US005825007A

United States Patent [19]

Jesadanont

[11] Patent Number: 5,825,007

[45] Date of Patent: Oct. 20, 1998

[54] AUTOMATIC NON-COMPUTER NETWORK NO-STOP COLLECTION OF EXPRESSWAY TOLLS BY PREPAID CARDS AND METHOD: PAY ACCORDING TO CATEGORY OF VEHICLE AND THE DISTANCE IT TRAVELS

[76] Inventor: Mongkol Jesadanont, c/o Dr. Sukanya Jesadanont, Faculty of Pharmaceutical Sciences, Chulalongkorn University, Bangkok 10330, Thailand

[21] Appl. No.: 643,635

[22] Filed: May 6, 1996

[51] Int. Cl.[6] ..... G07B 15/02

[52] U.S. Cl. ..... 235/384; 235/380

[58] Field of Search ..... 235/384, 380, 235/382; 364/401

[56] References Cited

U.S. PATENT DOCUMENTS

| | | | |
|---|---|---|---|
| 5,086,389 | 2/1992 | Hassett et al. | 364/401 |
| 5,101,184 | 3/1992 | Antes | 235/454 |
| 5,144,553 | 9/1992 | Hassett et al. | 364/401 |
| 5,310,999 | 5/1994 | Claus et al. | 235/384 |
| 5,451,758 | 9/1995 | Jesadanont | 235/384 |

*Primary Examiner*—Donald T. Hajec
*Assistant Examiner*—Karl Frech

[57] ABSTRACT

An automatic system is for collection of expressway tolls uses prepaid cards to pay toll while a vehicle is moving at a normal driving speed through a toll booth where computer network is not required. A tollroad with plurality of entrances and exits is provided toll booths one at each entrance and one at each exit. Each toll booth has a toll-collecting device having a support booth and a main booth. An in-vehicle unit is installed in the moving vehicle. Infrared radiation is used as communication apparatus between toll-collecting device and in-vehicle unit to make the system most cost-effective with very low cost of installation, versatile, accurate and virtually error-free compared with those systems using radio frequency for communication. Toll is collected as fixed or variable rates according to the type of vehicles classified by their height and the distance the vehicle travels, the longer the higher is the toll. A data processing means of in-vehicle device records data signals received and calculates toll from the two different modulation frequencies of infrared signals received one from the entrance and the other from the exit and reduces the calculated toll from the cash balance in the prepaid card. The card reader/writer rewrites new cash balance onto the card. Details on the number of each category of vehicles and the entrance they entered including total tolls collected are reported on display screen at each exit toll booth. The system can be used for interstate or international tollroads.

4 Claims, 47 Drawing Sheets

PRIOR ART

A, B & C = entrances

D, E & F = exits 0 hr. 0 min. 0 sec. 2.00 pm August 8, 1995

EXIT D

From Entrance A

| | | | |
|---|---|---|---|
| Saloon cars | 0 | Toll collected (฿) | 0 |
| Vans | 0 | Toll collected (฿) | 0 |
| Trucks | 0 | Toll collected (฿) | 0 |

From Entrance B

| | | | |
|---|---|---|---|
| Saloon cars | 0 | Toll collected (฿) | 0 |
| Vans | 0 | Toll collected (฿) | 0 |
| Trucks | 0 | Toll collected (฿) | 0 |

From Entrance C

| | | | |
|---|---|---|---|
| Saloon cars | 0 | Toll collected (฿) | 0 |
| Vans | 0 | Toll collected (฿) | 0 |
| Trucks | 0 | Toll collected (฿) | 0 |
| A total of tolls collected (฿) | | | 0 |

FIG. 10

1 hr. 20 min. 30 sec. 3.20.30 pm; August 8, 1995

EXIT D

| | | | |
|---|---|---|---|
| From Entrance A | | | |
| Saloon cars | 20 | Tolls collected (฿) | 1600 |
| Vans | 15 | Tolls collected (฿) | 1350 |
| Trucks | 10 | Tolls collected (฿) | 1000 |
| From Entrance B | | | |
| Saloon cars | 10 | Tolls collected (฿) | 700 |
| Vans | 30 | Tolls collected (฿) | 2400 |
| Trucks | 20 | Tolls collected (฿) | 1800 |
| From Entrance C | | | |
| Saloon cars | 20 | Tolls collected (฿) | 1200 |
| Vans | 10 | Tolls collected (฿) | 700 |
| Trucks | 20 | Tolls collected (฿) | 1600 |
| A total of tolls collected (฿) | | | 12350 |

FIG. 11

0 hr. 0 min. 0 sec. 12.00 am August 8, 1995

EXIT E

| | | | |
|---|---|---|---|
| From Entrance A | | | |
| Saloon cars | 0 | Toll collected (฿) | 0 |
| Vans | 0 | Toll collected (฿) | 0 |
| Trucks | 0 | Toll collected (฿) | 0 |
| From Entrance B | | | |
| Saloon cars | 0 | Toll collected (฿) | 0 |
| Vans | 0 | Toll collected (฿) | 0 |
| Trucks | 0 | Toll collected (฿) | 0 |
| From Entrance C | | | |
| Saloon cars | 0 | Toll collected (฿) | 0 |
| Vans | 0 | Toll collected (฿) | 0 |
| Trucks | 0 | Toll collected (฿) | 0 |
| A total of tolls collected (฿) | | | 0 |

FIG. 12

1 hr. 15 min. 10 sec. 1.15.10 pm; August 8, 1995

EXIT E

| | | | |
|---|---|---|---|
| From Entrance A | | | |
| Saloon cars | 30 | Tolls collected (฿) | 3000 |
| Vans | 20 | Tolls collected (฿) | 2200 |
| Trucks | 10 | Tolls collected (฿) | 1200 |
| From Entrance B | | | |
| Saloon cars | 10 | Tolls collected (฿) | 900 |
| Vans | 20 | Tolls collected (฿) | 2000 |
| Trucks | 10 | Tolls collected (฿) | 1100 |
| From Entrance C | | | |
| Saloon cars | 10 | Tolls collected (฿) | 800 |
| Vans | 15 | Tolls collected (฿) | 1350 |
| Trucks | 20 | Tolls collected (฿) | 2000 |
| A total of tolls collected (฿) | | | 14550 |

FIG. 13

0 hr. 0 min. 0 sec. 10.00 am August 8, 1995

EXIT F

| | | | |
|---|---|---|---|
| From Entrance A | | | |
| Saloon cars | 0 | Toll collected (฿) | 0 |
| Vans | 0 | Toll collected (฿) | 0 |
| Trucks | 0 | Toll collected (฿) | 0 |
| From Entrance B | | | |
| Saloon cars | 0 | Toll collected (฿) | 0 |
| Vans | 0 | Toll collected (฿) | 0 |
| Trucks | 0 | Toll collected (฿) | 0 |
| From Entrance C | | | |
| Saloon cars | 0 | Toll collected (฿) | 0 |
| Vans | 0 | Toll collected (฿) | 0 |
| Trucks | 0 | Toll collected (฿) | 0 |
| A total of tolls collected (฿) | | | 0 |

FIG. 14

1 hr. 2 min. 5 sec. 11.02.05 am August 8, 1995

EXIT F

| | | | |
|---|---|---|---|
| From Entrance A | | | |
| Saloon cars | 10 | Toll collected (฿) | 1200 |
| Vans | 10 | Toll collected (฿) | 1400 |
| Trucks | 10 | Toll collected (฿) | 1600 |
| From Entrance B | | | |
| Saloon cars | 15 | Toll collected (฿) | 1650 |
| Vans | 20 | Toll collected (฿) | 2600 |
| Trucks | 30 | Toll collected (฿) | 4500 |
| From Entrance C | | | |
| Saloon cars | 10 | Toll collected (฿) | 1000 |
| Vans | 20 | Toll collected (฿) | 2400 |
| Trucks | 40 | Toll collected (฿) | 5200 |
| A total of tolls collected (฿) | | | 21550 |

FIG. 15

AUTOMATIC NON-COMPUTER NETWORK NO-STOP COLLECTION OF EXPRESSWAY TOLLS BY PREPAID CARDS AND METHOD: PAY ACCORDING TO CATEGORY OF VEHICLE AND THE DISTANCE IT TRAVELS

BACKGROUND

In U.S. Pat. No. 5,451,758 of Jesadanont, an automatic system for collection of expressway tolls has been disclosed using infrared signals of predetermined modulation frequencies as communication means between toll booths and the vehicles where computer network is not necessary. Toll can be paid by the driver while he is passing the toll booth at normal driving speeds with no need to stop or slow down. Toll is deducted from the amount of money present in a prepaid card either of optically-coded or magnetically-coded type while being inserted in a card reader/writer of a in-vehicle unit (IVU) installed under the front windshield in a vehicle. Such system can be regarded as a breakthrough improvement over all those previously existing toll-collection systems as to tremendous reduction of capital needed to be invested for installation of the system and all the effective and efficient features together with conveniences of toll authorities in handling toll collection, user's privacy, versatility and the ease of use. In principle, the system using infrared radiation as communication means can serve all the necessary functions of a toll-collection system including its versitilities as it is possible to use such system for different tollroads belong to different toll agencies which is at present a main problem for interstate driving, however in the previous U.S. Pat. No. 5,451,758 of Jesadanont has not yet described all the detailed features as how to identify the vehicles and how to handle the toll collection during a traffic jam at a toll booth together with, how to verify the daily revenues at each exit and as a whole. The present invention describes in details these certain features, as follows:

1) during a traffic jam, between first and second car there must be enough space since too close the second car following the first car may result in prolonged delay of cancellation of the activation of an alarm and a camera at the toll booth (FIG. 1- prior art) and thus, devices at the toll booth may falsely operate,
2) the categories of vehicles passing the toll booth need to be identified since different tolls need to be collected from different types of vehicles, whether it is a saloon car, a van, a truck or a bus.
3) Several other components both at the toll booth and of the in-vehicle-unit need to be added to the previous system of Jesadanont (FIG. 2—prior art) to allow efficient identification of vehicle are to be described in the present invention.
4) In those previously available system for toll-collection using a 'Tag' attached to a front glass windshield of a vehicle, a user needs to deposit a considerable amount of money with the toll authority and has to refill after being used only about half of the amount. This is rather unfair to the user. While in this proposed new Jesadanont's system, the user can choose buying prepaid cards of various prices at his will and uses until the amount of cash balance left in the card is less than the maximum toll for that particular tollroad.
5. Using those previously available system for toll-collection, most of the time it is not possible for the driver to know right at the moment of passing the toll booth how much exactly the toll is deducted and how much is left in the 'Tag'. This is quite undesirable for the user, since too often there has been mistakes such that erroneously higher amount was deducted. User thus has no confidence in the system and thus mostly leads to refusal to using such system. These are not the case for the presently proposed system of the Jesadanont automatic toll collection device. The amount of cash balance left in a prepaid card is shown at all time on a display screen of a in-vehicle unit and deduction is also show clearly on the screen. Thus left the user with no doubt as he is passing through the toll booth.
6) There should also be a way to check how many vehicles enter at each entrance and accordingly how many vehicles leave at each exit. The total number of vehicles enter and vehicles exit should be equal and the total daily revenue should be known. This assists the toll authorities to verify their daily revenue.

Those previously available toll-collection systems using a 'tag' to act as a reflective transmitter or discrete transmitter and radio frequency identification technique, in addition, have too often confronted with the problems of interference of the frequency which results in serious operation failure. These problems are now shown to be true in too many places in the world. This is surely unfair and too disturbing to user. Moreover, user can never know how much had been deducted each time he passed the toll booth and whether the cash balance had been erroneously deducted than it should be. All these problems resulted in total refusal of expressway users to use such automatic toll collection system.

A toll collection system has been described by Claus et al, (U.S. Pat. No. 5,310,999) using the data signals of the radio frequency (RF) range for transmission through the air where a vehicle-mounted unit communicates with two antenna to make toll payments and transfer data to/from a smart card inserted therein. Their system suffers from the fact that using the RF as means for paying toll, there can always be communication interferences intentionally or unintentionally which leads to false deduction of toll from the amount present in the smart card either too low or too high. Besides, the cost of a smart card is unnecessarily too high for this particular purpose while the presently available prepaid cards either the optically coded cards or the magnetically coded cards can be very appropriately used. Using the optically coded cards like that of LGZ Landis & Gyr Zug AG, Zug, Switzerland (U.S. Pat. No. 5,101,184) is the best to provide the antifraud mechanism where the used information part for paying of the card is permanently destroyed optically and can never be fraudly rewritten to increase the amount of money in the card in addition to its much lower cost of production than the smart card. This can thus fully serve the purpose. User can buy two cards at a time to provide convenience when a first card is used up, he can then change to a second card instantaneously with no need to stop proceeding his car. The amount deducted from the card can never be exceed the amount present in the card and therefore can save the driver from erroneously high deduction of toll which is possible during an electricity disturbance like that in those systems using computer network and credit cards as means for paying tolls.

All the other systems of automatic toll collection using the computer network, the users must make a deposit account. In addition, if the computer network is out of order, there can always be mistakes in deduction for toll payment which results in arguments between the toll authority and the driver.

The objectives of the invention described here are:

(1) to provide a toll-collecting system which can identify the types of vehicles passing each toll booth, yet is very simple, convenient, highly effective while at very low cost for installation, operation, and maintenance of the system for collection of expressway tolls;

(2) to provide a toll-collecting system which can fairly collect tolls according to the distance the driver travels along a tollroad having a plurality of entrances and exits, the farther the more expensive is the toll;

(3) to provide a toll-collecting system which is fair to the users as the cash balance in the prepaid card is shown on the display screen of the in-vehicle device at all time while the device is on and during the process of paying toll. User can know all the time how much remained in the prepaid card and how much is deducted each time he has paid the toll;

(4) to provide a toll-collecting system in which the user can choose to buy the prepaid card of different amount of cash balance as he desires;

(5) to speed up the flow of traffic through toll plazas especially during rush hours, thus increase economical fuel usage by eliminating the stop-and-go driving;

(6) to help the vehicle drivers eliminate the time required to stop to pay a toll since the vehicles can pass through a toll station at a normal driving speed;

(7) to reduce the number of toll booth operators needed at each toll station;

(8) to promote better securities for toll authorities at each toll booth since the total amount of cash collected daily at any toll plazas is reduced to minimum using this automatic toll collection;

(9) to eliminate the great burden of the billing systems such as those need in the system using computer-network and the credit cards or even the smart cards;

(10) to reduce the incidence of serious car accidents which is most likely when those vehicles of speed have to come to a full stop to pay toll, especially in those poor weather conditions; and

(11) to help solve the problems for driver using many tollways belonged to different toll agencies like those interstates as in the United States or international as in Europe since the toll agencies can issue the prepaid card of their own to be inserted in and turns on the same single in-vehicle device to transmit the infrared beam of a predetermined modulation frequency specified to inform the corresponding toll-collecting device of a particular tollroad.

SUMMARY OF THE INVENTION

The present invention describes an automatic system for collection of toll from a vehicle moving at a normal driving speed along an expressway with a plurality of entrances and exits where a computer-network is not required. Toll can be collected as a fixed rate or variable rates according to the distance between a couple of entrance and exit a vehicle operator drives and the category a vehicle belongs to. Infrared signals are used as communication means between the toll-collecting device at each toll booth and an in-vehicle unit installed in the moving vehicle.

A toll collection system comprises of toll booths, one at a entrance and one at the exit for each lane of the expressway, and an in-vehicle unit to be installed in a moving vehicle. Each toll booth has a toll-collecting device comprising a main booth and a support booth located at fixed positions apart on an expressway. At the booth canopy of each support booth, there are a red light, a green light, first voice alarm, first camera, a Light-Emitting Diode (LED) emitting an infrared beam of switch on tailing-up type, and a Light-Emitting Diode (LED) emitting an infrared beam of switch on tailing-down type. All components at support booths are identical either of an entrance or an exit. At main booth of an entrance there is first Central Processing Unit (CPU) which controls functions of all components both at support booth and at main booth. All other components at canopy of main booth of an entrance are first comparator which is connected to an infrared beam receiver, an infrared beam transmitter which is a LED emitting an infrared beam of a unique predetermined modulation frequency identifying each toll booth, three LEDs emitting infrared beams of switch on tailing-up type which help to identify a vehicle with regard to its height, a LED emitting an infrared beam of switch on tailing-down type, second voice alarm being connected to an orange light bulb, and second camera. The three LEDs, identifying the category of a vehicle, emit infrared beams perpendicularly and having their ends at 0.50 meter, 2.0 meters and 2.80 meters, respectively, above road surface. At canopy of main booth of each exit there are all components identical to those of main booth of an entrance and, in addition, a display screen, having a digital clock indicating the time, date, month and year at any particular time point, and a timer with its reset button connected thereto where all these are connected to second CPU; and an additional receiver also connected to second comparator to receive an infrared signal of a modulation frequency identical to a modulation frequency identifying an entrance transmitted from a transmitter of an in-vehicle unit installed in a moving vehicle. An in-vehicle unit (IVU) to be installed in third moving vehicle comprises of a central processing unit (CPU) with its memory unit, capable of processing the data received from the other components in the IVU, executing the calculation of tolls and commanding the other components in the IVU to function, third comparator, an infrared receiver connected thereto third comparator, an infrared transmitter to transmit an infrared signal of a predetermined modulation frequency for identifying said vehicle to inform both CPUs of said entrance and said exit to command the infrared beam(s) of switch on tailing-up type of both main booths not to be sent out according to the category of moving vehicle, an infrared transmitter to transmit an infrared signal whose frequency is identical to the predetermined modulation frequency identifying the entrance from which vehicle had entered, third voice alarm, with a red light bulb connected thereto, a prepaid card reader/writer, having a display screen to show a number representing an amount of money left in a prepaid card or an information storing means and capable of reading and writing information onto the prepaid card, a prepaid card wherein there are two tracks, a password track and a number of count track.

The method of automatic collection of toll from a vehicle moving along an expressway comprises steps of:

1. Inserting a prepaid card having a number of count representing an amount of money sufficient for paying maximum toll for the longest distance of an expressway into a card holder of an IVU. This turns on IVU. When all the components are ready and the prepaid card is a valid one, CPU then actuates the transmitter to transmit an infrared beam of specific modulation frequency identifying the vehicle to communicate with a toll-collecting device installed at the toll booth. In case where the card is not valid IVU is not turned on or if number of count is not sufficient voice alarm of IVU is actuated and red light bulb of IVU starts blinking to notify driver not to use automatic toll booth;

2. Arriving at a toll booth of an entrance, a driver must wait in front of a support booth if a red light of the support booth is blinking which indicates that the preceding vehicle has not yet moved out of the toll booth. Only when the red light is off and a green light of the support booth is on and blinks that the driver is allowed to enter the support booth;

3. Receiving the infrared beam of specific modulation frequency identifying the vehicle by the receiver at the main booth, comparing by the comparator and sending the information to the CPU of the main booth;

4. Commanding by the CPU of the main booth the LED(s) emitting the infrared beam(s) of switch on tailing-up type corresponding to the type of vehicle passing to stop emitting (i.e. for a vehicle of a height equal to or greater than 2.80 meters, all three LEDs are turned off; for a vehicle of a height equal to or greater than 2.00 meters but less than 2.80 meters, the two LEDs emitting infrared beams with their ends at 2.00 and 2.80 meters above the road surface are turned off; while for a vehicle of a height less than 2.00 meters, only one LED emitting an infrared beam with its end at 0.50 meter above the road surface is turned off);

5. Commanding by CPU the transmitter at main booth to transmit the infrared beam of predetermined modulation frequency identifying the entrance.

6. Receiving infrared beam identifying the entrance by receiver of IVU, comparing and memorizing information in a memory unit of CPU of IVU;

7. Transmitting out an infrared beam of a frequency identical to the one identifying the entrance from a transmitter of IVU through a front glass windshield of the vehicle at all time while moving towards an exit;

8. No blocking of any of infrared beam(s) of switch on tailing-up type by vehicle and thus there is no activation of voice alarm or orange light bulb or camera of main booth;

9. Blocking by moving vehicle of an infrared beam of switch on tailing-down type at main booth, where moving of vehicle out from beam causes CPU to command all the three LEDs to reemit out all the three beams of switch on tailing-up type at main booth and at support booth LED emitting infrared beam of switch on tailing-up type to turn off, green light bulb to turn on and blink and the red light bulb to turn off. This indicates that the next vehicle can enter the support booth;

10. At support booth of the an exit, the vehicle is allowed to pass into the support booth in a similar manner as at the entrance;

11. At the main booth of the an exit, receiving an infrared beam identifying the vehicle by the receiver of the main booth, comparing the signal and sending the information to the CPU at the main booth causes the CPU to command the LED(s) emitting the infrared beam of switch on tailing-up type corresponding to the type of the vehicle to turn off in a similar manner as at the main booth of the entrance;

12. Receiving, by receiver of IVU, infrared beam of a predetermined modulation frequency identifying exit transmitted from transmitter at main booth, comparing and sending information to CPU of IVU;

13. Processing by CPU of IVU using two predetermined modulation frequencies received, one from entrance and one from exit which results in amount of toll needs to be paid and reducing toll calculated from cash balance present in prepaid card;

14. Instructing by CPU card reader/writer to rewrite resulting new cash balance onto prepaid card and to display new cash balance on its display screen, and ejecting out prepaid card from card holder;

15. Receiving by a receiver at main booth of an exit, infrared beam identifying entrance from which the vehicle has entered transmitted from transmitter of IVU, comparing and sending information to CPU of main booth;

16. Commanding by CPU of main booth of an exit to display on display screen at the exit the total number of vehicles of each category according to the entrance the vehicles entered and the total amount of toll collected at a particular time point from the preset time;

17. Commanding by CPU of main booth all LEDs emitting all infrared beam(s) of switch on tailing-up type to reemit back all beams, while commanding LED at support booth to stop emitting infrared beam of switch on tailing-up type, red light bulb to turn off and green light bulb to turn on and blink as a signal to allow a next vehicle to enter support booth. Thus a new cycle of automatic toll collection starts;

18. Activation of alarm either at support booth or main booth of either entrance or an exit if any of infrared beams of switch on tailing-up type is blocked by vehicle which will occur only when such a vehicle enters support booth while red light bulb is not yet turned off and green light bulb is not yet turned on and blinks or vehicle has no authentic means of paying toll, once any alarm is activated camera will take picture of invading vehicle and driver is then arrested.

The invention presently described is capable of collecting expressway toll from a moving vehicle according to the distance the vehicle travels and the category a vehicle belongs to, where vehicles can be classified as many categories as required by assigning as equal number of LEDs emitting equal number of infrared beams of switch on tailing- up type having the ends at a certain distance above the road surface corresponds to minimum height of a vehicle it can detect. Using infrared beams as means for communication between toll booth and a moving vehicle presents an accurate, precise and most cost-effective way of toll collection while a driver can check at all time a accuracy of a deduction of toll from a cash balance of a prepaid card on a display screen of a prepaid card reader/writer in an in-vehicle unit. Yet he can conveniently buy two cards at a time to replace with a second card when first one is used up. Toll authority may collect the money in advance before using of expressway takes place and know total collection of toll at any time point desired.

BRIEF DESCRIPTION OF THE DRAWINGS

All numericals in meter(s) shown in the drawings are for illustrative purpose only and do not reflect the actual scale.

FIG. 10 shows a display screen at an exit toll booth D in a situation while there is no vehicle passing through;

FIG. 11 shows a display screen at an exit toll booth D in a situation while a vehicle had already passed through;

FIG. 12 shows a display screen at an exit toll booth E in a situation while there is no vehicle passing through;

FIG. 13 shows a display screen at an exit toll booth E in a situation while a vehicle had already passed through;

FIG. 14 shows a display screen at an exit toll booth F in a situation while there is no vehicle passing through;

FIG. 15 shows a display screen at an exit toll booth F in a situation while a vehicle had already passed through;

FIG. 22 shows a vehicle arriving at the support booth of an entrance where a red light of the support booth is blinking, the driver, however, tries to invade through;

DESCRIPTION OF THE PREFERRED EMBODIMENT

The present invention describes an automatic toll-collecting system where a computer network is not required. Using infrared signals as communicating means between sets of transceivers at the toll booths and sets of transceivers of an in-vehicle unit (IVU) being carried in the vehicle, toll is collected while a driver is driving his vehicle through a toll booth at a normal driving speed. The present automatic toll collecting system can distinguish the different categories of vehicles according to their heights and collect toll accordingly. Toll is collected also according to the distance one travels along an expressway, the longer is the distance the more expensive is the toll. Thus, toll is collected according to both the category of the vehicle and the distance a vehicle travels on an expressway.

Figure 5:
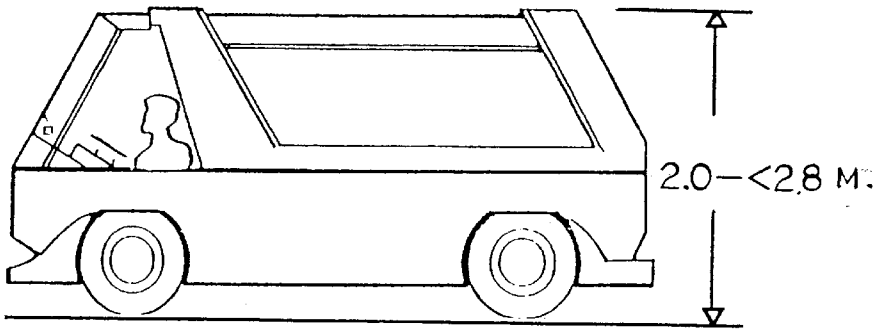
FIG. 5 is a van or any vehicle of a height equal to or greater than 2.0 meters but less than 2.8 meters.
Figure 4:
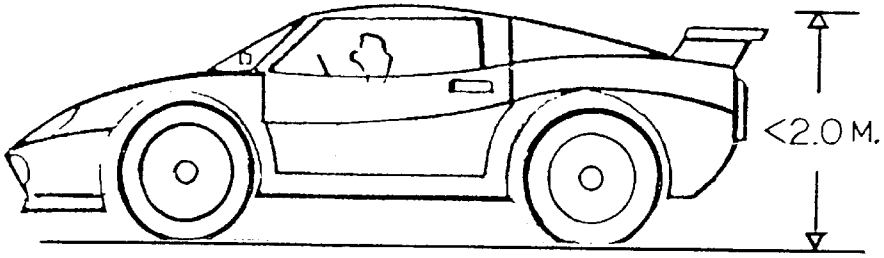
FIG. 4 is a saloon car or any car of a height less than 2.0 meters.
Figure 6:
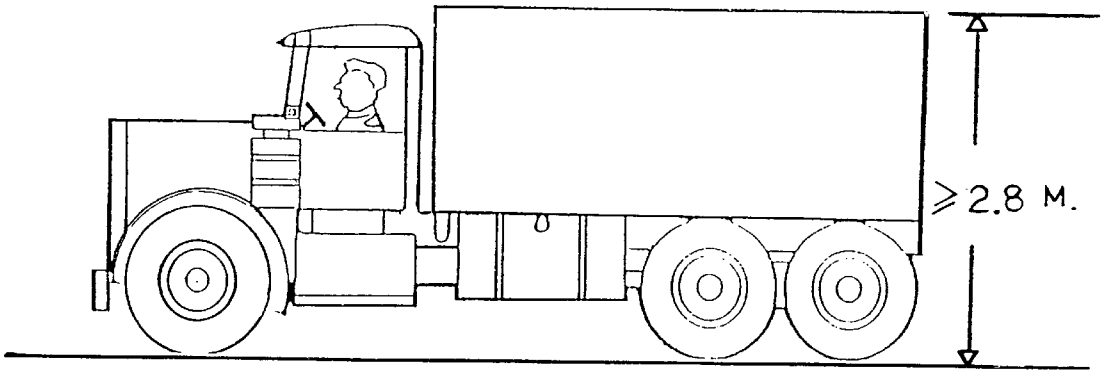
FIG. 6 is a truck or a bus of a height equal to or greater than 2.8 meters.

In the present invention, vehicles will be classified into 3 categories according to their heights although many more categories can also be classified. They are classified as follow:

(1) saloon car or any vehicles of a height less than 2.0 meters, as in FIG. 4, and (2) van or any vehicles of a height equal to or greater than 2.0 meters but less than 2.80 meters, as in FIG. 5, and (3) truck or any vehicles of a height equal to or greater than 2.80 meters, as in FIG. 6.

In addition, this system is capable of showing the summation of a total number of each type of vehicles using any pairs of entrance and exit at any time points on a display screen of each exit such that each toll booth usage and the total revenue can be verified by toll authorities at any time and hence daily. More particularly, a driver can at all time know the amount of toll deducted and the amount of money left in his prepaid card, a feature can never be provided by any other automatic toll-collecting systems.

Figure 7:
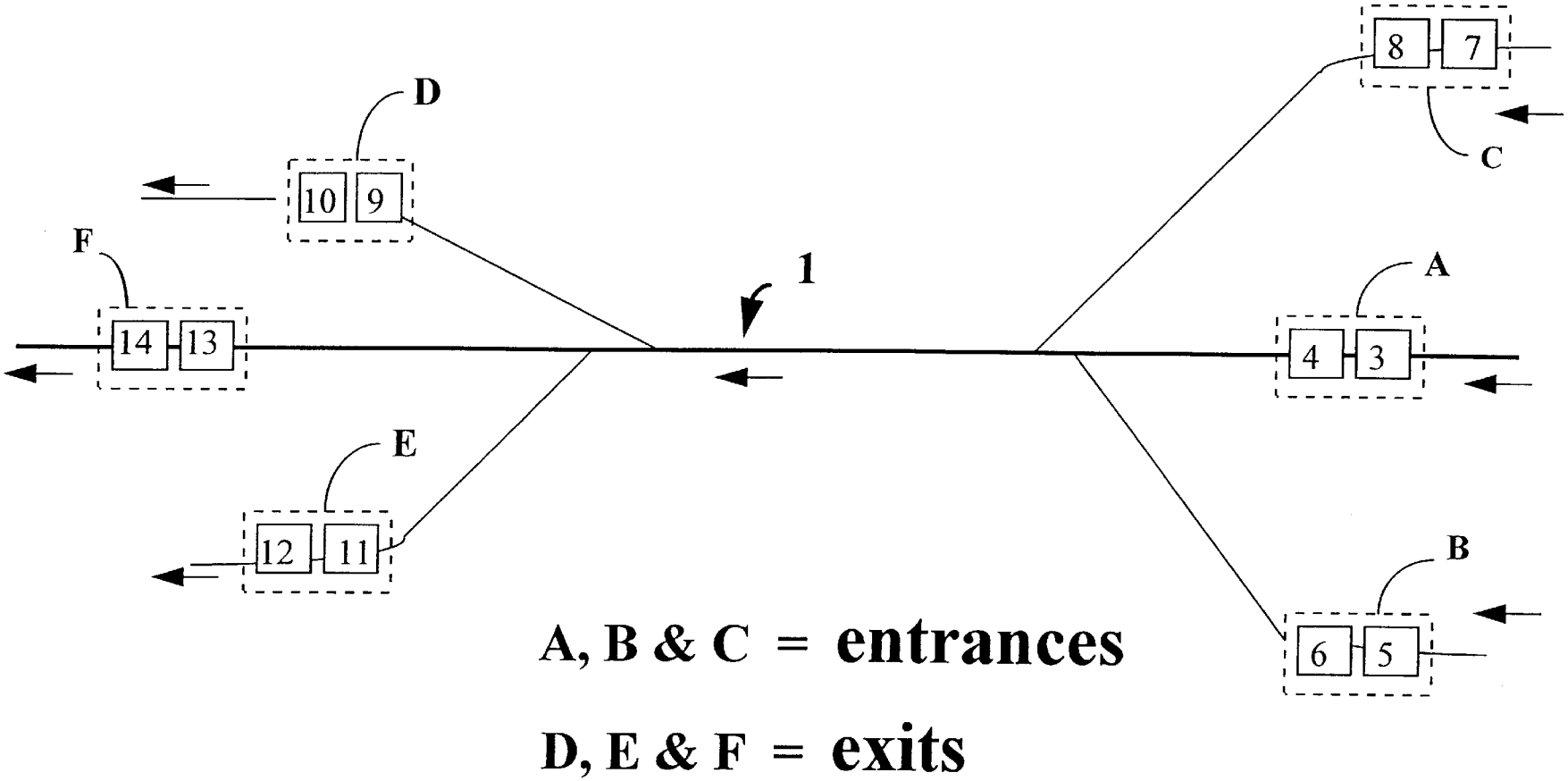
FIG. 7 shows an expressway of the present invention diagramatically where any toll station either at the entrance or the exit each consists of a main booth and a support booth.

As shown in FIG. 7, an expressway 1 consists of a plurality of Entrances A, B and C and a plurality of Exits D, E and F. Each of an entrance and an exit is composed a support booth and a main booth, where all the components in the support booth either at an entrance or at an exit are identical but the main booth at an exit has some more components in addition to those of the main booth at an entrance.

According to FIG. 7,

Entrance A consists of support booth 3 and main booth 4,

Entrance B consists of support booth 5 and main booth 6,

Entrance C consists of support booth 7 and main booth 8,

Exit D consists of support booth 9 and main booth 10,

Exit E consists of support booth 11 and main booth 12, and

Exit F consists of support booth 13 and main booth 14.

Figure 8:
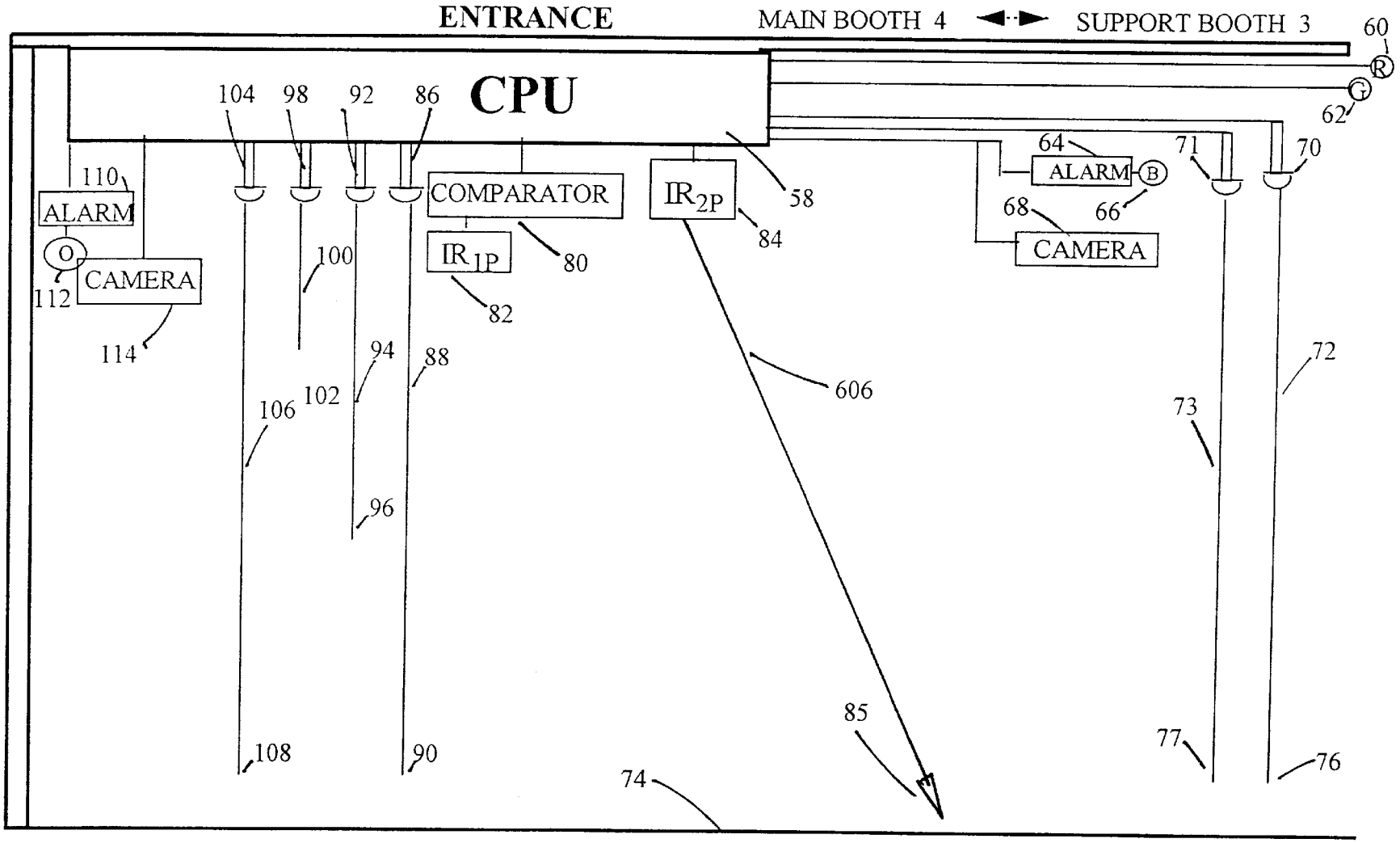
FIG. 8 is a side view of a toll booth at each entrance of an expressway showing all its components.

At Entrances A, B and C, as shown in FIG. 8 which is a side-view, each consists of a support booth and a main booth with a CPU (Central Processing Unit) 58 which is a microprocessor capable of processing all the data received from a comparator 80 and controlling the functions of all the components both at the support booth and the main booth.

At each support booth, the components which are connected to and being controlled by CPU 58 are:

(1) a red light bulb 60;

(2) a green light bulb 62;

(3) a voice alarm 64 which can be actuated to give a periodic high frequency audible signal, with a blue light bulb 66 connected thereto;

(4) a camera 68;

(5) a light-emitting diode (LED) 70 which emits an infrared beam 72 down perpendicularly to the road surface 74 of expressway 1. The end 76 of the infrared beam 72 ends at 0.50 meter above the surface 74. At this distance the infrared beam 72 can detect the passage of any types of vehicles of any heights equal to or greater than 0.50 meter passing through the support booth;

(6) a LED 71 which emits an infrared beam 73 down perpendicularly to the road surface 74 of expressway 1. The end 77 of the infrared beam 73 ends at 0.50 meter above the surface 74. At this distance the infrared beam 73 can detect the passage of any types of vehicles of any heights equal to or greater than 0.50 meter passing in the support booth.

At the main booth of each Entrance A, B and C, all the components are connected to and controlled by CPU 58. These are:

(1) a comparator 80, which has an infrared signal receiver $IR_{1P}$ 82 connected thereto;

(2) a transmitter $IR_{2P}$ 84, is a LED transmitting an infrared beam 606 down at all time making an inclination angle towards the support booth, by the command from CPU 58. This infrared beam is of switch on tailing-up type and of a predetermined fixed modulation frequency identifying each main booth of each entrance which is different from any other entrances. This particular predetermined frequency is transmitted out by $IR_{2P}$ of each toll station at all time and serves as the identification frequency of that particular toll station.

The end 85 of infrared beam 606 is 0.5 meter above the road surface 74;

(3) a LED 86, emitting an infrared beam 88 of switch on tailing-up type perpendicularly to the road surface 74 of expressway 1. The end 90 of the infrared beam 88 ends at 0.50 meter above the surface 74. At this distance the infrared beam 88 can detect the passage of any types of vehicles of any different heights equal to or greater than 0.50 meter passing through the main booth such as a saloon car (assigned to have a height less than 2.0 meters in this invention), as in FIG. 4; a van (assigned to have a height equal to or greater than 2.0 meters but less than 2.80 meters), as in FIG. 5; and a truck (assigned to have a height equal to or greater than 2.80 meters), as in FIG. 6;

(4) a LED 92, emitting an infrared beam 94 of switch on tailing-up type out perpendicularly to the road surface 74 of expressway 1. The end 96 of the infrared beam 94 ends at 2.0 meters above the surface 74. At this distance the infrared beam 94 can detect the passage of any types of vehicles of any different heights equal to or greater than 2.0 meters passing through the main booth such as vans or trucks of the height equal to or greater than 2.0 meters, where saloon cars which has the height less than 2.0 meters can not be detected;

(5) a LED 98, emitting an infrared beam 100 of switch on tailing-up type out perpendicularly to the road surface 74 of expressway 1. The end 102 of the infrared beam 100 ends at 2.80 meters above the surface 74. At this distance the infrared beam 100 can detect the passage of any types of vehicles of any different heights equal to or greater than 2.80 meters passing through the main booth such as trucks or buses of the height equal to or greater than 2.80 meters , where saloon cars or vans which has a height less than 2.80 meters can not be detected;

(6) a LED 104, emitting an infrared beam 106 of switch on tailing-down type down at all time perpendicularly to the road surface 74 of expressway 1. The end 108 of the infrared beam 106 ends at 0.50 meter above the surface 74. At this distance the infrared beam 106 can detect the passage of any types of vehicles of any different heights which are equal to or greater than 0.50 meter passing through the main booth of this expressway;

(7) a voice alarm 110, which can be actuated to give a siren audible signal, with an orange light bulb 112 connected thereto these make it quite distinguishable from that voice alarm 64 and the blue light bulb 66 of the support booth;

(8) a camera 114;

All these components are located at toll booth canopy of the entrance.

Figure 9:
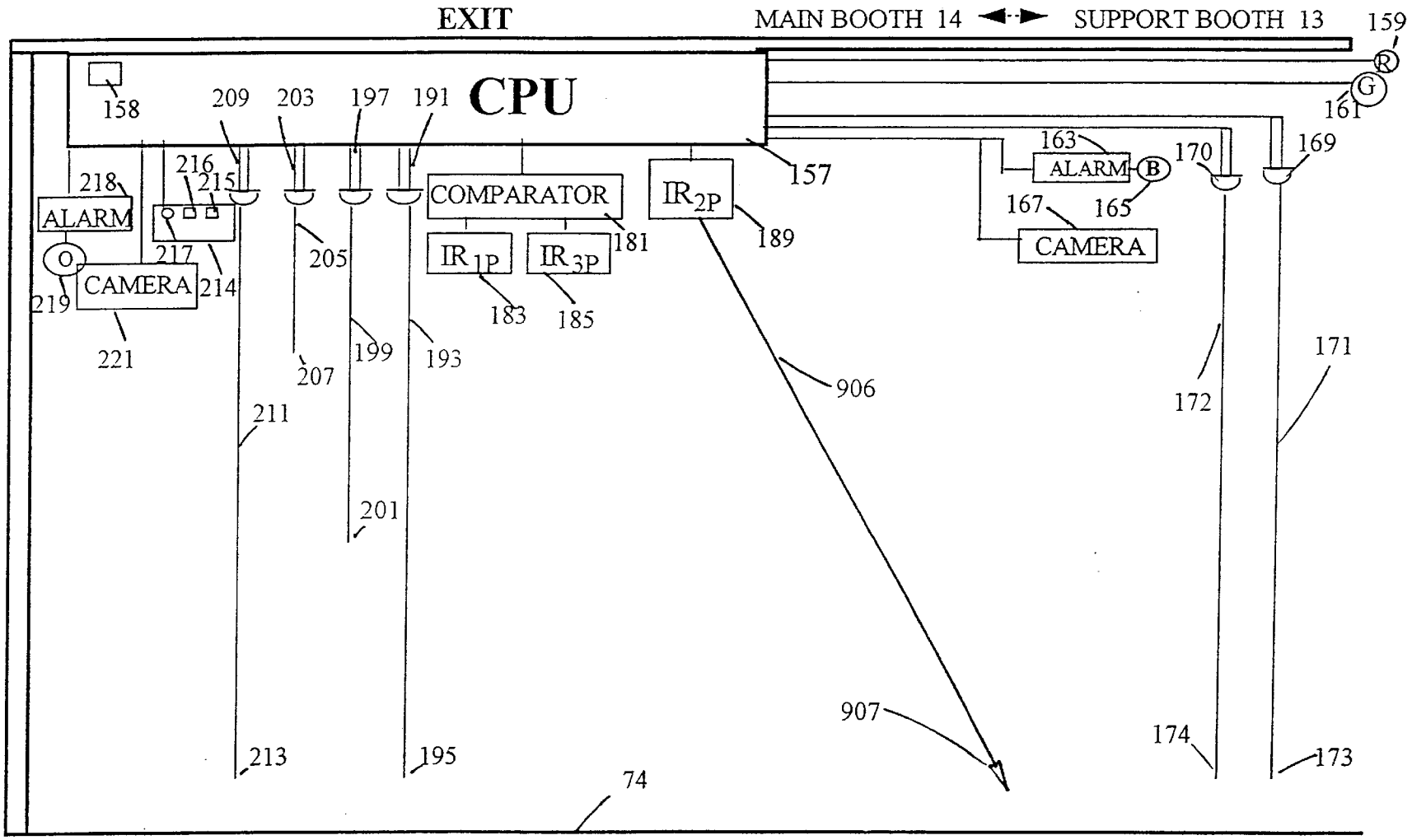
FIG. 9 is a side view of a toll booth at each exit of an expressway showing all its components.

At Exits D, E and F, as shown in FIG. 9 which is a side-view, each consists of a support booth and a main booth with a CPU (Central Processing Unit) 157 together with its memory unit 158. CPU is a microprocessor capable of processing all the data received from a comparator 181 and controlling the functions of all the components both at the support booth and the main booth.

At each support booth, the components which are connected to and being controlled by the CPU 157 are:

(1) a red light bulb 159;

(2) a green light bulb 161;

(3) a voice alarm 163 which can be actuated to give a periodic high frequency audible signal, with a blue light bulb 165 connected thereto;

(4) a camera 167;

(5) a LED 169 which emits an infrared beam 171 out perpendicularly to the road surface 74 of expressway 1. The end 173 of the infrared beam 171 ends at 0.50 meter above the surface 74. At this distance the infrared beam 171 can detect the passage of any types of vehicles of any different heights which are equal to or greater than 0.50 meter passing through the support booth;

(6) a LED 170 which emits an infrared beam 172 out perpendicularly to the road surface 74 of expressway 1. The end 174 of the infrared beam 172 ends at 0.50 meter above the surface 74. At this distance the infrared beam 172 can detect the passage of any types of vehicles of any different heights which are equal to or greater than 0.50 meter passing through the support booth.

At the main booth of each Exit D, E and F, all the components are connected to and controlled by CPU 157. These are:

(1) a comparator 181, which has two infrared signal receivers $IR_{1P}$ 183 and $IR_{3P}$ 185 connected thereto;

(2) a transmitter $IR_{2P}$ 189, is a LED transmitting an infrared beam 906 down making an inclination angle towards the support booth at all time by the command from CPU 157. This infrared beam is of a predetermined fixed modulation frequency identifying each main booth of each exit which is different from that of any other exits. This particular predetermined frequency is transmitted out by $IR_{2P}$ of each toll station at all time and serves as the identification frequency of that particular toll station;

For each entrance or exit, no matter how many toll booths it has at that toll plaza, each toll booth will have the same particular predetermined modulation frequency emitted from the transmitter $IR_{2P}$, for example, if there are five toll booths at Entrance A, each $IR_{2P}$ 84 of each toll booth is to emit an infrared beam 606 of the same modulation frequency of 10 KHz or if there are six toll booths at Exit F, each $IR_{2P}$ 189 of each toll booth is to emit an infrared beam 906 of the same modulation frequency of 60 KHz.

The end 907 of infrared beam 906 is 0.50 meter above the road surface 74;

(3) a LED 191, emitting an infrared beam 193 down perpendicularly to the road surface 74 of expressway 1. The end 195 of the infrared beam 193 ends at 0.50 meter above the surface 74. At this distance, the infrared beam 193 can detect the passage of any types of vehicles of any different heights which are equal to or greater than 0.50 meter passing through the main booth such as saloon cars (assigned to have a height less than 2.0 meters in this invention), as in FIG. 4; vans (assigned to have a height equal to or greater than 2.0 meters but less than 2.80 meters), as in FIG. 5; and trucks (assigned to have a height equal to or greater than 2.80 meters), as in FIG. 6;

(4) a LED 197, emitting an infrared beam 199 down perpendicularly to the road surface 74 of expressway 1. The end 201 of the infrared beam 199 ends at 2.0 meters above the surface 74. At this distance the infrared beam 199 can detect the passage of any types of vehicles of any different heights equal to or greater than 2.0 meters passing through the main booth such as vans or trucks of the height equal to or greater than 2.0 meters, where saloon cars or any cars which have their height less than 2.0 meters can not be detected;

(5) a LED 203, emitting an infrared beam 205 down at all time perpendicularly to the road surface 74 of expressway 1. The end 207 of the infrared beam 205 ends at 2.80 meters above the surface 74. At this distance the infrared beam 205 can detect the passage of any types of vehicles of any different heights equal to or greater than 2.80 meters passing through the main booth such as trucks or buses of the height equal to or greater than 2.80 meters, where saloon cars or vans which have their height less than 2.80 meters can not be detected;

(6) a LED 209, emitting an infrared beam 211 down at all time perpendicularly to the road surface 74 of expressway 1. The end 213 of the infrared beam 211 ends at 0.50 meter above the surface 74. At this distance the infrared beam 211 can detect the passage of any types of vehicles of any different heights which are equal to or greater than 0.50 meter passing through the main booth of this expressway;

(7) a display screen 214 as in FIGS. 10–15, having a digital clock 215 indicating the time, date, month and year at any particular time point, a timer 216 that can measure an elapsed time to record the number and the types of vehicles using that particular exit, and a reset button 217 to reset all the data shown on the display screen to 0. This timer 216 and the reset button 217 are connected directly to the CPU 157 at each exit; where FIG. 10 shows a display screen at Exit D in a standby condition where there is no vehicle passing through;

FIG. 11 shows a display screen at Exit D in a condition where a vehicle has already passed through;

FIG. 12 shows a display screen at Exit E in a standby condition where there is no vehicle passing through;

FIG. 13 shows a display screen at Exit E in a condition where a vehicle has already passed through;

FIG. 14 shows a display screen at Exit F in a standby condition where there is no vehicle passing through; and FIG. 15 shows a display screen at Exit F in a condition where a vehicle has already passed through;

(8) a voice alarm 218, which can be actuated to give a siren audible signal, with an orange light bulb 219 connected thereto. This makes it quite distinguishable from that voice alarm 163 and the blue light bulb 165 of the support booth;

(9) a camera 221.

All these components are located at toll booth canopy of the exit, except for the display screen 214 can be installed at the exit observe room.

The infrared beams 72, 88, 94 and 100 of the Entrances A, B and C together with the infrared beams 171, 193, 199 and 205 of the Exits D, E and F are those of 'switch on tailing-up' type which means once any of these beams is blocked by a vehicle, this will cause CPU to actuate the alarm and the camera to start taking the picture of the invading vehicle's license plate right away.

However, the infrared beams 73 and 106 of the Entrances A, B and C together with the infrared beams 172 and 211 of the Exits D, E and F are those of 'switch on tailing-down' type which means once any of these beams is blocked by a vehicle, only after the vehicle has already moved away from the beam that will cause the CPU to actuate the other components to start functioning. The followings are how all these components function:

(1) at the support booth each of the Entrances A, B or C; only after vehicles have blocked the infrared beam 73, and have moved away from the beam 73 that CPU 58 starts commanding LED 70 to emit the infrared beam 72 downward, and at the same time turning the green light bulb 62 off and turning the red light bulb 60 on and blinks;

(2) at the main booth each of the Entrances A, B or C 2.1 In case of saloon cars or any vehicles of the height less than 2.0 meters, only after the vehicles have blocked the infrared beam 106, and have moved away from the beam 106, that CPU 58 starts commanding LED 86 to emit the infrared beam 88 downward. At the same time, CPU 58 also commands LED 70 to stop emitting the infrared beam 72 downward at the support booth, and turns the red light bulb 60 off, the green light bulb 62 on and blinks to allow the next vehicle to enter the support booth of the entrance.

2.2 In case of vans or any vehicles of the height equal to or greater than 2.0 meters, only after the vehicles have blocked the infrared beam 106, and have moved away from the beam 106, that CPU 58 starts commanding LEDs 86 and 92 to emit the infrared beams 88 and 94 downward, respectively.

At the same time, CPU 58 also commands LED 70 to stop emitting the infrared beam 72 downward at the support booth, and turns the red light bulb 60 off, the green light bulb 62 on and blinks to allow the next vehicle to enter the support booth of the entrance.

2.3 In case of trucks or any vehicles of the height equal to or greater than 2.80 meters, only after the vehicles have blocked the infrared beam 106, and have moved away from the beam 106, that CPU 58 starts commanding LEDs 86, 92 and 98 to emit the infrared beams 88, 94 and 100, respectively downward. At the same time, CPU 58 also commands LED 70 to stop emitting the infrared beam 72 downward at the support booth, and turns the red light bulb 60 off, the green light bulb 62 on and blinks to allow the next vehicle to enter the support booth of the entrance (3) at the support booth each of the Exits D, E or F, only after vehicles have blocked the infrared beam 172, and have moved away from the beam 172 that CPU 157 starts commanding LED 169 to emit the infrared beam 171 downward, and at the same time turning the green light bulb 161 off and turning the red light bulb 159 on and blinks;

(4) at the main booth each of the Exits D, E or F 4.1 In case of saloon cars or any vehicles of the height less than 2.0 meters, only after the vehicles have blocked the infrared beam 211, and have moved away from the beam 211, that CPU 157 starts commanding LED 191 to emit the infrared beam 193 downward. At the same time, CPU 157 also commands LED 169 to stop emitting the infrared beam 171 downward at the support booth, and turns the red light bulb 159 off, the green light bulb 161 on and blinks to allow the next vehicle to enter the support booth.

4.2 In case of vans or any vehicles of the height equal to or greater than 2.0 meters, only after the vehicles have blocked the infrared beam 211, and have moved away from the beam 211, that CPU 157 starts commanding LEDs 191 and 197 to emit the infrared beams 193 and 199 downward, respectively.

At the same time, CPU 157 also commands LED 169 to stop emitting the infrared beam 171 downward at the support booth, and turns the red light bulb 159 off, the green light bulb 161 on and blinks to allow the next vehicle to enter the support booth.

4.3 In case of trucks or any vehicles of the height equal to or greater than 2.80 meters, only after the vehicles have blocked the infrared beam 211, and have moved away from the beam 211, that CPU 157 starts commanding LEDs 191, 197 and 203 to emit the infrared beams 193, 199 and 205, respectively downward. At the same time, CPU 157 also commands LED 169 to stop emitting the infrared beam 171 downward at the support booth, and turns the red light bulb 159 off, the green light bulb 161 on and blinks to allow the next vehicle to enter the support booth.

These three infrared beams XX, 94 and 100 of the entrances and the three infrared beams 193, 199 and 205 of the exits are used in the present invention to differentiate the three categories of vehicles according to their heights, i.e.;

infrared beams 8 and 193 can be blocked by all three kinds of vehicles, namely, saloon cars, vans and trucks;

infrared beams 94 and 199 can be blocked by only two kinds of vehicles, namely, vans and trucks;

infrared beams 100 and 205 can be blocked by only one kind of vehicles, namely, trucks.

Therefore, in the present invention, vehicles can be classified to as many categories as desired according to their height, by assigning as equal number of those LEDs as described above to emit equal number of infrared beams of switch on tailing-up type with their ends at different distances above the road surface 74 of the expressway where each beam is to be blocked by vehicles of the height equal to or greater than a distance above the road surface assigned for a particular category but not by vehicles of the height less than that distance. This is justified to classify according to the vehicles' height, since the taller a vehicle is, the heavier it can carry a load which in turn it can cause more stress and damages to the road surface thus the higher should be the toll.

All the components of the support booth and the main booth of each entrance or exit are installed at fixed positions under the toll booth canopy and powered by a direct current (DC) which can be converted from an alternating current (AC) supplied at each toll booth and installed about 8 meters above the road surface 74 which can be adjusted to fit any local designs.

The In-Vehicle Unit (IVU):

Two main purposes of the present invention are to provide an automatic toll collection system by which tolls can be collected from a moving vehicle according to category of the vehicle and the distance between a couple of entrance and exit the vehicle travels. This can be achieved by using an in-vehicle unit installed in the vehicle to communicate with the toll-collecting device installed at the toll booth.

The IVU of the present invention is to be installed in a vehicle. The production of which is very inexpensive, i.e. not greater than ฿500 per unit (฿-Baht is a Thai currency, where ฿25 is approximately U.S.$ 1).

Since vehicles are classified according to their height, the IVU installed in the vehicle needs then be to function differently according to its category. The transceivers and their CPUs are the parts which make the IVUs function differently according to their categories and therefore are given different numbers.

Figure 1:
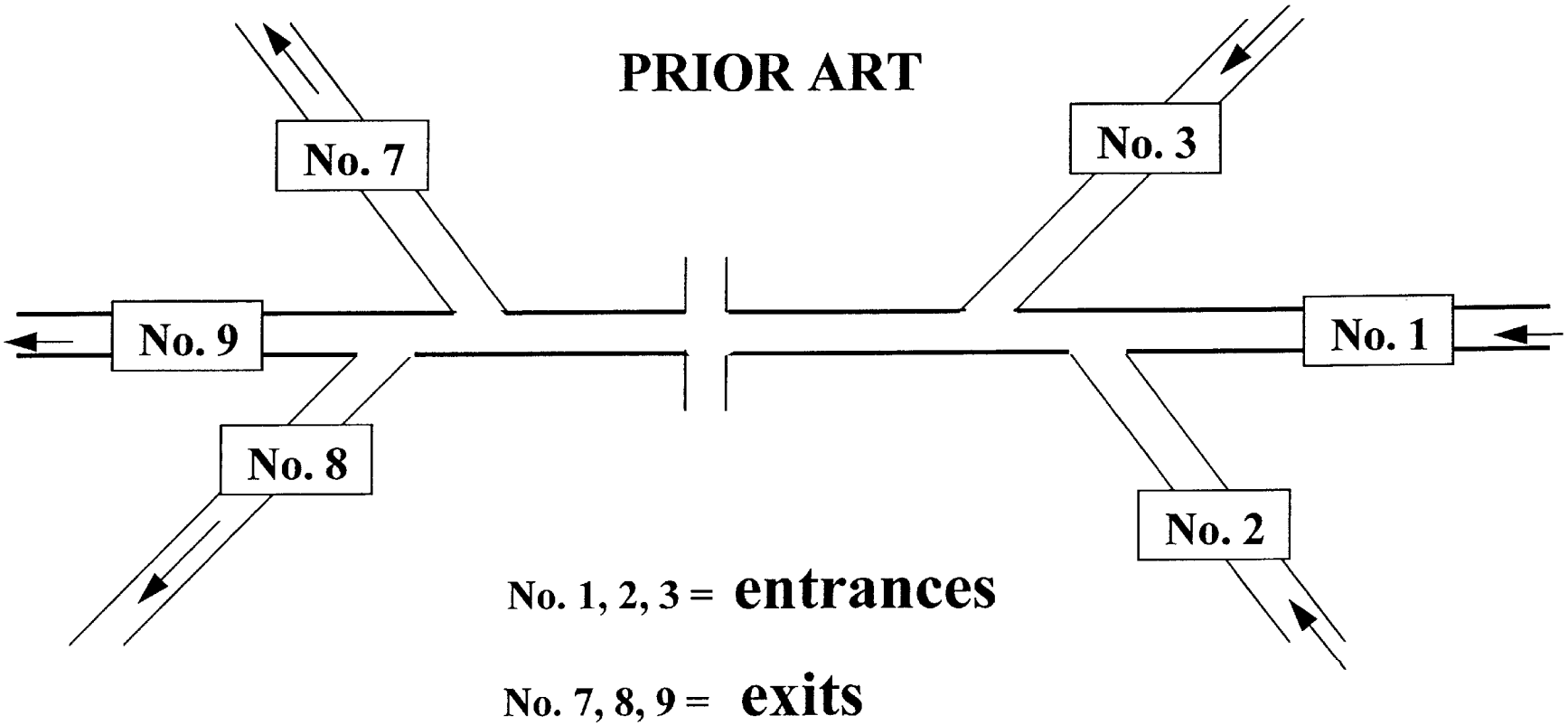
FIG. 1 shows an expressway diagramatically where there is no support booth either at the entrance or the exit toll booths (prior art)
Figure 2:
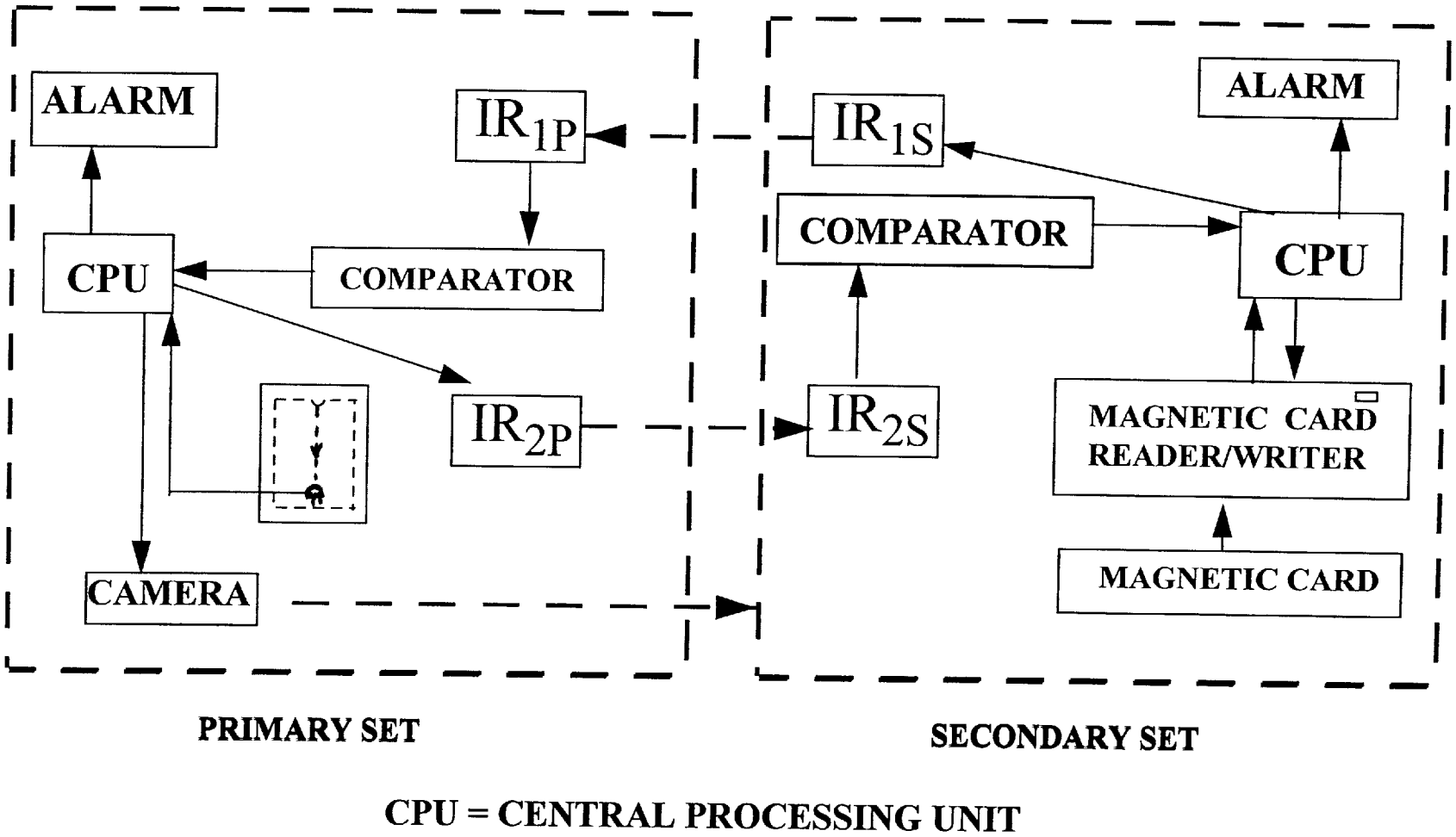
FIG. 2 shows all the components of those previous system for automatic toll collection, one installed at the toll station and the other installed in the vehicle (prior art)
Figure 3:
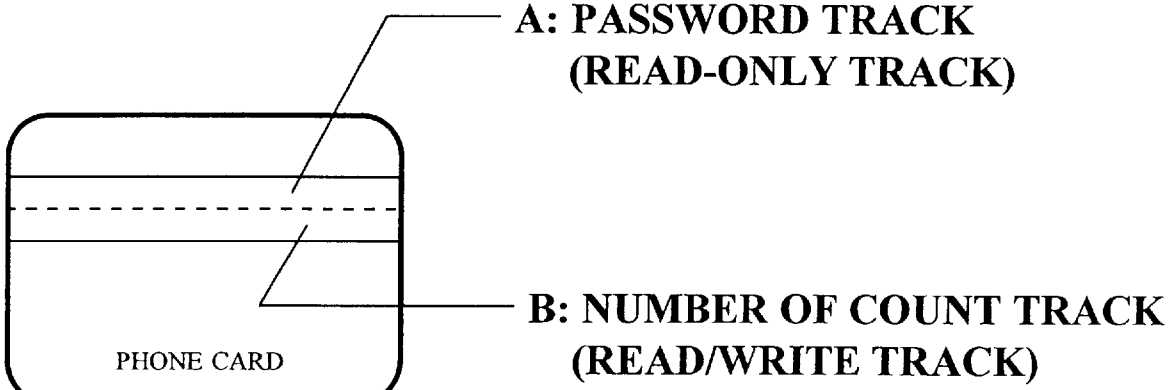
FIG. 3 is a conventional prepaid card (prior art) which can be either a magnetically-coded card or an optically-coded card.
Figure 17:
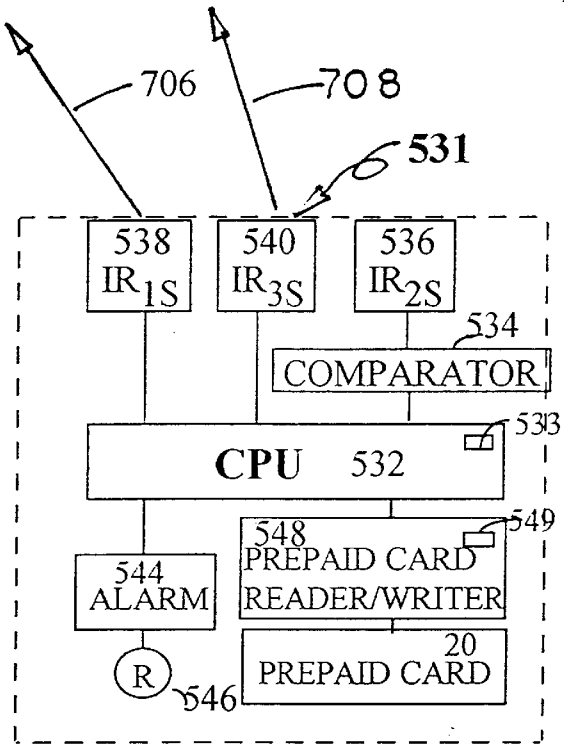
FIG. 17 shows all the components in an in-vehicle unit (IVU) to be installed in a van.
Figure 16:
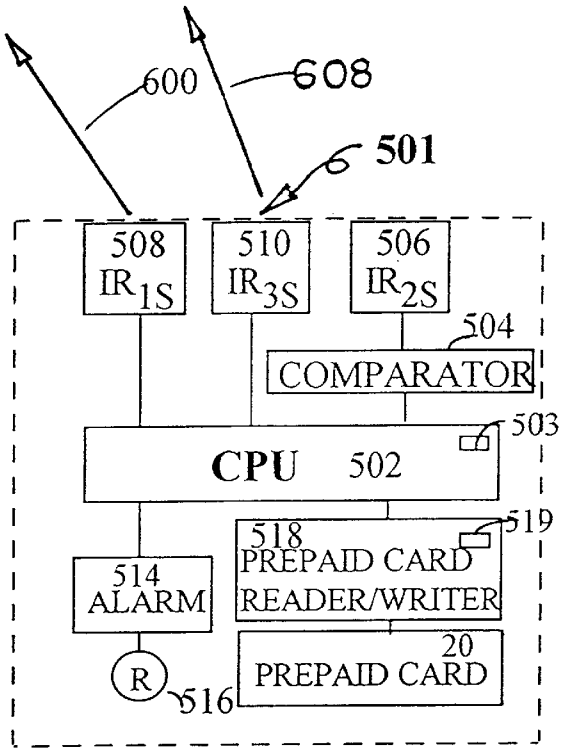
FIG. 16 shows all the components in an in-vehicle unit (IVU) to be installed in a saloon car.

(1) IVU 501, as shown in FIG. 16 which is a block diagram, is to be installed in a saloon car 500 or any vehicles of a height less than 2.0 meters, having:

1.1 CPU (Central Processing Unit) 502 with its memory unit 503, capable of processing the data received from the other components in IVU 501, executing the calculation of tolls and commanding all the components in IVU 501 to function;

1.2 a comparator 504;

1.3 an infrared receiver $IR_{2S}$ 506, connected to comparator 504;

1.4 an infrared transmitter $IR_{1S}$ 508 to transmit an infrared beam 600;

1.5 an infrared transmitter $IR_{3S}$ 510 to transmit an infrared beam 608;

1.6 a voice alarm 514, with a red light bulb 516 connected thereto;

1.7 a card reader/writer 518, having a display screen 519 to show the number indicating the amount of money left in a prepaid card at all time during the payment process;

1.8 a prepaid card 20, as shown in FIG. 3 which can be of either magnetically-coded type or optically-coded type or smart card, where there are two tracks in the card, namely, track A called 'PASSWORD TRACK' and track B called 'NUMBER OF COUNT TRACK'. Track A is a read-only track, i.e., the information like password such as the code for category of the vehicle or the code of a particular tollroad recorded in this track can only be read and can never be changed, while track B is a read/write track where the information like the amount of money left in the prepaid card recorded within this track can be read and rewritten;

(2) IVU 531, as shown in FIG. 17 which is a block diagram, is to be installed in a van 530 or any vehicles of a height equal to or greater than 2.0 meters but less than 2.80 meters, having:

2.1 CPU (Central Processing Unit) 532 with its memory unit 533, capable of processing the data received from the other components in IVU 531, executing the calculation of tolls and commanding all the components in IVU 531 to function;

2.2 a comparator 534;

2.3 an infrared receiver $IR_{2S}$ 536, connected to comparator 534;

2.4 an infrared transmitter $IR_{1S}$ 538, to transmit an infrared beam 706;

2.5 an infrared transmitter $IR_{3S}$ 540, to transmit an infrared beam 708;

2.6 a voice alarm 544, with a red light bulb 546 connected thereto;

2.7 a card reader/writer 548, having a display screen 549 to show the number indicating the amount of money left in a prepaid card;

2.8 a prepaid card 20, as shown in FIG. 3 which can be of either magnetically-coded type or optically-coded type.

Figure 18:
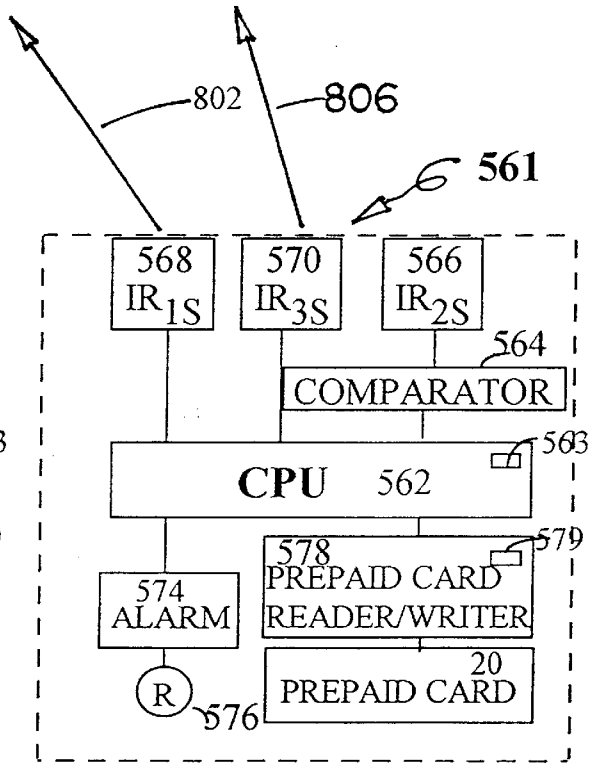
FIG. 18 shows all the components in an in-vehicle unit (IVU) to be installed in a truck or a bus.

(3) IVU 561, as shown in FIG. 18 which is a block diagram, is to be installed in a truck 560 or any vehicles of a height equal to or greater than 2.80 meters, having:

3.1 CPU (Central Processing Unit) 562 with its memory unit 563, capable of processing the data received from the other components in IVU 561, executing the calculation of tolls and commanding all the components in IVU 561 to function;

3.2 a comparator 564;

3.3 an infrared receiver $IR_{2S}$ 566, connected to comparator 564;

3.4 an infrared transmitter $IR_{1S}$ 568, to transmit an infrared beam 802;

3.5 an infrared transmitter $IR_{3S}$ 570, to transmit an infrared beam 806;

3.6 a voice alarm 574, with a red light bulb 576 connected thereto;

3.7 a card reader/writer 578, having a display screen 579 to show the number indicating the amount of money left in a prepaid card;

3.8 a prepaid card 20, as shown in FIG. 3 which can be of either magnetically-coded type or optically-coded type.

All the infrared beams emitted from or received by the transceivers of any of these IVUs are to be through the front glass windshields of the vehicles.

There are only slight differences between these three IVUs, namely the CPU and the $IR_{1S}$ in a following manner:

1. CPU after receiving the infrared signals from $IR_{2P}$ at the entrance and the exit via receiver $IR_{2S}$ and comparator in the IVU of each type of vehicles, the results of the processed data in each IVU are different.

For example, if a CPU of a saloon car, or any vehicle having a height less than 2.0 meters, receiving an infrared beam of 10 KHz (KiloHertz) from $IR_{2P}$ 84 at Entrance A and an infrared beam of 60 KHz from $IR_{2P}$ 189 at Exit F, it processes the data and comes up with a countdown of ฿40. This amount ฿40 is then deducted from the cash balance present in the prepaid card. The resulting number after deduction is then rewritten by the prepaid card reader/writer 518 and shown on the display screen 519 of the reader/writer.

The CPU of a van or any vehicles of a height equal to or greater than 2.0 meters but less than 2.80 meters, although processes the two infrared signals 10 and 60 KHz in a similar manner, however, a countdown assigned for this combination by CPU 532 is different and equal to ฿60; while CPU 562, of a truck or a bus or any vehicles of a height equal to or greater than 2.80 meters, processes the data and gives a result of ฿80, respectively. Thus, the taller is the vehicle, the higher is the toll resulting from the processing by its CPU although the pair of modulation frequencies it receives is the same.

2. $IR_{1S}$ which transmits an infrared beam according to the command from CPU in 1. has to transmit the infrared beam out at all time the infrared beam of specific frequency identifying the vehicle, where 2.1 at the entrance.

At the main booth of the entrance, from IVU 501 of saloon car 500, CPU 502 orders transmitter $IR_{1S}$ 508 to transmit an infrared beam 600, assumingly, of 1 KHz, which is a specific modulation frequency identifying a saloon car or any vehicles of a height lower than 2.0 meters. This infrared beam 600 is received by the receiver $IR_{1P}$ 82. When CPU 58 receives the information of 1 KHz frequency via comparator 80, it orders only the LED 86 to stop emitting only the infrared beam 88;

from IVU 531 of van 530, CPU 532 orders transmitter $IR_{1S}$ 538 to transmit an infrared beam 706, assumingly, of 2 KHz, which is a specific modulation frequency identifying a van or any vehicles of a height equal to or greater than 2.0 meters but less than 2.80 meters. This infrared beam 706 is received by the receiver $IR_{1P}$ 82. When CPU 58 receives the information of 2 KHz frequency via comparator 80, it orders both LEDs 86 and 92 to stop emitting both infrared beams 88 and 94, respectively;

from IVU 561 of truck 560, CPU 562 orders transmitter $IR_{1S}$ 568 to transmit an infrared beam 802, assumingly, of 3 KHz, which is a specific modulation frequency identifying a truck or any vehicles of a height equal to or greater than 2.80 meters. This infrared beam 802 is received by the receiver $IR_{1P}$ 82. When CPU 58 receives the information of 3 KHz frequency via comparator 80, it orders all the LEDs 86, 92 and 98 to stop emitting all the infrared beams 88, 94 and 100, respectively.

2.2 at the exit.

At the main booth of the exit, from IVU 501 of saloon car 500, CPU 502 orders transmitter $IR_{1S}$ 508 to transmit an infrared beam 600, assumingly, of 1 KHz, which is a specific modulation frequency identifying a saloon car or any vehicles of a height lower than 2.0 meters. This infrared beam 600 is received by the receiver $IR_{1P}$ 183. When CPU 157 receives the information of 1 KHz frequency via comparator 181, it orders only the LED 191 to stop emitting only the infrared beam 193;

from IVU 531 of a van 530, CPU 532 orders transmitter $IR_{1S}$ 538 to transmit an infrared beam 706, assumingly, of 2 KHz, which is a specific modulation frequency identifying a van or any vehicles of a height equal to or greater than 2.0 meters but less than 2.80 meters. This infrared beam 706 is received by the receiver $IR_{1P}$ 183. When CPU 157 receives the information of 2 KHz frequency via comparator 181, it orders both LEDs 191 and 197 to stop emitting both infrared beams 193 and 199, respectively;

from IVU 561 of a truck 560, CPU 562 orders transmitter $IR_{1S}$ 568 to transmit an infrared beam 802, assumingly, of 3 KHz, which is a specific modulation frequency identifying a truck or any vehicles of a height equal to or greater than 2.80 meters. This infrared beam 802 is received by the receiver $IR_{1P}$ 183. When CPU 157 receives the information of 3 KHz frequency via comparator 181, it orders all the LEDs 191, 197 and 203 to stop emitting all the infrared beams 193, 199 and 205, respectively.

Thus, the infrared signals emitted from the $IR_{1S}$ of IVU in each type of vehicles are of different specific frequencies, and thus the CPU of the toll booth are to respond differently.

Figure 19:
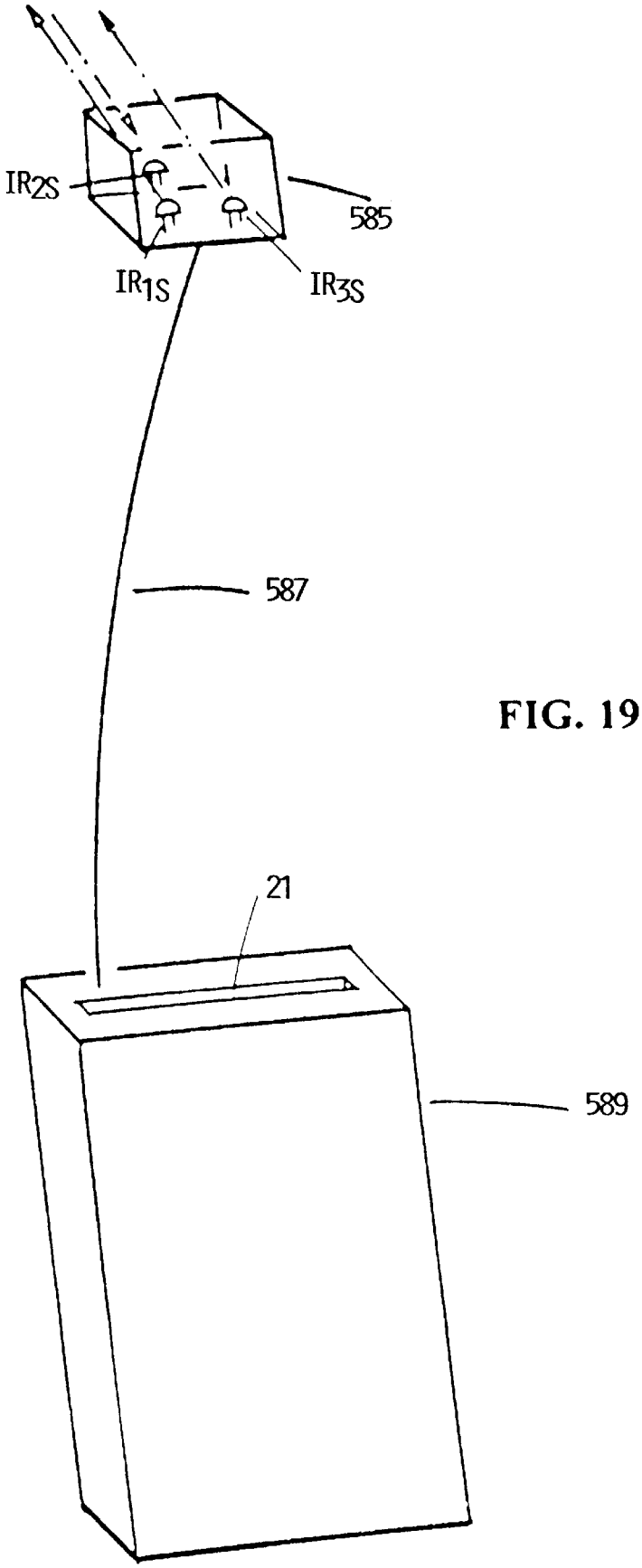
FIG. 19 shows how all the components of an in-vehicle unit (IVU) are separated into two parts to be installed in the vehicles.
Figure 20:
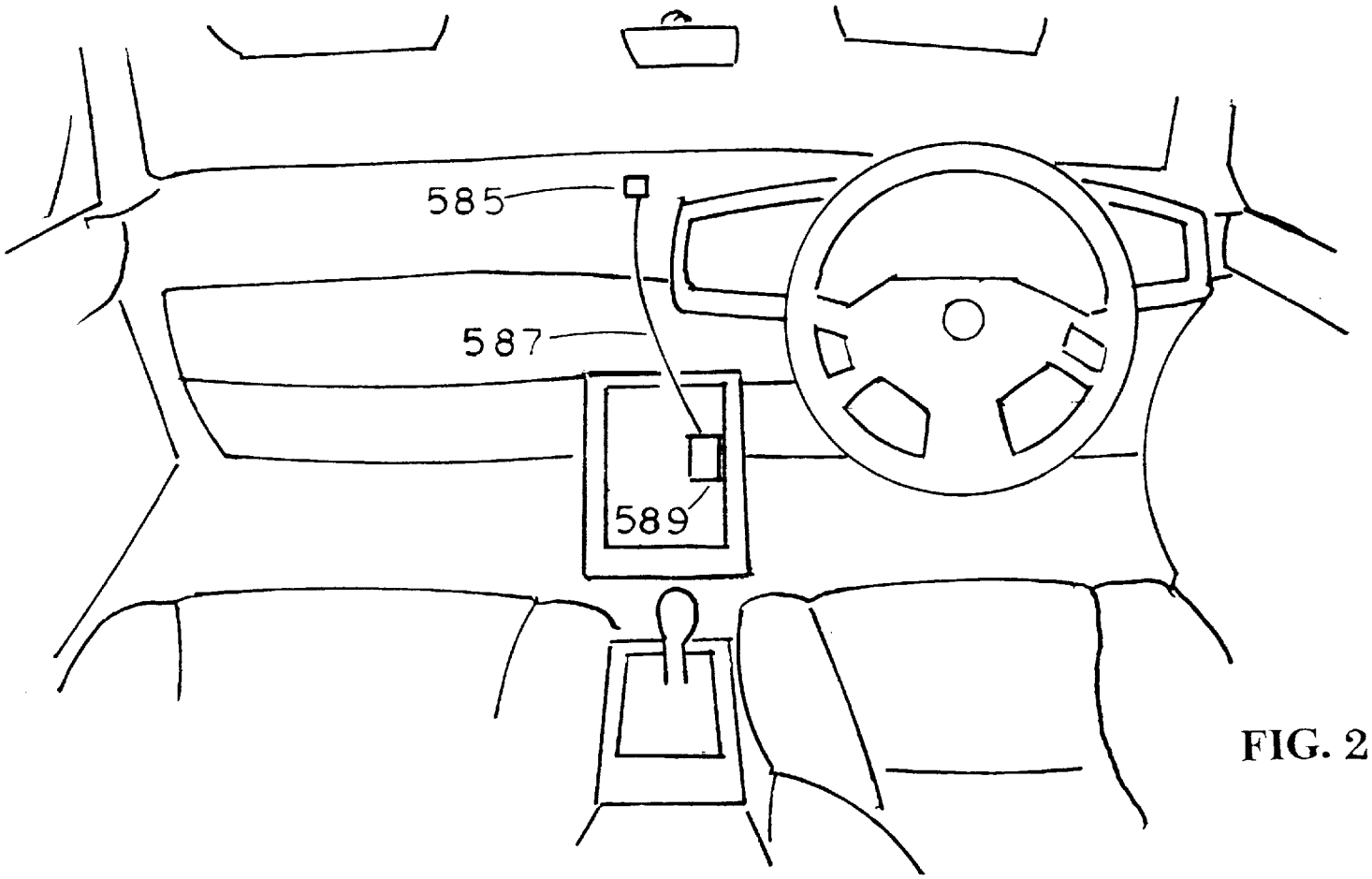
FIG. 20 shows the location where a IVU is installed in the vehicles.

All these components in the IVU can be separated into 2 parts, as in FIG. 19:

a first part consists of receiver $IR_{2S}$, transmitter $IR_{1S}$ and transmitter $IR_{3S}$ each of a diameter not greater than 5 mm. All these three components can be packed in a small plastic box 585 transparent to infrared radiation of a dimension not greater than 3×3×3 cm. This box can be mounted atop of an instrument panel of a vehicle connected through an electrical cord 587 to a second part consists of all the other components namely, CPU, comparator, voice alarm and its red light bulb, and card reader/writer packed in a container 589 also made of plastic having a dimension approximately the same as the remote control of a television set with a rectangular space 21 to which prepaid card 20 can be inserted in. This second part may be mounted at the console of the vehicle as shown in FIG. 20.

The IVU is powered by a DC supplied from the batteries in the vehicle.

There are 4 cases that the vehicle is not allowed to enter at the entrance or to leave at the exit of the expressway.

Case I: When there is no IVU within the vehicle. Therefore, there is no infrared signal transmitted from the $IR_{1S}$ in the vehicle towards and to be received by $IR_{1P}$ at the main booth of any entrance or exit. Thus, those infrared beams 88, 94, and 100 or 193, 199 and 205 are still transmitted out at all time perpendicularly downwards at the toll booth. If the vehicle without an IVU tries to invade through a toll booth, it will block all these three infrared beams Case II: There is an IVU in the vehicle but the IVU is a false one or is not provided by the expressway toll authority, the prepaid card inserted even is a authentic one, however, the infrared beam transmitted from $IR_{1S}$ of the IVU is not correct. When the CPU at the main booth receives this incorrect infrared beam. The situation is such that all the infrared beams of switch on tailing-up type are still transmitted downward at each toll booth and will be blocked by the vehicle with this false IVU.

Case III: When there is an IVU in the vehicle, the prepaid card inserted in the IVU is a false one or has the amount of money not sufficient to pay the maximum toll for that particular expressway. The IVUs in the present invention are designed to deny these invalid cards by ejecting them out. A voice alarm within the IVU in the vehicle is actuated and thus starts to buzz notifying the driver that the card is no longer valid, the red light blinks simultaneously and the IVU ejects out the card. As the prepaid card is ejected out the IVU is automatically turned off. There is no infrared signal from $IR_{1S}$ of the IVU when the vehicle arrives at the toll booth. $IR_{1P}$ at the main booth does not receive the infrared signal transmitted from $IR_{1S}$. The situation is then the same as that of case I, all the infrared beams emitted downward at each toll booth will be blocked.

In all these three Cases I–III, if the vehicle tries to invade the toll booth illegally, it will block all or some of these three infrared beams of switch on tailing-up type, alarm of the toll booth is actuated, the orange light bulb starts blinking for a certain period of time preset in the CPU. The camera starts taking the picture of the vehicle's license plate. The driver is then arrested.

Case IV: There is yet another different case i.e. since in the present invention, user can install the IVU himself and that he must use only the correct corresponding type of IVU to be installed in his vehicle. If the IVU for a vehicle of greater height is used in a vehicle of less height, the driver must then pay a higher toll than what he needs to. On the contrary, it is not possible to use an IVU for a vehicle of less height in a vehicle of greater height. This is because the infrared beams of switch on tailing-up type corresponds to the vehicle of greater height will still be emitting. Therefore, when such vehicle passes the toll booth it will block such infrared beams and causes the alarm to be actuated, the orange light bulb to blink and the camera to take the picture of the vehicle. The driver is then arrested and fined.

For any of these four cases, the driver must turn his vehicle to use a conventional toll booth and pay toll by cash where he may need to pay the maximum toll for that category of vehicle and he needs not be arrested.

Case V: There is an IVU in the vehicle and the situation is not any of those 4 cases described above, the vehicle can enter or leave the expressway 1 with no problem.

Upon insertion of a prepaid card into the card reader/writer of an IVU as in FIG. 20, all kinds of IVU together with their card reader/writers (conventional) are designed to hold the whole card into the device and automatically eject it out after finishing all the processing, i.e., after the CPU has finished processing the data received as the two infrared modulation frequencies, one at an entrance and the other at an exit, knowing the countdown to be deducted from the cash balance present in the prepaid card and instructing the card reader/writer to rewrite the result after the deduction onto the card.

Figure 21A:
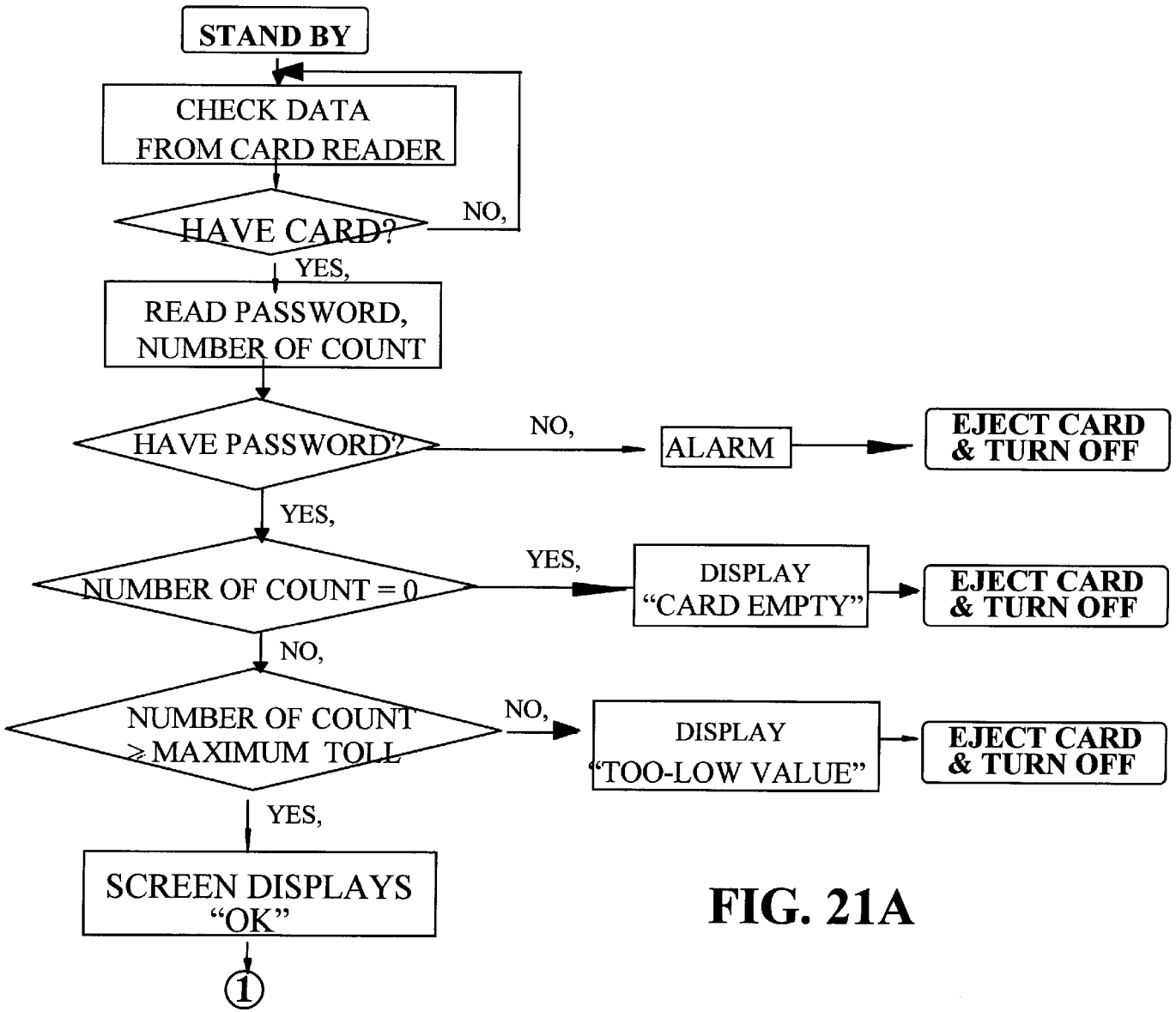
FIGS. 21A, 21B and 21C show a flow diagram describing the various steps performed by an IVU of the vehicle.
Figure 21B:
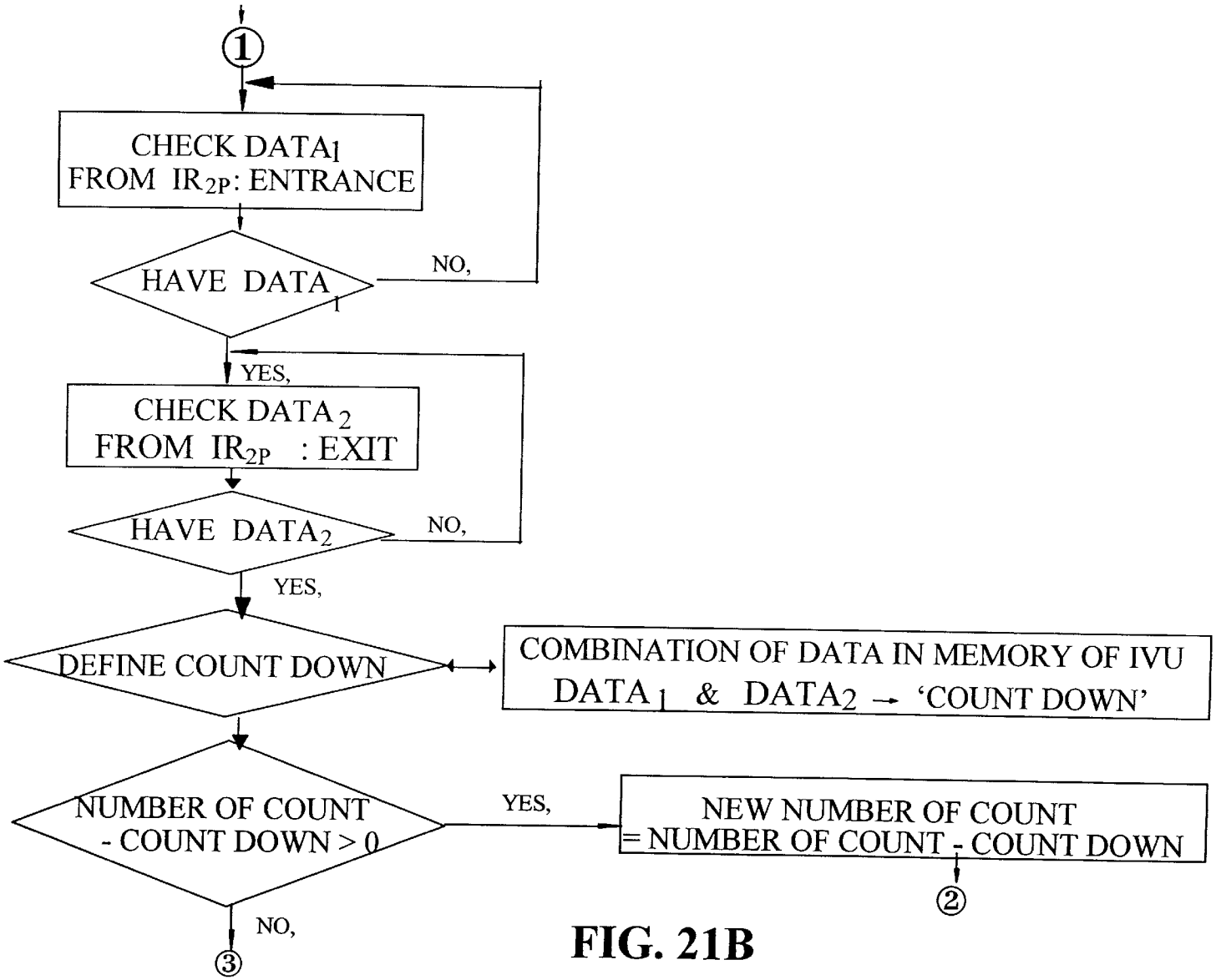
Figure 21C:
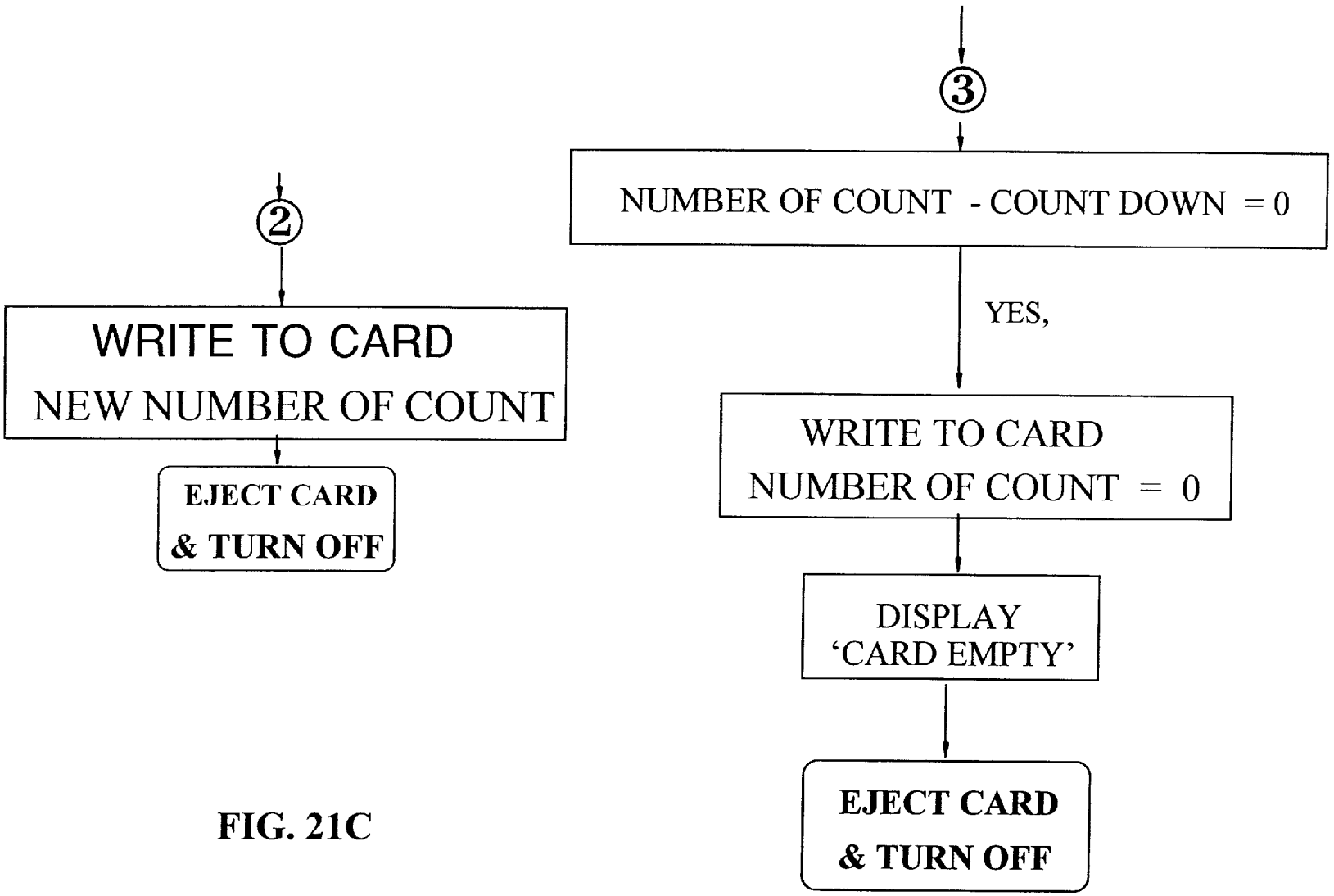

A flow diagram in FIG. 21A, 21B and 21C shows the various steps performed in an IVU during its operation cycle. As the vehicle moves closer to an entrance of an expressway to the vicinity of about 1 Km. from the toll booth, the driver inserts the prepaid card 20 into the space 21 of the IVU which is a card holder. The whole card is held within the device. This turns the IVU 'ON'. CPU then checks all the components of the IVU and leaves them at a 'STANDBY' mode. CPU knows that there is a card in the card reader/writer and reads the 'PASSWORD' and 'NUMBER OF COUNT' of the card. Password is recorded in a READ-ONLY track, while number of count is recorded in the READ/WRITE track in the card, as indicated by A and B tracks, respectively in FIG. 3.

Where there is NO password, CPU activates alarm, the red light bulb of the IVU blinks and the prepaid card is ejected out.

WHEN THERE IS CORRECT PASSWORD, CPU then checks 'NUMBER OF COUNT'. If there is no count, the display screen of the reader/writer shows the word 'CARD EMPTY' the red light bulb of the IVU blinks and the prepaid card is ejected out.

If 'NUMBER OF COUNT' is less that the count for maximum toll information recorded in ROM, screen displays 'TOO LOW VALUE' and alarm is actuated, the red light bulb of the IVU blinks and the prepaid card is ejected out.

When 'NUMBER OF COUNT' is equal to or greater than the maximum toll, screen then displays 'OK' and all the components are ready to function. For the maximum toll information to be recorded in the IVU, if the IVU is designed to be used only for only one particular expressway then the number indicating maximum toll can be recorded as a fixed number into ROM to be used for execution. However, if the IVU is designed to be used with more than one particular expressway with different maximum tolls for each of the expressways, then it can be designed such that the driver himself can set any number representing the maximum toll for that particular expressway he is about to enter as indicated on the roadside before insertion of the card into the IVU or the information may contain in the 'PASSWORD TRACK' in each card issued to be used only in each different tollroad. CPU then processes in a similar manner and informs the driver whether the cash balance in the card is sufficient to pay the maximum toll or not.

When all the components are ready and the prepaid card is a valid one, CPU then actuates the transmitter $IR_{1S}$ to emit an infrared of specific modulation frequency to communicate with a toll-collecting device installed at the toll booth. In case the amount of money left in a prepaid card is not sufficient to pay the maximum toll, eg. the toll for entering at Entrance A and leaving at Exit F for expressway l, then the driver needs to change to a new prepaid card with sufficient amount of cash balance if he had one. If not, he has to turn to a conventional toll booth to pay toll by cash where for some expressways he may have to pay the maximum toll for that particular expressway regardless of the distance he travels. For the prepaid card with insufficient amount of money, he may bring it along with him the next time he buys a new prepaid card and has the amount of money left in the previous card refunded from the toll-card selling booth.

Thus, at about 1 Km. from a support booth 3 of Entrance A, a driver inserts a prepaid card into an IVU. Where his IVU is a correct one and the card is authentic with sufficient cash balance to pay the maximum toll for that particular expressway and therefore not fit in any of case I–IV as described above, automatic toll paying is operated as following.

When card 20 is inserted into the IVU installed at the console of a vehicle as shown in FIG. 20, the whole card is held within the IVU, and (1) for saloon car 500, IVU 501 transmits an infrared beam 600 from its $IR_{1S}$ 508 out at all time;

(2) for van 530, IVU 531 transmits an infrared beam 706 from its $IR_{1S}$ 538 out at all time;

(3) for truck 560, IVU 561 transmits an infrared beam 802 from its $IR_{1S}$ 568 out at all time.

Figure 22:
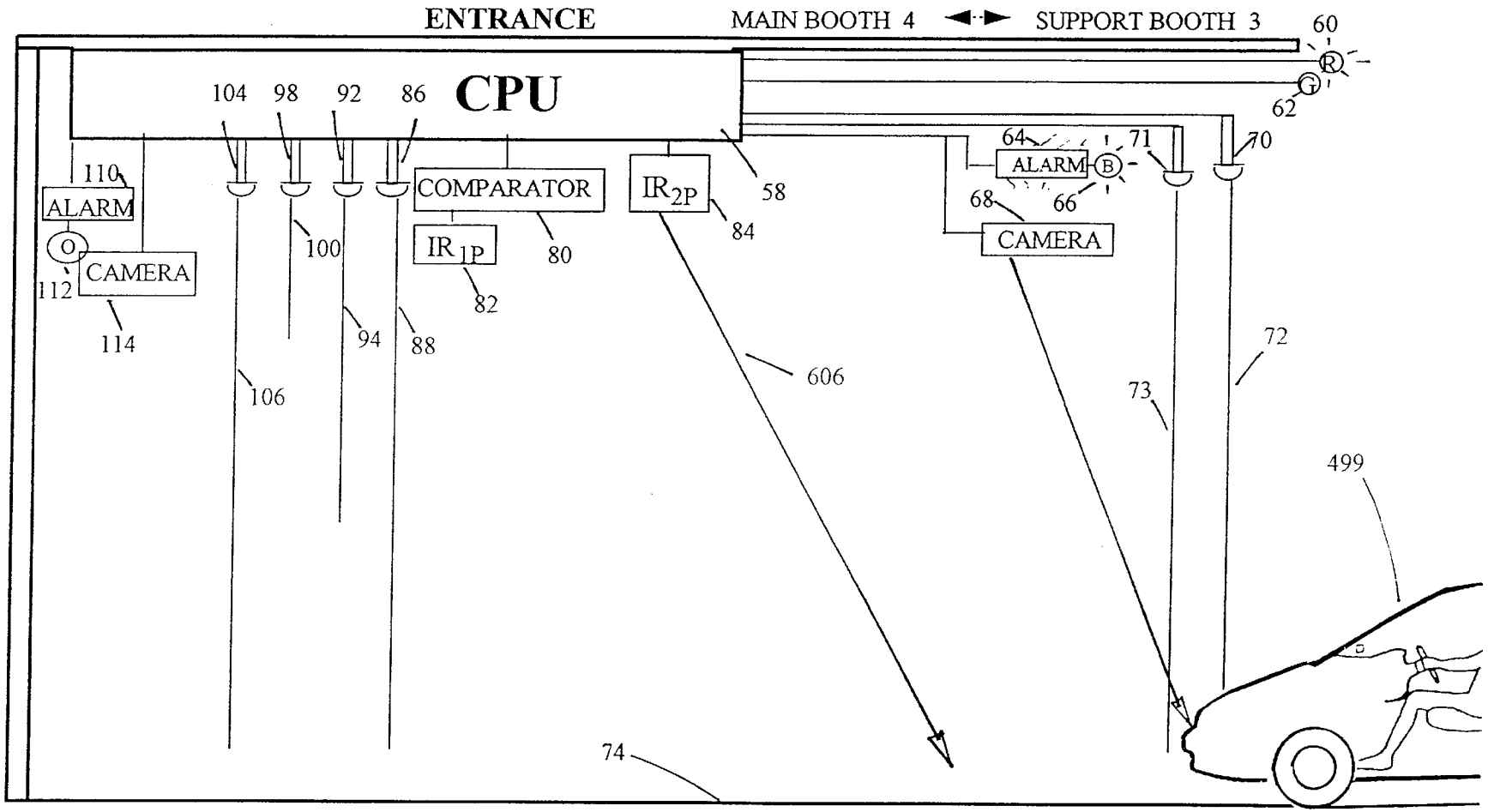

The following describes five various conditions how a vehicle enters at an entrance and exits at an exit:

1. As in FIG. 22, in any of the cases I–V as mentioned above, before entering the support booth 3 of Entrance A, if a red light bulb 60 at the support booth is blinking which means that the preceding vehicle had not yet moved out from the beam 106 at the main booth 4, any vehicle (given the number 499) needs to wait at the waiting zone outside the redlight zone. If the driver insists to pass into the redlight zone, then the vehicle 499 will have blocked the infrared beam 72 (which is of switch on tailing-up type) transmitted from LED 70. Once the beam is blocked, CPU 58 actuates alarm 64 to work, the blue bulb 66 then starts blinking for a certain period of time as preset by the CPU, for instance, 30 seconds. The camera then takes the picture of the invading vehicle's license plate. The toll authority then arrests the driver.

Figure 23:
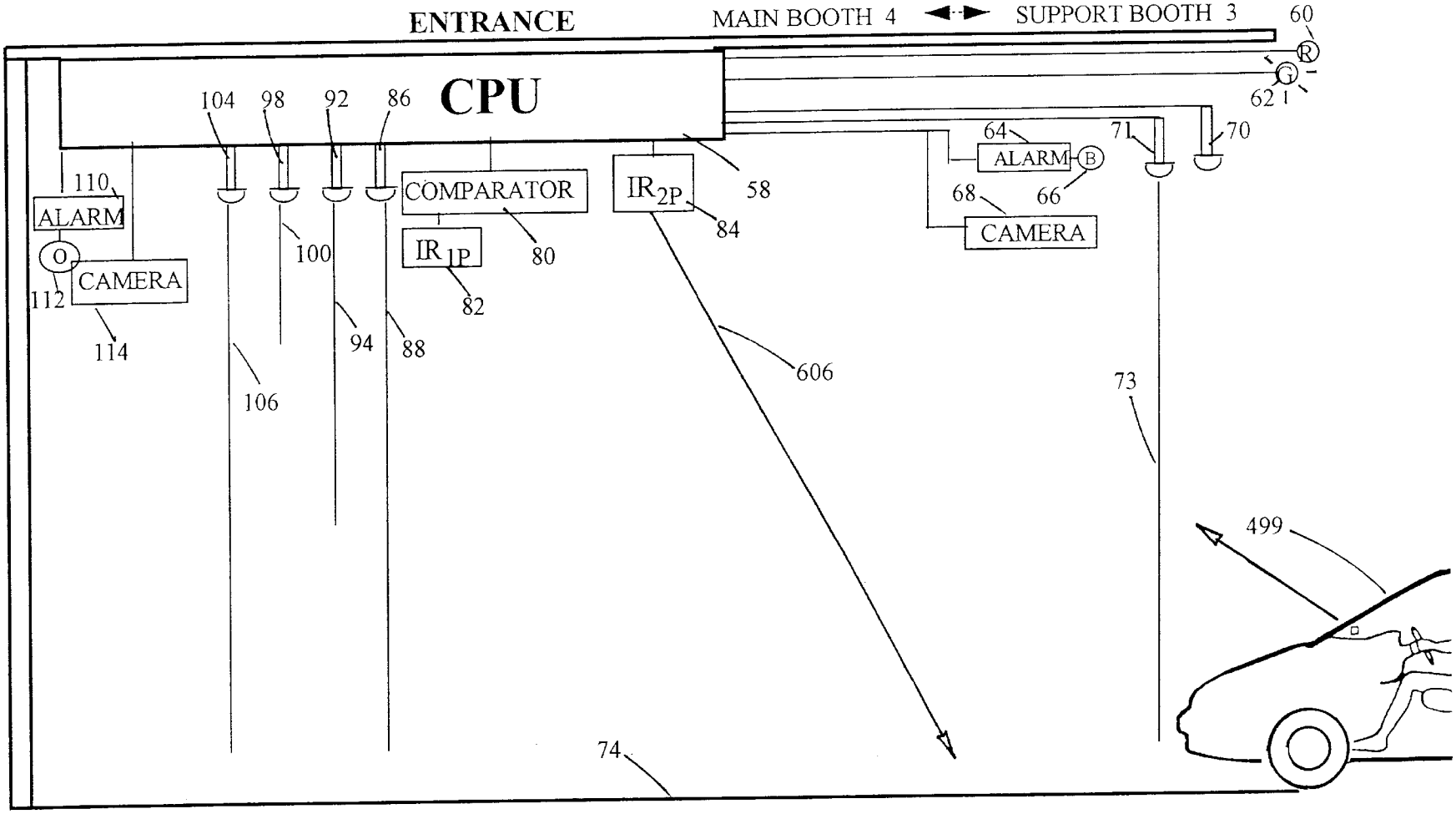
FIG. 23 shows a vehicle arriving at a support booth of an entrance where a green light of the support booth is blinking, the driver is allowed to pass the vehicle through the toll booth.
Figure 24:
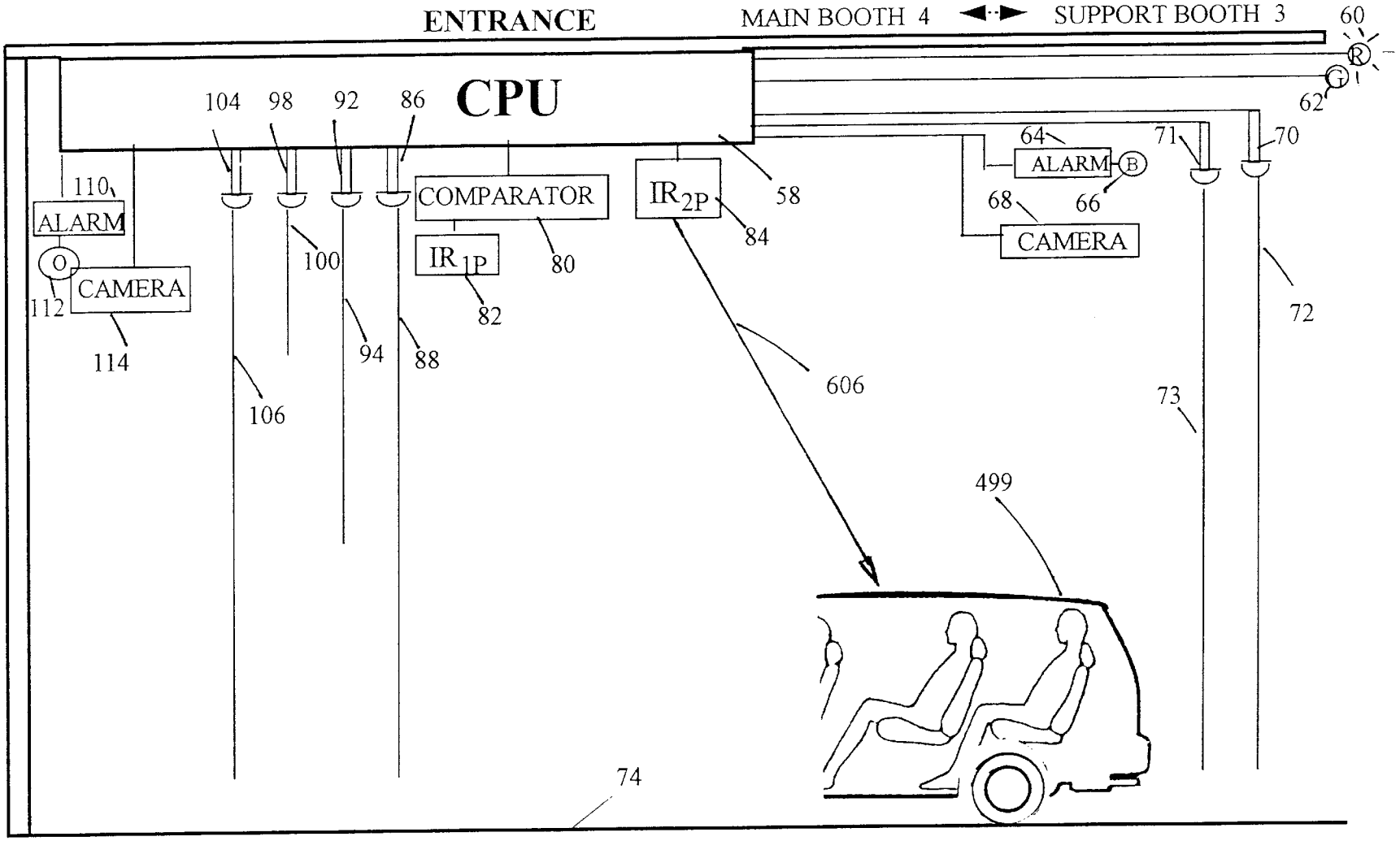
FIG. 24 shows a vehicle while moving out from the infrared beam of switch on tailing-down type at the support booth of an entrance.

2. As shown in FIG. 23, if the driver sees the red light bulb 60 is off and the green light bulb 62 is blinking at the support booth 3 which means that the preceding vehicle had already moved out from the beam 106 at the main booth 4, and CPU 58 has commanded the LED 70 to stop emitting the infrared beam 72 thus there is no infrared beam 72 to be blocked, the driver is then allowed to pass his vehicle 499 through the support booth 3. CPU 58 does not actuate alarm 64, blue bulb 66 or camera 68 to start operating 3. FIG. 24 shows that as the vehicle 499 has blocked and moved away from beam 73 which is of switch on tailing-down type, CPU 58 commands LED 70 to reemit the infrared beam 72, green light bulb 62 to turn off and red light bulb 60 to start blinking. The following car is prohibited to enter support booth 3. This prohibition is necessary especially during a traffic jam either at an entrance or an exit to provide accuracy of toll-collection.

The vehicle 499 can then pass into main booth 4 of the entrance A.

Figure 25:
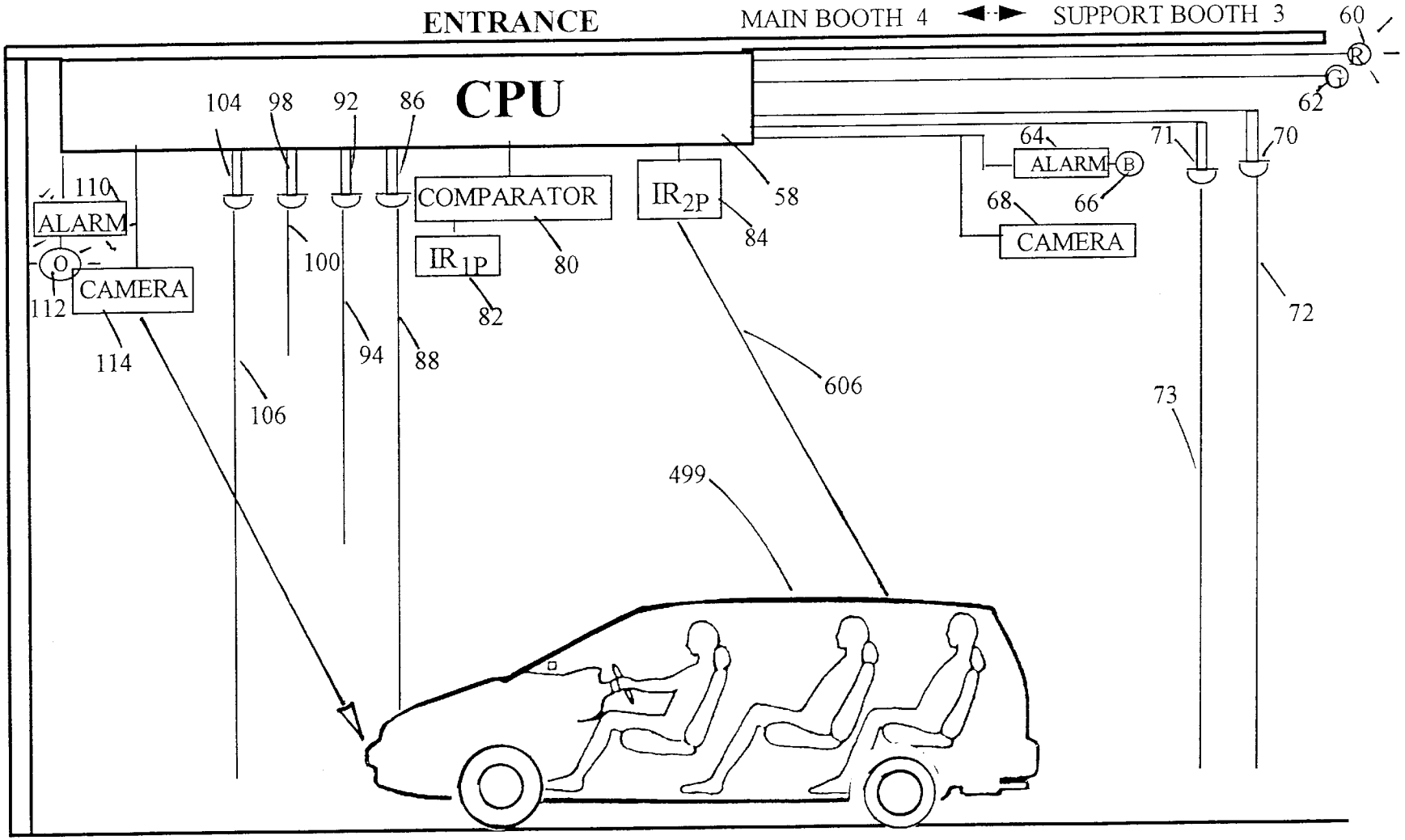
FIG. 25 shows a vehicle using a wrong IVU while arriving at the main booth of an entrance.

4. According to FIG. 25, if the IVU of vehicle 499 is in the condition as in case I–IV, when the vehicle 499 arrives at main booth 4 there will be no infrared beam transmitted from the $IR_{1S}$ of the IVU to be received by $IR_{1P}$. Thus, all the three infrared beams of switch on tailing-up type, i.e. 88, 94 and 100, at main booth are still emitted out. Once the first beam, 88, is blocked by vehicle 499, CPU 58 then actuates alarm 110, orange light 112 starts blinking and the camera 114 then takes the picture of the license plate of vehicle 499. The toll authority arrests the driver of vehicle 499.

Figure 26:
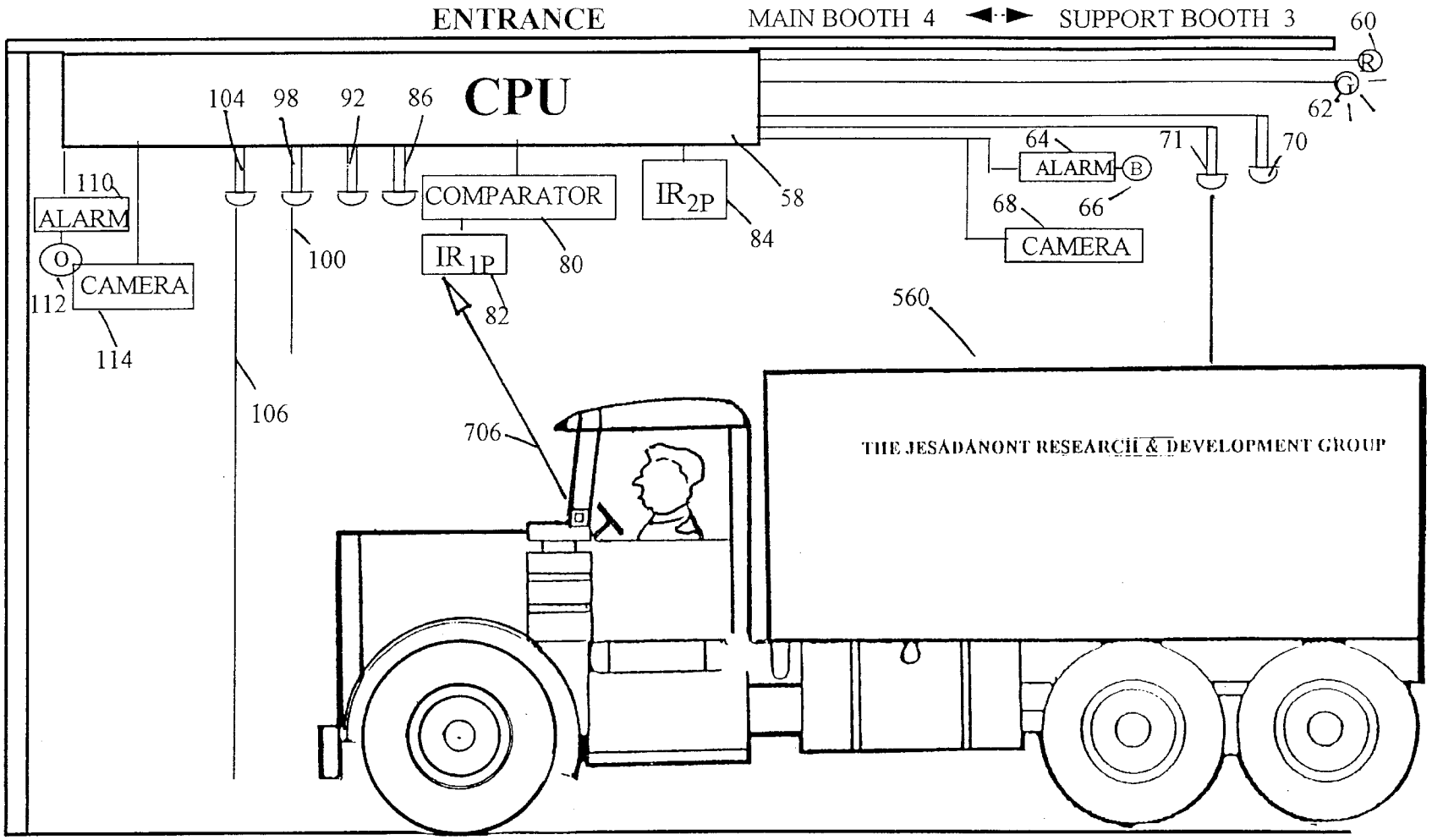
FIG. 26 shows a vehicle of greater height using an IVU belonged to a vehicle of lower height while arriving at the main booth of an entrance.

5. FIG. 26 shows a case where an IVU for a vehicle of lesser height is used in a vehicle of a greater height in attempt to fraudly pay less than what should be. For example, truck 560 uses an IVU 531 for van 530 instead of corresponding IVU 561 it should use. When truck 560 arrives at the main booth 4 of the entrance, $IR_{1S}$ of IVU 531 transmits the infrared beam 706 of frequency 2 KHz which is the frequency identifying van 530 to be received by the $IR_{1P}$ 82 at the main booth. CPU 58 then commands LED 86 and LED 92 to stop emitting the beams 88 and 94, respectively. LED 98, however, still emits the beam 100 with its end 102 at 2.80 meters above the road surface 74. The truck which, in the present invention assumingly, has a height of 2.80 meters or greater passes into the main booth and blocks then the beam 100. CPU 58 actuates the alarm I 10, the orange bulb 112 starts blinking and the camera takes the picture of the license plate of the truck. The toll authority then comes and arrests the driver.

In a similar manner, if all these conditions 1–5 described right above occur at the exit as what happened at the entrance, the driver would meet the same problems then at the exit.

The following describes how each category of vehicles having the correct IVU and prepaid card enters the expressway 1 at Entrance A and leaves at Exit F pays toll.

1. A saloon car 500 or any vehicles of a height less than 2.0 meters.

Figure 27:
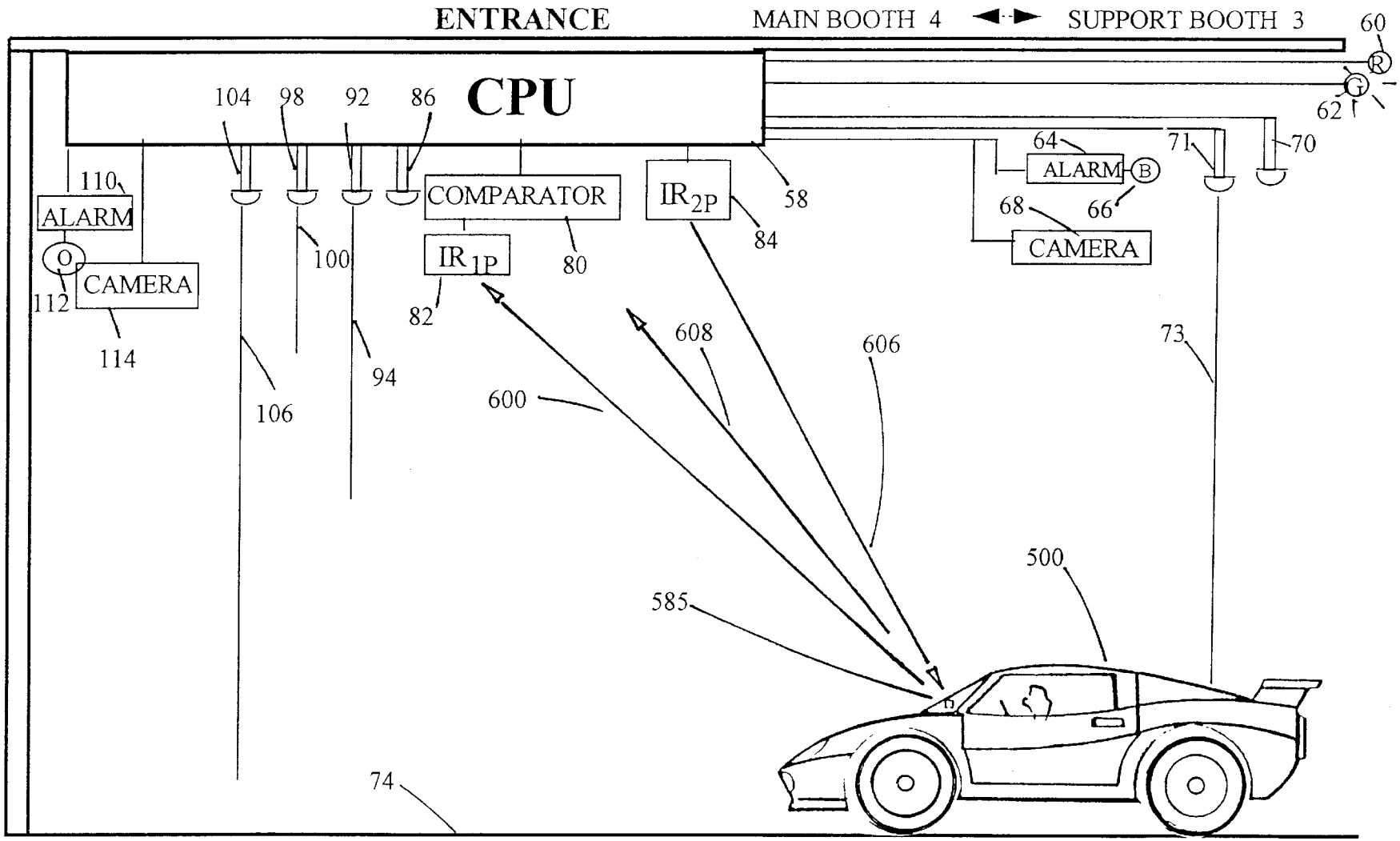
FIG. 27 shows a saloon car using a correct IVU while arriving at the main booth of an entrance.
Figure 28:
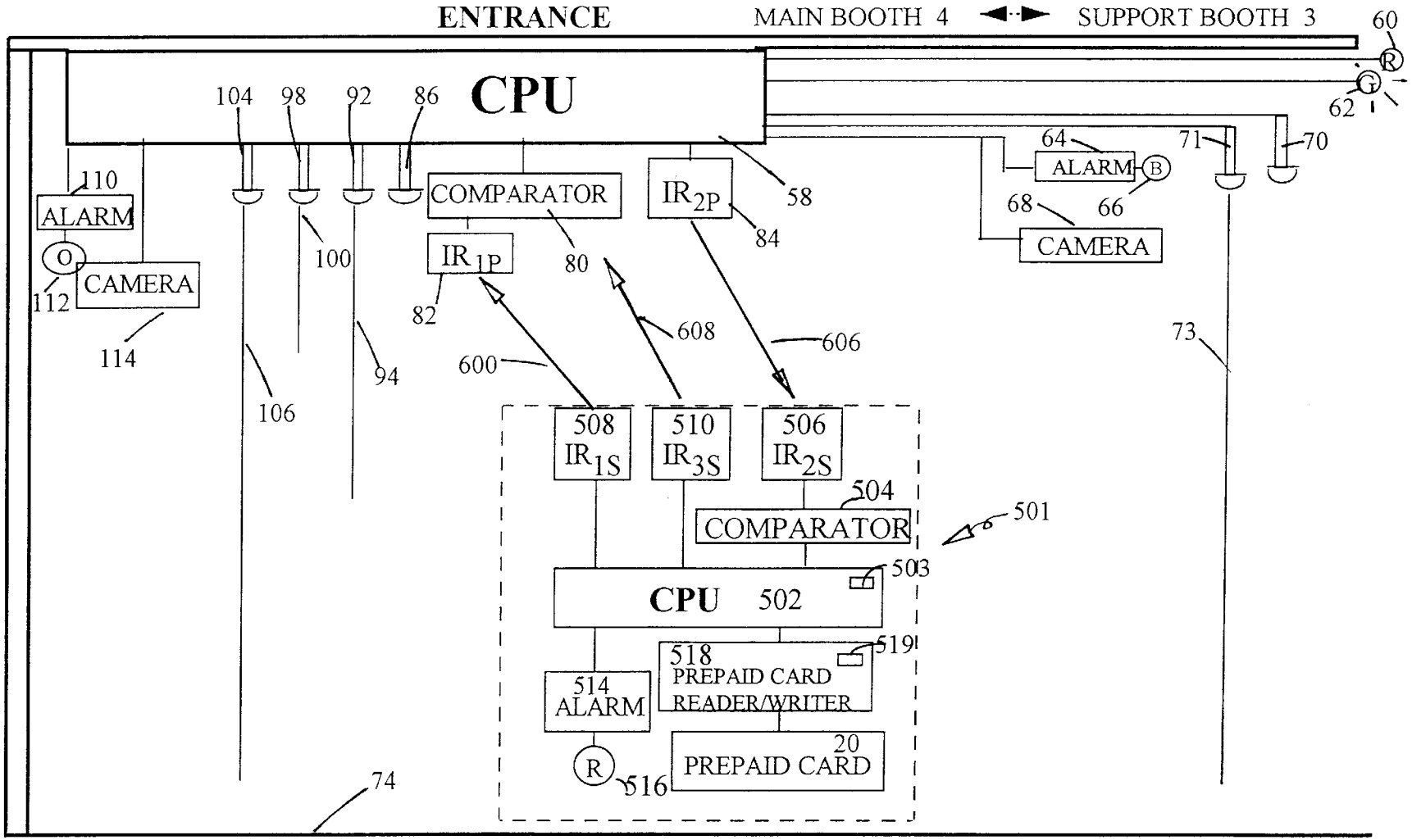
FIG. 28 is a block diagram of FIG. 27.

At main booth 4 of Entrance A, as shown in FIG. 27 and FIG. 28 which is a block diagram of FIG. 27, when saloon car 500 arrives at the main booth 4 of Entrance A, an infrared beam 600, assumingly, of a specific modulation frequency 1 KHz is transmitted out by $IR_{1S}$ 508 of IVU 501 at all time. This frequency of 1 KHz is supposed to be the identification frequency of a saloon-type car or any vehicles of a height less than 2.0 meters. This infrared beam 600 is received by receiver $IR_{1P}$ 82 of the main booth 4 where signal is sent to the comparator 80. Comparator 80 identifies that the signal is of 1 KHz and informs the CPU 58. CPU 58 then commands only LED 86 to stop emitting only one infrared beam 88 such that no beam 88 is emitted out. In the mean time, an infrared beam 606 is transmitted from transmitter $IR_{2P}$ 84 of the main booth 4 of this particular Entrance A. This beam is predetermined to have a specific modulation frequency of 10 KHz which will be called the identification frequency of Entrance A. This infrared beam 606 in turn is received by receiver $IR_{2S}$ 506 of IVU 501 of saloon car 5000. Comparator 504 then identifies this frequency of 10 KHz and sends the information to CPU 502 to be recorded in the memory 503 of IVU 501.

CPU 502, besides recording the data of infrared frequency of 10 KHz in its memory 503, it also commands another transmitter $IR_{3S}$ 510 to transmit an infrared beam 608 of 10 KHz out at all time. That is this specific infrared modulation frequency of 10 KHz received besides being kept in the memory 503 of IVU 501, the transmitter $IR_{3S}$ 510 must also be actuated by CPU 502 to transmit out the infrared beam 608 of the same frequency 10 KHz to communicate with the receivers $IR_{3P}$ 185 at the canopy of the main booth of Exits D, E or F to inform that this vehicle entered the expressway from Entrance A. Therefore, if a vehicle with its $IR_{1S}$ transmitting out an infrared beam of 1 KHz and its $IR_{3S}$ transmitting out an infrared beam of 10 KHz, it can tell any exits that it is a saloon car (having in identification frequency of 1 KHz) and it comes from Entrance A (having an identification frequency of 10 KHz).

Figure 29:
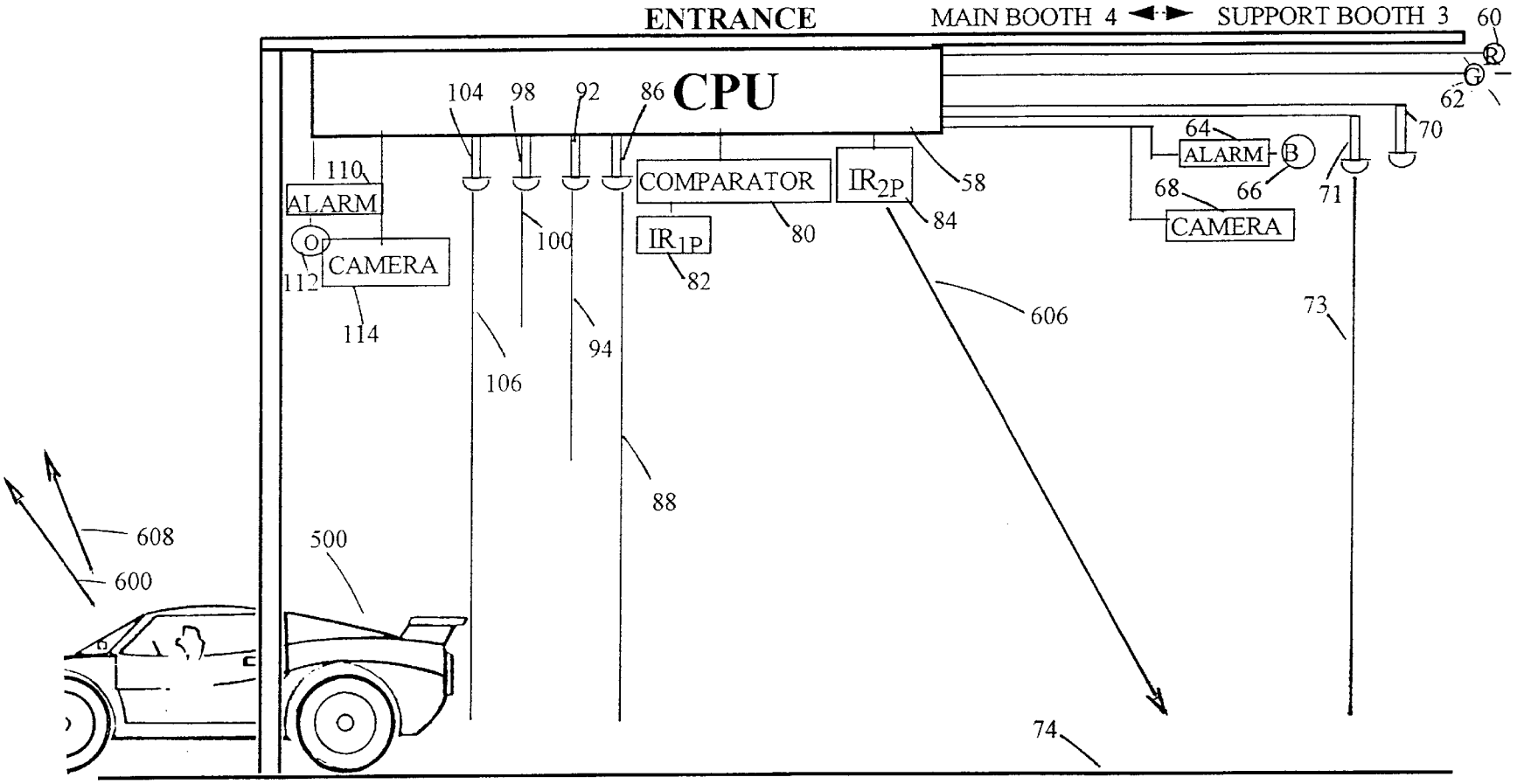
FIG. 29 shows a saloon car while moving out from the infrared beam of switch on tailing-down type at the main booth of an entrance.

When saloon car 500 (of a height less than 2.0 meters) moves a little further, it will then be under the two infrared beams 94 and 100 respectively (where the ends 96 and 102 of the beams 94 and 100 are 2.0 and 2.80 meters respectively, above the road surface 74. Thus both are above any vehicles with the maximum height less than 2.0 meters). There will be no transmission of the infrared beam 88 (with its end 0.50 meter above the surface 74) to be blocked by saloon car 500. This is because after the $IR_{1P}$ 82 having received an infrared signal 600 of 1 KHz from $IR_{1S}$ 508, the comparator 80 sends the information to CPU 58 to order the LED 86 NOT to emit the infrared beam 88 downward. There is thus no infrared beam 88 of switch on tailing-up type to be blocked by saloon car 500. The voice alarm 10 is not actuated, the orange bulb 112 does not blink, and camera 14 is not actuated. Saloon car 500 moves forward to block a last infrared beam 106, which is of switch on tailing-down type, being emitted from LED 104 of the entrance main booth 4. Therefore, only after saloon car 500 has moved out from the infrared beam 106 as shown in FIG. 29 that CPU 58 commands the LED 86 to reemit an infrared beam 88 once again downward. At the same time at the support booth 3, CPU 58 also commands the turning off of red light bulb 60, LED 70 to stop emitting an infrared beam 72 and green light bulb 62 to turn on and start blinking again as a signal that saloon car 500 has been moving away from the main booth 4 of Entrance A towards any exit and that a next vehicle is then allowed to enter the support booth 3 of Entrance A.

Saloon car 500 moves out of main booth 4 of Entrance A simultaneously as $IR_{1S}$ 508 transmitting out the infrared beam 600 of frequency 1 KHz and $IR_{3S}$ 510 transmitting out the infrared beam 608 of frequency 10 KHz at all time. Saloon car 500 then moves, assumingly, towards Exit F.

The situation of the vehicle passes through the support booth 13 of Exit F is similar to that of Entrance A.

At main booth 14 of Exit F.

Assuming at Exit F, before entering of any vehicles into main booth 14, the display screen 214 shows at that moment starting from 10.00 a.m. Aug. 8, 1995 that the total number of vehicles exit at Exit F is 0. Toll collected is also 0 at Time 0 hr. 0 min 0 sec as in FIG. 14. The number of each category of vehicles enter from Entrance A, B or C is 0.

Figure 30:
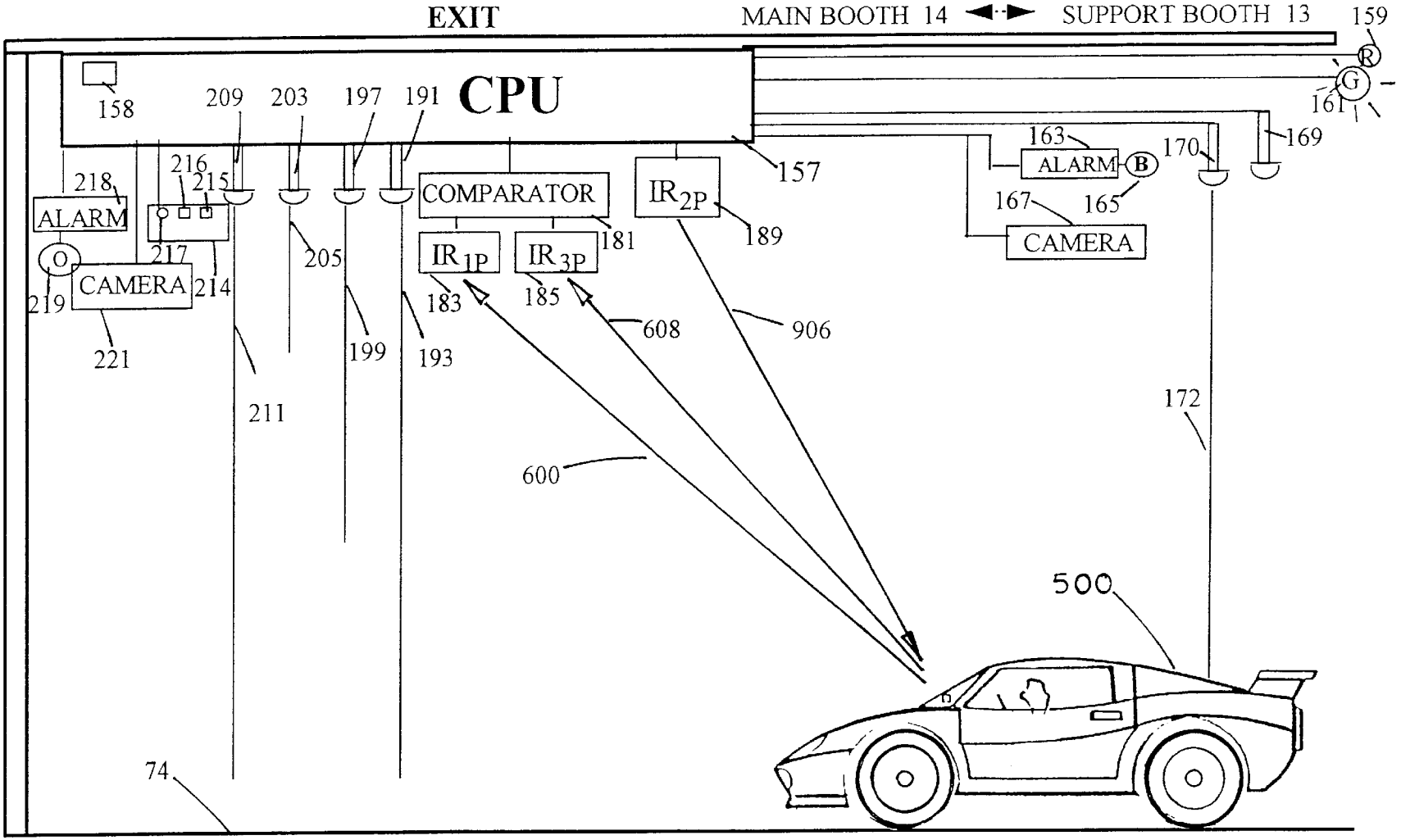
FIG. 30 shows a saloon car using a correct IVU while arriving at the main booth of an exit.
Figure 31:
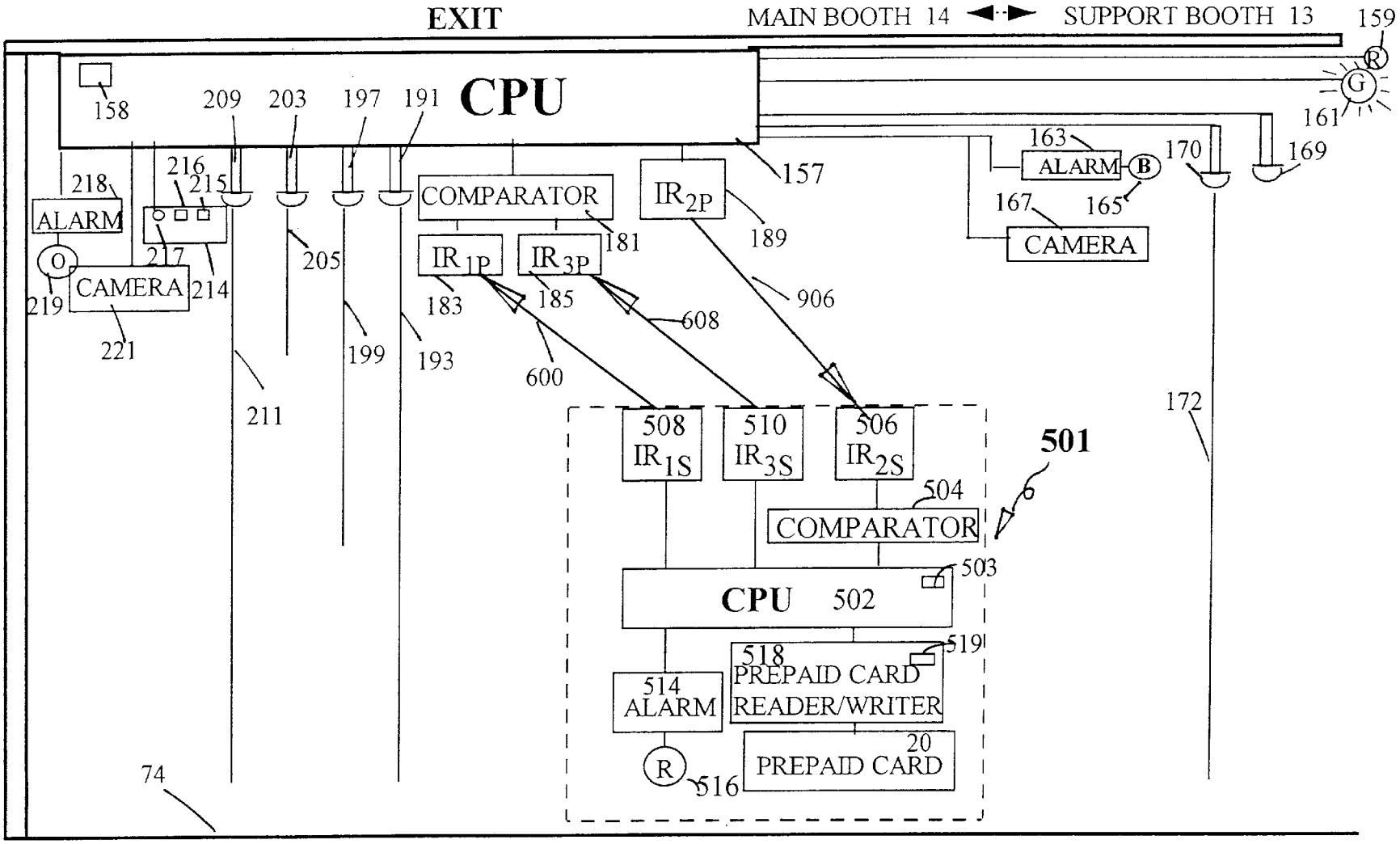
FIG. 31 is a block diagram of FIG. 30.

FIG. 30 and FIG. 31 which is a block diagram of FIG. 30 show that, at the main booth 14, an infrared beam 600 emitting from $IR_{1S}$ 508 by the order of CPU 502 in IVU 501 of saloon car 500 is received by $IR_{1P}$ 183 at the main booth 14 of Exit F. Comparator 181 identifies this infrared signal that it is of 1 KHz frequency (which is a frequency identifying a vehicle of any height less than 2.0 meters) and informs CPU 157 of the main booth 14 of Exit F. This informs CPU 157 that the arriving vehicle is one saloon car. CPU 157 then orders only LED 191 to stop emitting the infrared beam 193. In the mean time, an infrared beam 60X of frequency 10 KHz (which is equal to the frequency identifying the Entrance A) emitting from $IR_{3S}$ 510 in the vehicle is received by a receiver $IR_{3P}$ 185 at the main booth 14. The signal is identified by comparator 181 that it has a frequency of 10 KHz and comparator 181 informs CPU 157. CPU 157 processes the data of the two frequencies 10 KHz (which is also a modulation frequency identifying the Entrance A) and 60 KHz (which is a modulation frequency identifying the Exit F). The result from the processing supposed that a toll of ฿120 must be collected for a saloon car passing this toll booth. CPU 157 orders this number 120 to be shown on a display screen 214 as FIG. 15, located as the amount of toll charged at the line of the category of the vehicle having a height less than 2.0 meters coming from Entrance A.

Thus, after 1 hr. 2 min. 5 sec. which is at 11.02.05 am. Aug. 8, 1995, suppose there are 10 saloon cars coming from Entrance A to exit at Exit F. The display screen 214 shows that there are 10 saloon cars enter from Entrance A. The tolls collected for saloon cars would be ฿1200 as in FIG. 15.

At the same time, in IVU 501 of a saloon car 500, receiver $IR_{2S}$ 506 receives infrared beam 906 emitting from transmitter $IR_{2P}$ 189 having a frequency of 60 KHz (which is a modulation frequency identifying the Exit F) at all time. Comparator 504 of IVU 501 identifies the signal and sends this information to CPU 502. CPU 502 then processes this infrared frequency of 60 KHz with the frequency of 10 KHz, the frequency identifying Entrance A recorded in its memory 503 while passing the main booth 4 of the Entrance A. The execution results in a toll of, assumingly, ฿120 needs to be collected. CPU 502 then subtracts this number from the cash balance present in prepaid card 20 inserted in IVU 501 and instructs the card reader/writer 518 to rewrite a new number resulted from the substraction onto the card represents a new cash balance. For example, if the previous cash balance was ฿800, then after the subtraction of ฿120 it will be left with ฿680 to be rewritten onto the card 20 by the card reader/writer 518. The number ฿680 is to be then displayed on the screen 519 of the card reader/writer 518.

After the new cash balance has been written onto the prepaid card 20, the card reader/writer 518 ejects out the prepaid card 20 and IVU 501 is automatically turned off.

Figure 32:
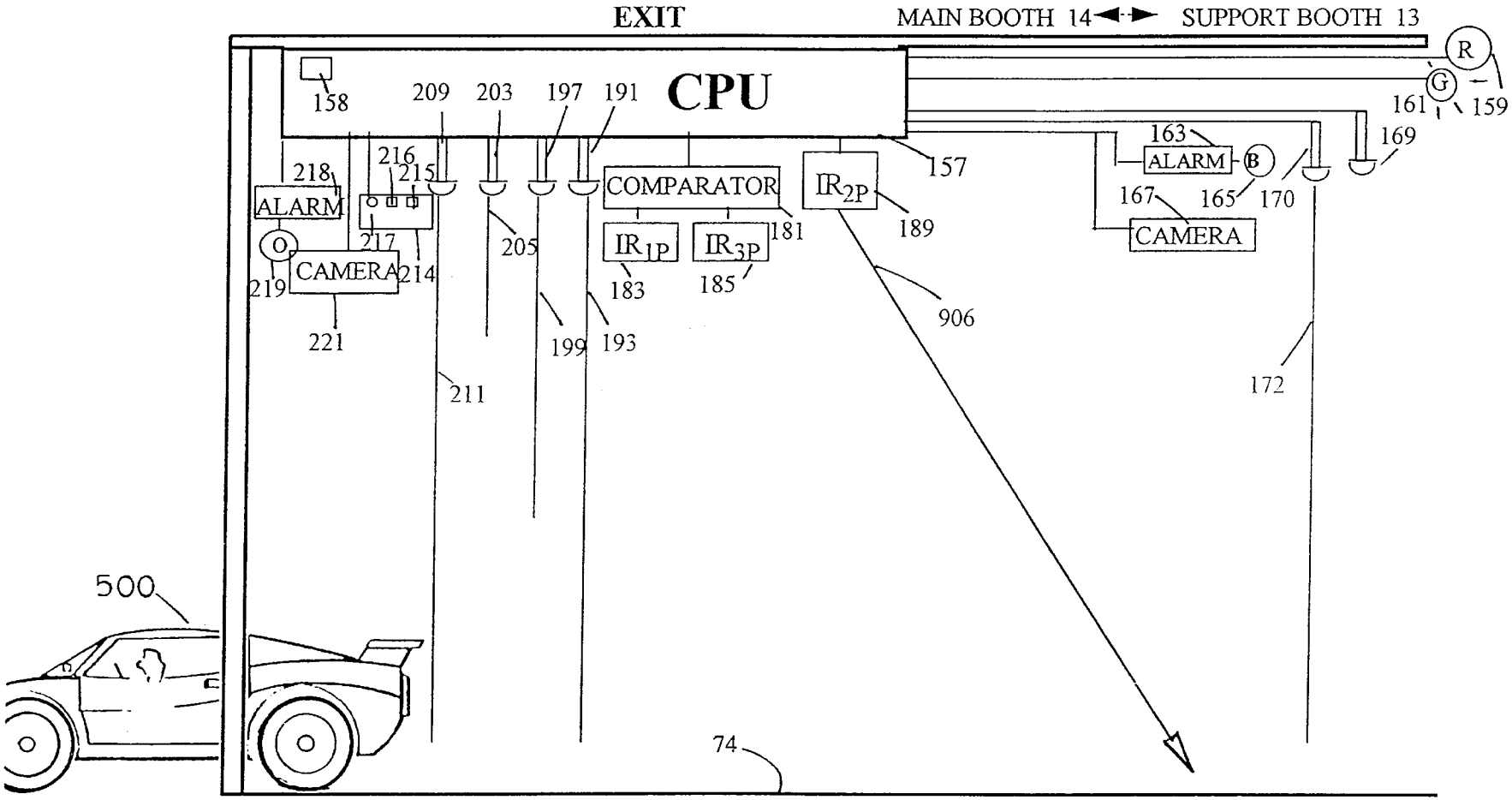
FIG. 32 shows a saloon car while moving out from the infrared beam of switch on tailing-down type at the main booth of an exit.

When saloon car 500 moves a little further, it will then be under two infrared beams, namely, 199 and 205, respectively (with their ends 201 and 207 at the levels 2.0 and 2.80 meters above the road surface 74, respectively). There is no infrared beam 193, with its end at 0.50 meter above the surface 74, to be blocked by saloon car 500. CPU then cancels the actuation of alarm 218, orange light bulb 219 and camera 221. Thus, the saloon car moves forward until it blocks an infrared beam 211 of switch on tailing-down type. Only after saloon car 500 has moved away from the beam 211 as in FIG. 32 that CPU commands LED 191 to reemit an infrared beam 193 once again. At the same time at support booth 13, CPU 157 commands the red light bulb 159 to turn off, LED 169 to stop emitting an infrared beam 171 and green light 161 to start blinking once again. This is a signal means that saloon car 500 has already moved out from the main booth 14 at Exit F and get off the expressway 1, thus allowing that a next vehicle waiting at a waiting zone outside the support booth 13 may now pass the support booth 13 and move forward to main booth 14.

All these steps of how a presently disclosed automatic toll-collecting system functions are described in very elaborated details, although in practice the whole toll-paying action occurs within a very short time with almost no delay between the preceding and the next cars as they may pay the toll while driving at a normal driving speed.

2. A van 530 or any vehicles of a height equal to or greater than 2.0 meters but less than 2.80 meters.

Figure 33:
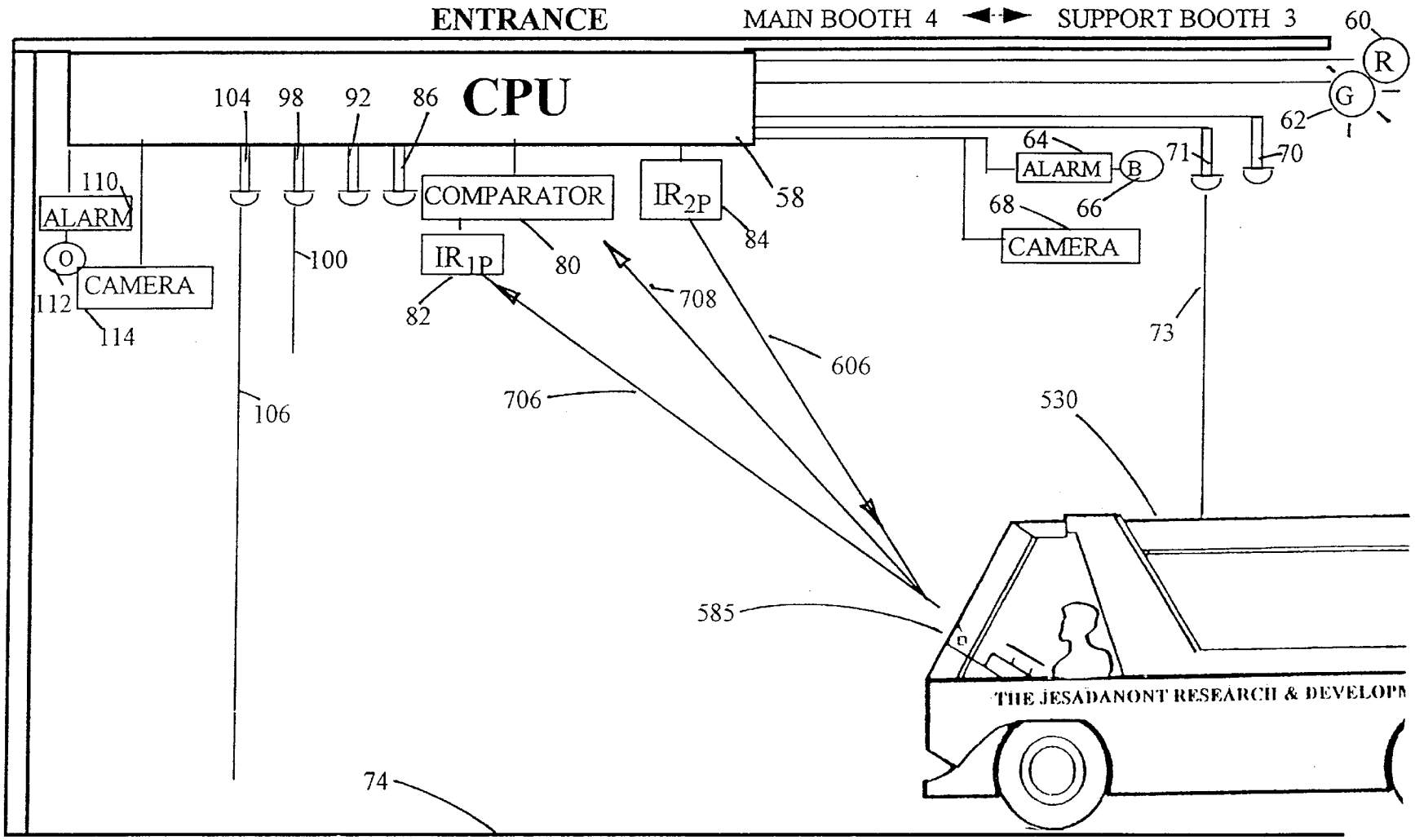
FIG. 33 shows a van using a correct IVU while arriving at the main booth of an entrance.
Figure 34:
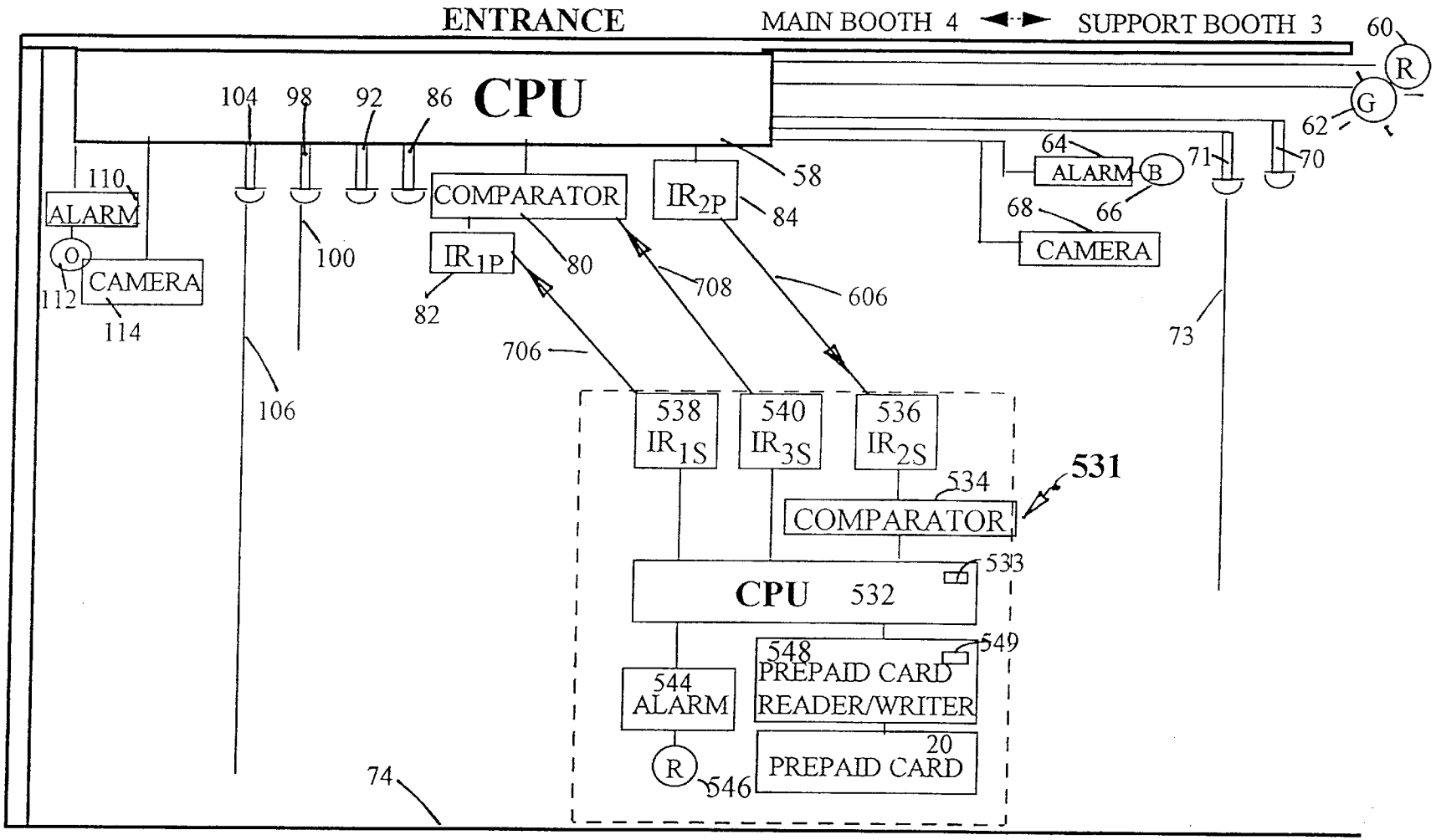
FIG. 34 is a block diagram of FIG. 33.

At main booth 4 of Entrance A, as shown in FIG. 33 and FIG. 34 which is a block diagram of FIG. 33, when van 530 arrives at the main booth 4 of the Entrance A, an infrared beam 706, assumingly, of a specific modulation frequency 2 KHz is transmitted out by $IR_{1S}$ 538 of IVU 531 at all time. This frequency of 2 KHz is to be the identification frequency of a van or any vehicles of a height equal to or greater than 2.0 meters but less than 2.80 meters. This infrared beam 706 is received by receiver $IR_{1P}$ 82 of the main booth 4 where signal is sent to the comparator 80. Comparator 80 identifies that the signal is of 2 KHz and informs the CPU 58. CPU 58 then commands LEDs 86 and 92 to stop emitting infrared beams 88 and 94, respectively such that no beams 88 and 94 are emitted out. In the mean time, an infrared beam 606, transmitted from transmitter $IR_{2P}$, 84 of the main booth 4 of this particular Entrance A, has a specific identification frequency of 10 KHz. This infrared beam 606 in turn is received by a receiver $IR_{2S}$ 536 of IVU 531 of van 530. Comparator 534 then identifies this frequency of 10 KHz and sends the information to CPU 532 to be recorded in the memory 533 of IVU 531.

CPU 532, besides recording the data of infrared frequency of 10 KHz in its memory 533, it also commands transmitter $IR_{3S}$ 540 to transmit an infrared beam 708 of 10 KHz out at all time. That is this specific infrared modulation frequency of 10 KHz received besides being kept in the memory 533 of IVU 531, transmitter $IR_{1S}$ 540 must also be actuated by CPU 532 to transmit out the infrared beam 708 of the same frequency, 10 KHz, to communicate with the receivers , $IR_{3P}$ 185, at the Exits D, E or F to inform that this vehicle entered the expressway from Entrance A. Therefore, if a vehicle with its $IR_{1S}$ transmitting out an infrared beam of 2 KHz and its $IR_{3S}$ transmitting out an infrared beam of 10 KHz, it can tell any exits that it is a van (having an identification frequency of 2 KHz) and it comes from the Entrance A (having an identification frequency of 10 KHz).

Figure 35:
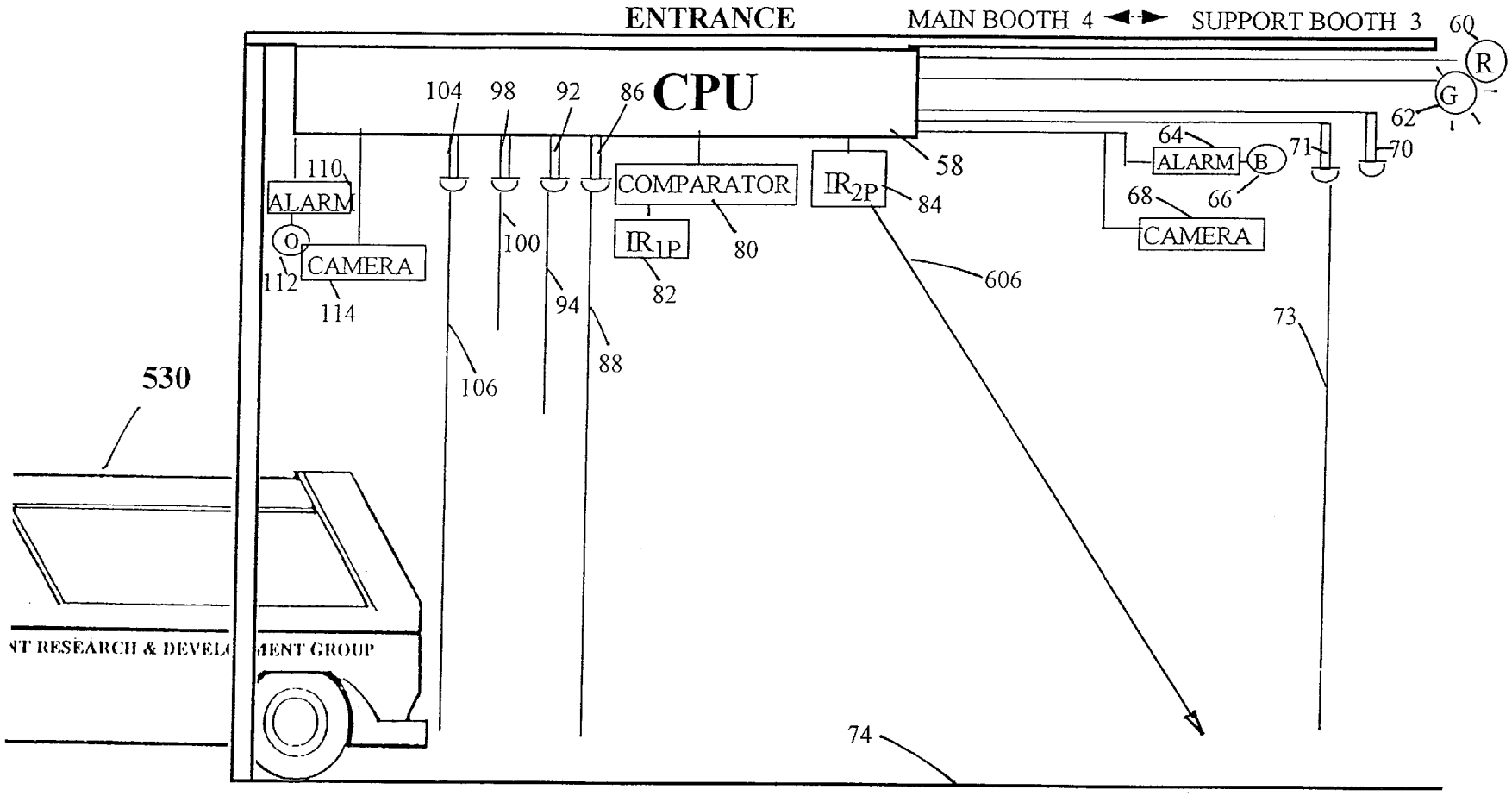
FIG. 35 shows a van while moving out from the infrared beam of switch on tailing-down type at the main booth of an entrance.

When van 530 moves a little further, it will then be under only one infrared beam 100 (since the end 102 of the beam 100 is 2.80 meters above the road surface 74). Thus, there will be no transmission of the infrared beams 88 and 94 to be blocked by van 530. This is because after $IR_{1P}$ 82 having received an infrared signal 706 of 2 KHz from $IR_{1S}$ 538, the comparator 80 sends the information to CPU 58 to order the LEDs 86 and 92 NOT to emit the infrared beams 88 and 94 downward. The voice alarm 110 is not actuated, the orange bulb 112 does not blink, and the camera 114 is not actuated. Van 530 moves forward to block a last infrared beam 106, which is of switch on tailing-down type, being emitted from LED 104 of the entrance main booth 4. Therefore, only after van 530 has moved out of the infrared beam 106 as shown in FIG. 35 that CPU 58 commands the LEDs 86 and 92 to emit the infrared beams 88 and 94 once again downward. At the same time at the support booth 3, CPU 58 also commands the turning oft of red light 60, LED 70 to stop emitting an infrared beam 72 and green light 62 to start blinking again as a signal that van 530 has moved away from the main booth 4 of the Entrance A towards any exit and that a next vehicle is then allowed to enter the support booth 3 of the Entrance A.

Van 530 moves out of main booth 4 of Entrance A simultaneously as $IR_{1S}$ 538 transmitting out the infrared beam 706 of frequency 2 KHz and $IR_{3S}$ 540 transmitting out the infrared beam 708 of frequency 10 KHz at all time. Van 530 then moves, assumingly, towards Exit F.

At main booth 14 of Exit F.

Assuming at Exit F, before entering of any vehicle into main booth 4, the display screen 214 shows, at the moment starting from 10.00 a.m. Aug. 8, 1995, that the total number of vehicles exit at Exit F is 0. Toll collected is also 0 at Time 0 hr. 0 min 0 sec as in FIG. 14. The number of each category of vehicle enter from Entrance A, B or C is 0.

Figure 36:
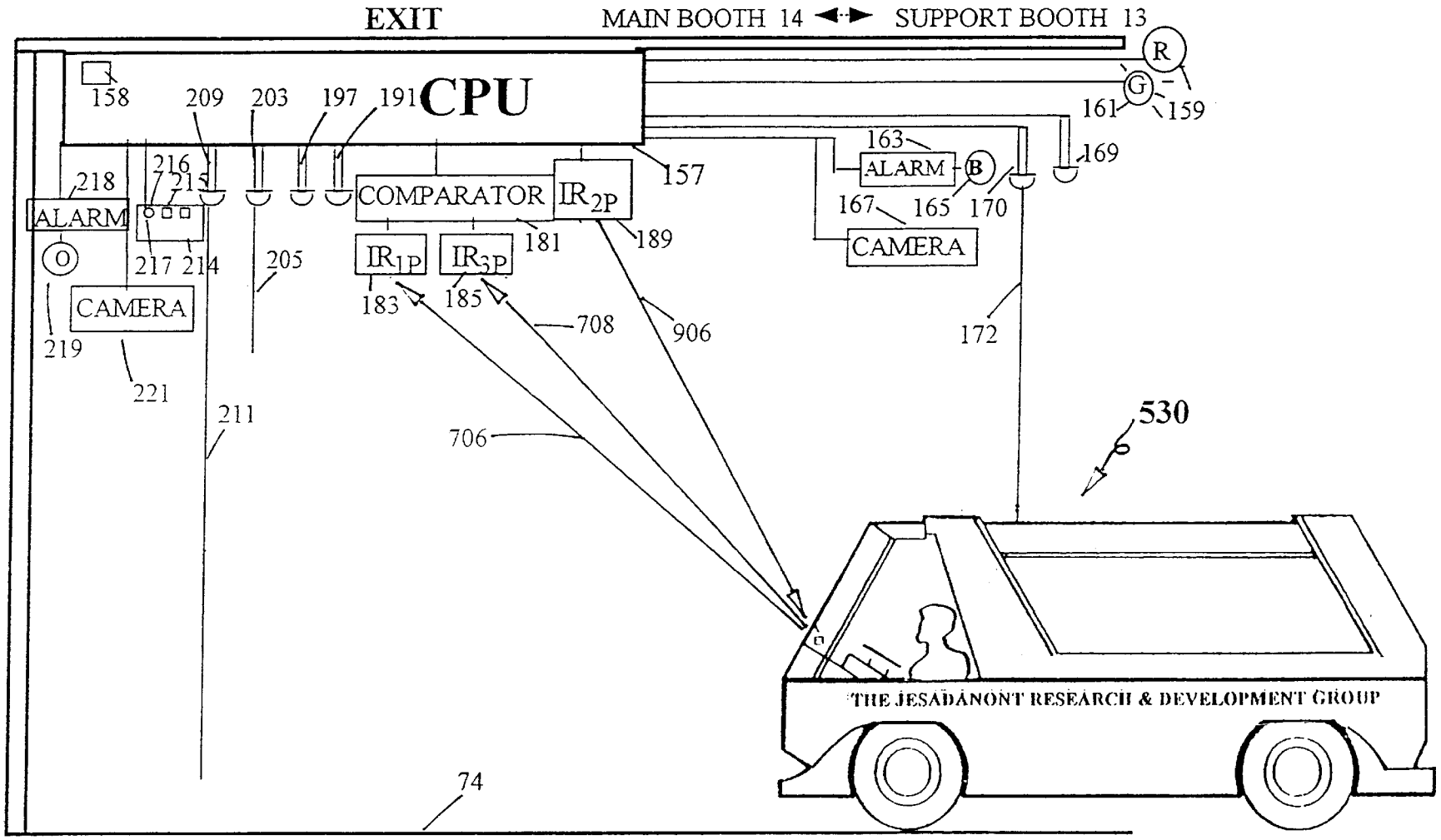
FIG. 36 shows a van using a correct IVU while arriving at the main booth of an exit.
Figure 37:
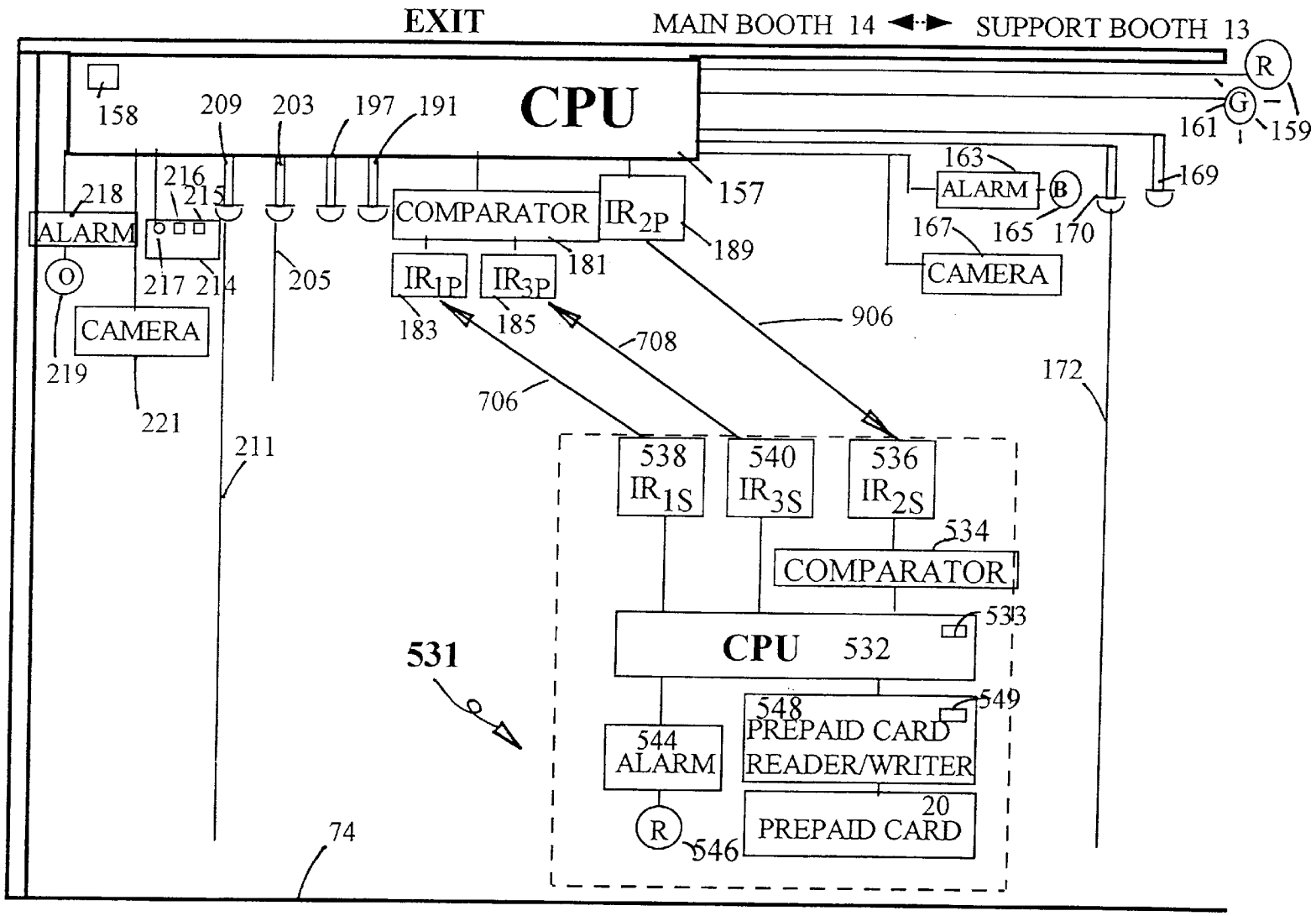
FIG. 37 is a block diagram of FIG. 38.

FIG. 36 and FIG. 37 which is a block diagram of FIG. 36 show that, at the main booth 14, an infrared beam 706 emitted from $IR_{1S}$ 538 by the order of CPU 532 in IVU 531 of van 530 is received by $IR_{1P}$ 183 at the main booth 14 of Exit F. Comparator 181 identifies this infrared signal that it is of 2 KHz frequency (which is a frequency identifying a vehicle of any height equal to or greater than 2.0 meters but less than 2.80 meters) and informs CPU 157 of the main booth 14 of Exit F. This informs CPU 157 that the arriving vehicle is one van. CPU 157 then orders LEDs 191 and 197 to stop emitting the infrared beams 193 and 199. In the mean time, an infrared beam 708 of frequency 10 KHz (which is equal to the frequency identifying the Entrance A) emitted from $IR_{3S}$ 540 in the vehicle is received by receiver $IR_{3P}$ 185 at the main booth 14. The signal is identified by a comparator 181 that it has a frequency of 10 KHz and comparator 181 informs CPU 157. CPU 157 processes the data of the two frequencies 10 KHz (which is also a modulation frequency identifying the Entrance A) and 60 KHz (which is a modulation frequency identifying the Exit F). The result from the processing supposed that a toll of ฿140 must be collected from a van passing this toll booth. CPU 157 orders this number 140 to be shown on a display screen 214 as FIG. 15, located as the amount of toll charged at the line of the category of the vehicle having a height equal to or greater than 2.0 meters but less than 2.80 meters coming from Entrance A.

Thus, after 1 hr. 2 min. 5 sec. which is at 11.02.05 am. Aug. 8, 1995, suppose there are 10 vans coming from Entrance A to exit at Exit F. The display screen 214 shows that there are 10 vans enter from Entrance A. The tolls collected for vans would be ฿1400 as in FIG. 15.

At the same time, in IVU 531 of van 530, receiver $IR_{2S}$ 536 receives an infrared beam 906 emitted from transmitter $IR_{2P}$ 189 having a frequency of 60 KHz (which is a modulation frequency identifying the Exit F) at all time. Comparator 534 of IVU 531 identifies the signal and sends this information to CPU 532. CPU 532 then processes this infrared frequency of 60 KHz with the frequency of 10 KHz the frequency identifying Entrance A recorded in its memory 533 while passing the main booth 4 of the Entrance A. The execution results in a toll of, assumingly, ฿140 needs to be collected. CPU 532 then subtracts this number from the cash balance present in prepaid card 20 inserted in IVU 531 and instructs the card reader/writer 548 to rewrite a new number resulted from the substraction onto the card represents a new cash balance. For example, if the previous cash balance was ฿800, then after the subtraction of ฿140 it will be left with ฿660 to be rewritten onto the card 20 by the card reader/writer 548. The number ฿660 is to be then displayed on the screen 519 of the card reader/writer 548.

After the new cash balance has been written onto the prepaid card 20, the card reader/writer 548 ejects out the prepaid card 20 and IVU 531 is automatically turned off.

Figure 38:
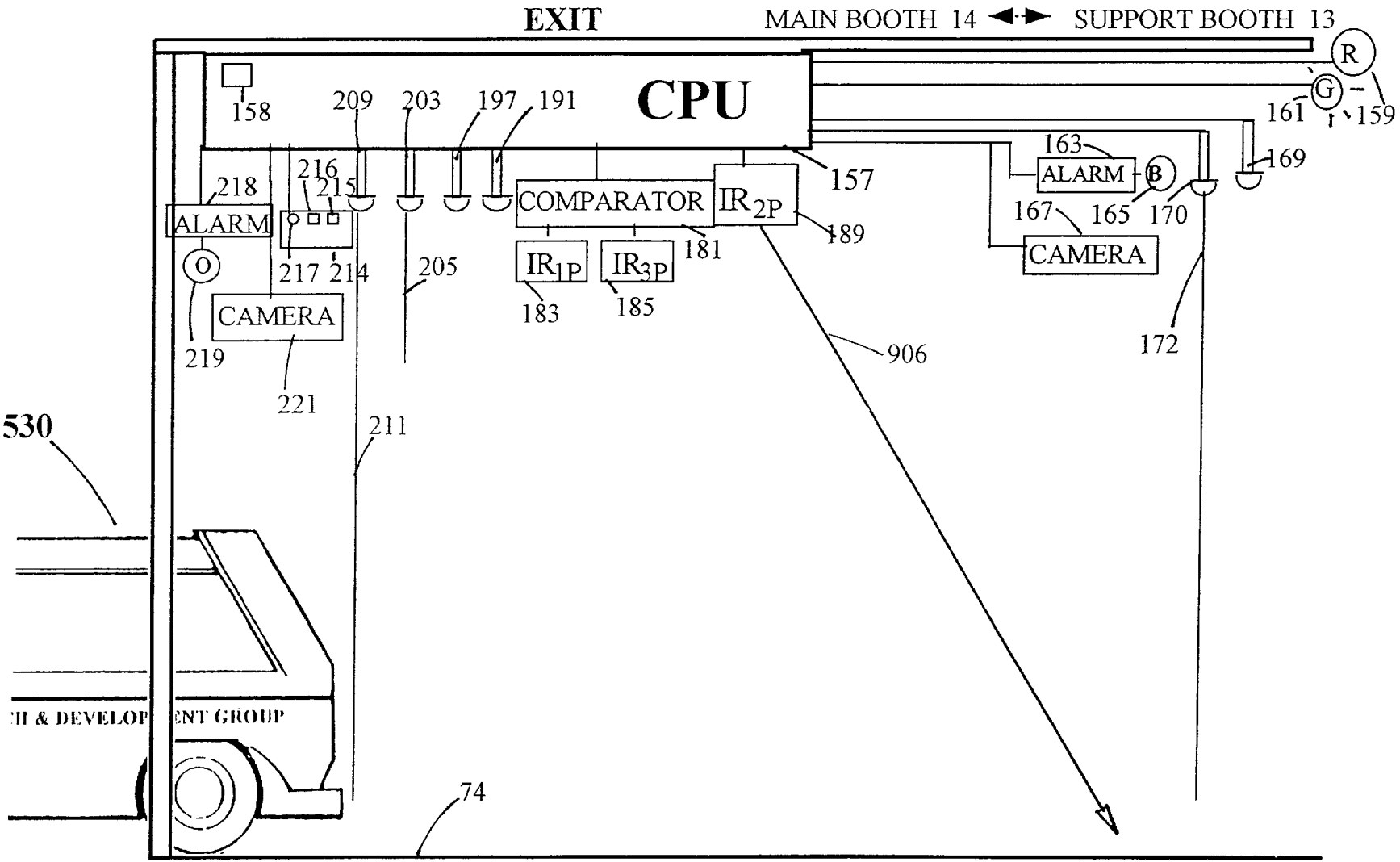
FIG. 38 shows a van while moving out from the infrared beam of switch on tailing-down type at the main booth of an exit.

When van 530 moves a little further, it will then be under the infrared beam, namely, 205 (with its end 207 at 2.80 meters above the road surface 74). There are no infrared beams 193 and 199 to be blocked by van 530 since the an infrared beam 706 of 2 KHz frequency emitted from $IR_{1S}$ 538 and received by $IR_{1P}$ 183 will actuate the CPU 157 to order LEDs 191 and 197 to stop emitting out the beams 193 and 199, respectively. CPU then cancels the actuation of alarm 218, orange light bulb 219 and camera 221. Thus, the van moves forward until it blocks an infrared beam 211 of switch on tailing-down type. Only after van 530 has moved out from the beam 211 as in FIG. 38 that CPU commands LEDs 191 and 197 to reemit out the beams 193 and 199, respectively, once again. At the same time at support booth 13, CPU 157 commands the red light bulb 159 to turn off, LED 169 to stop emitting an infrared beam 171 and green light 161 to start blinking once again. This is a signal means that van 530 has already moved out from the main booth 14 at Exit F and get off the expressway 1, thus allowing that a next vehicle waiting at a waiting zone outside the support booth 13 may now pass into support booth 13 and move forward to main booth 14.

3. A truck 560 or a bus or any vehicles of a height equal to or greater than 2.80 meters.

Figure 39:
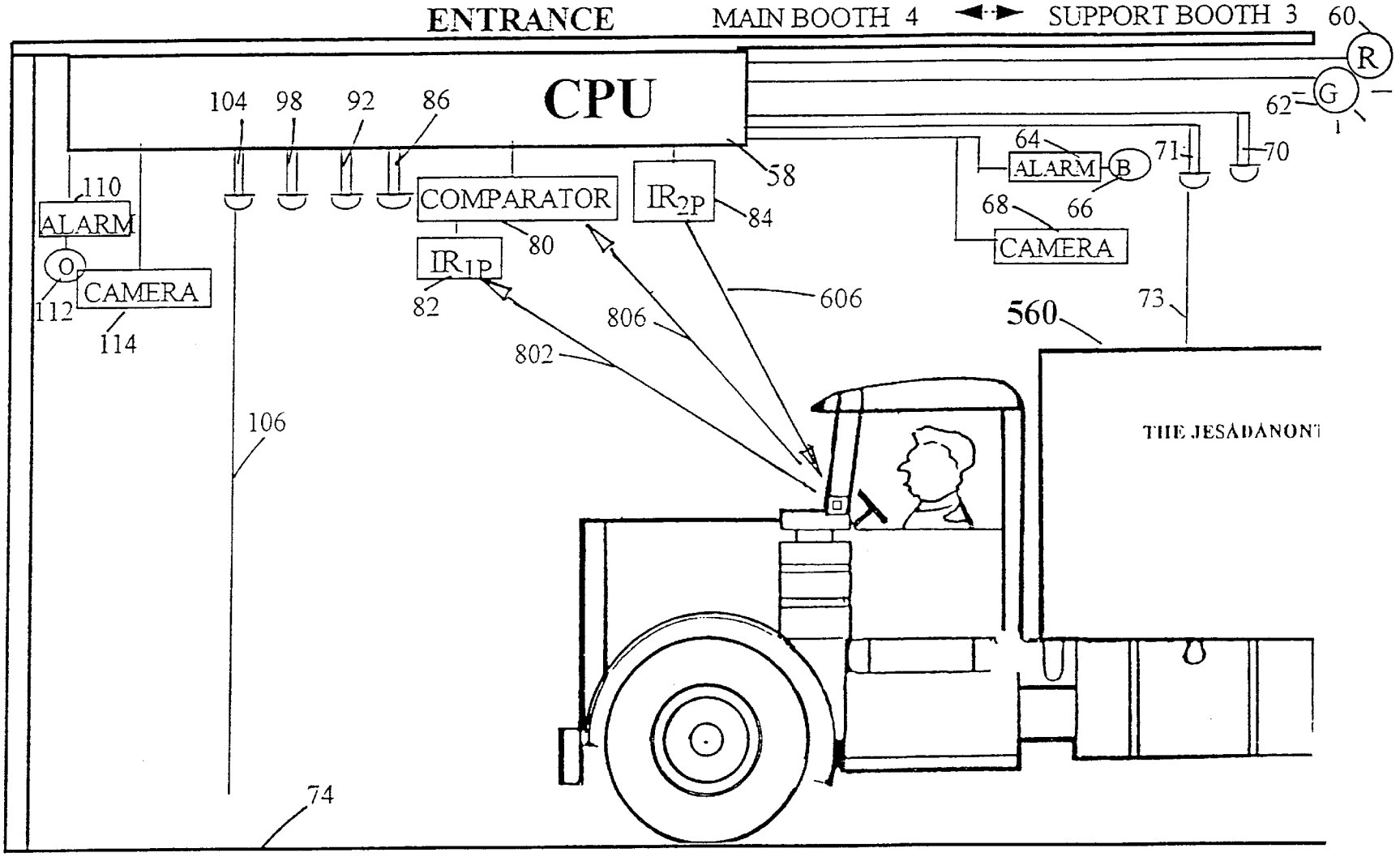
FIG. 39 shows a truck using a correct IVU while arriving at the main booth of an entrance.
Figure 40:
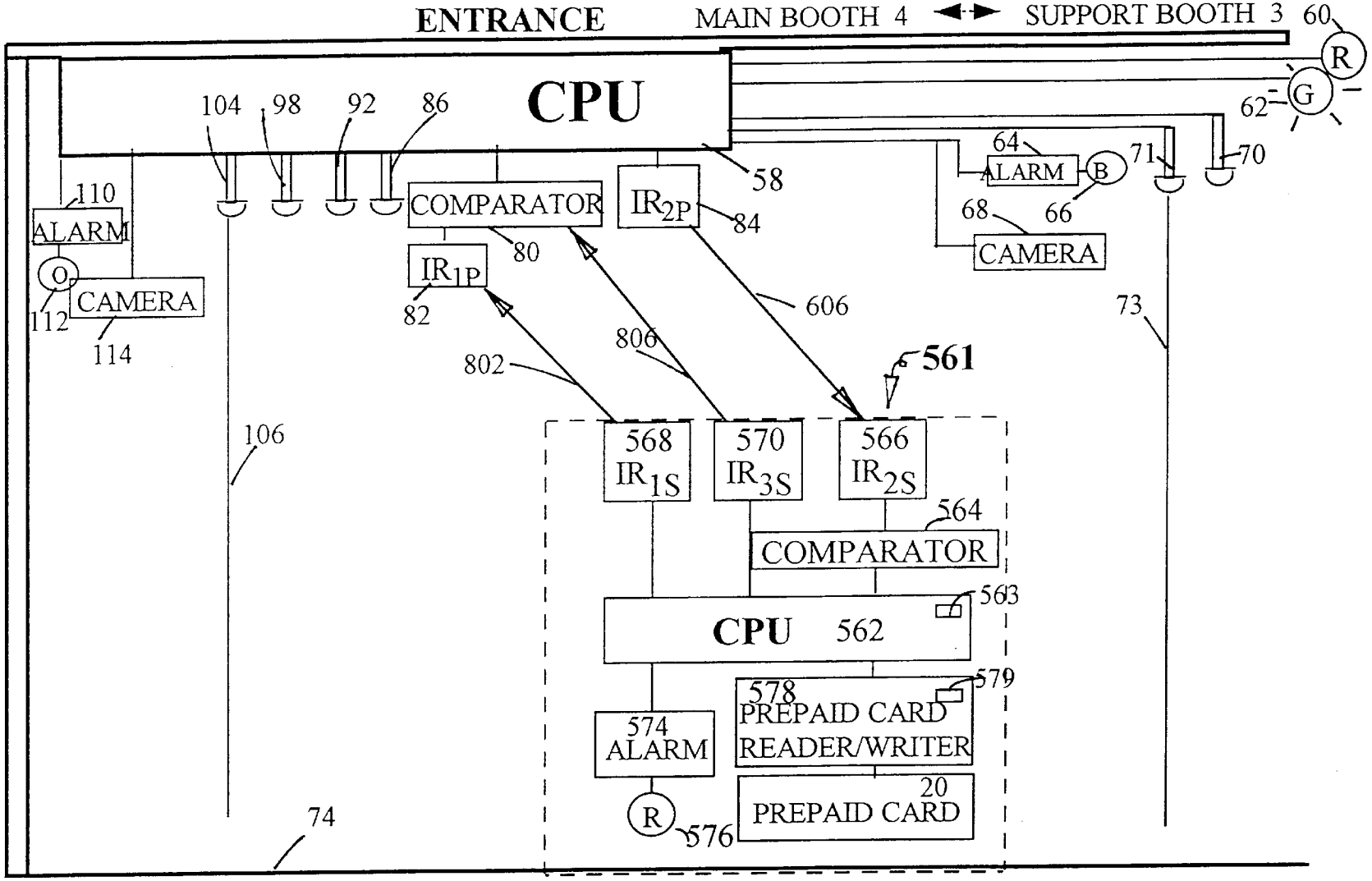
FIG. 40 is a block diagram of FIG. 39.

At main booth 4 of Entrance A, as shown in FIG. 39 and FIG. 40 which is a block diagram of FIG. 39, when truck 560 arrives at the main booth 4 of the Entrance A, infrared beam 802, assumingly, of a specific modulation frequency 3 KHz is transmitted out by $IR_{1S}$ 568 of IVU 561 at all time. This frequency of 3 KHz is supposed to be the identification frequency of a truck or any vehicles of a height equal to or greater than 2.80 meters. This infrared beam 802 is received by receiver $IR_{1P}$ 82 of the main booth 4 where signal is sent to the comparator 80. Comparator 80 identifies that the signal is of 3 KHz and informs the CPU 58. CPU 58 then commands LEDs 86, 92 and 98 to stop emitting infrared beams 88, 94 and 100, respectively, such that no beams 88, 94 and 100, are emitted out. In the mean time, an infrared beam 606, transmitted from transmitter $IR_{2P}$ 84 of the main booth 4 of this particular Entrance A, has a specific identification frequency of 10 KHz. This infrared beam 606 in turn is received by receiver $IR_{2S}$ 566 of IVU 561 of truck 560. Comparator 564 then identifies this frequency of 10 KHz and sends the information to CPU 562 to be recorded in the memory 563 of IVU 561.

CPU 562, besides recording the data of infrared frequency of 10 KHz in its memory 563, it also commands transmitter $IR_{3S}$ 570 to transmit an infrared beam 806 of 10 KHz out at all time. That is this specific infrared modulation frequency of 10 KHz received besides being kept in the memory 563 of IVU 561, the transmitter $IR_{3S}$ 570 must also be actuated by CPU 562 to transmit out the infrared beam 806 of the same frequency, 10 KHz, to communicate with the receivers, $IR_{3P}$ 185, at the Exits D, E or F to inform that this vehicle entered the expressway from Entrance A. Therefore, if a vehicle with its $IR_{1S}$ transmitting out an infrared beam of 3 KHz and its $IR_{3S}$ transmitting out an infrared beam of 10 KHz, it can tell any exits that it is a truck (having an identification frequency of 3 KHz) and it comes from the Entrance A (having an identification frequency of 10 KHz).

Figure 41:
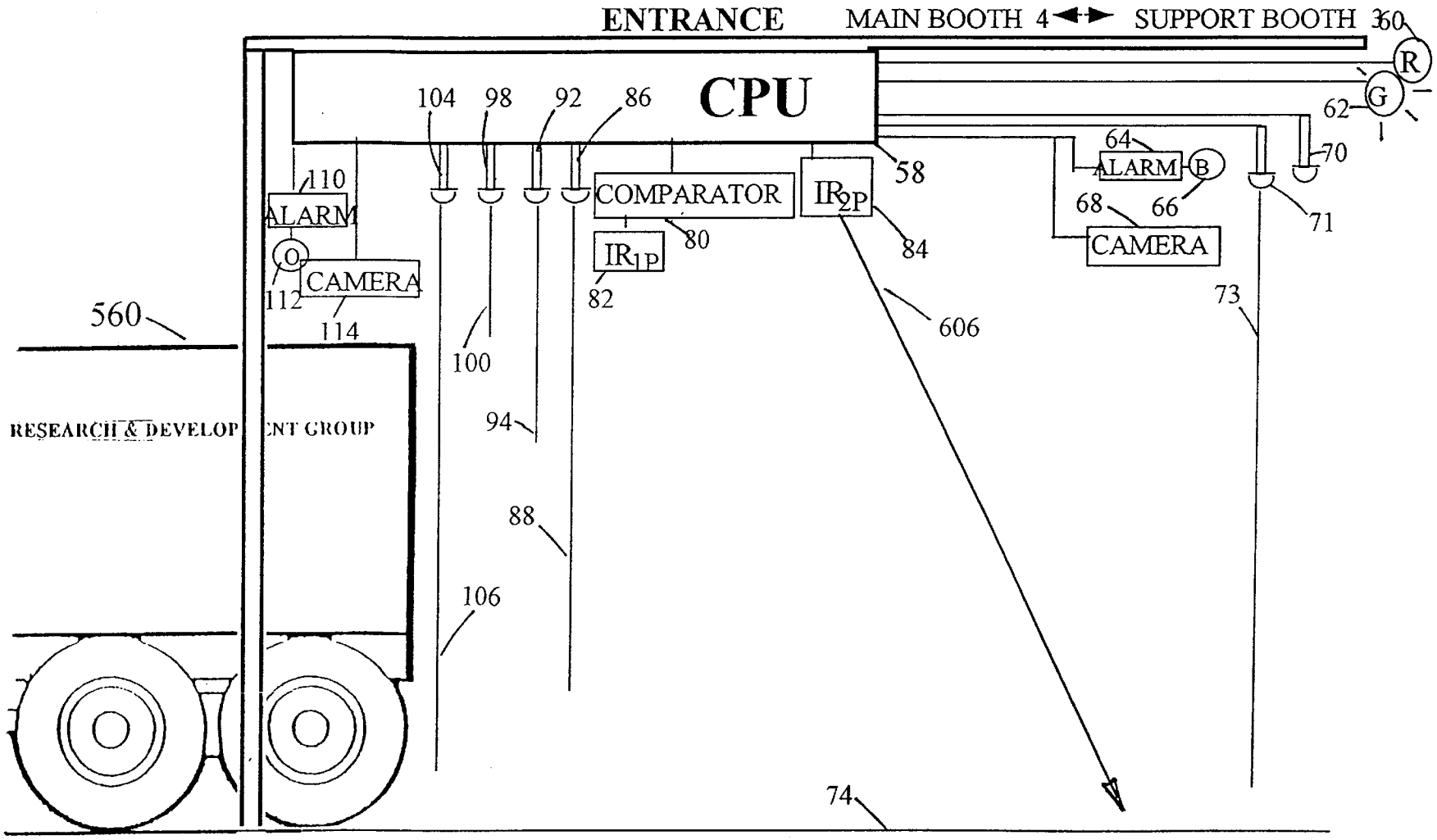
FIG. 41 shows a truck while moving out from the infrared beam of switch on tailing-down type at the main booth of an entrance.

When truck 560 moves a little further, there will be no infrared beam to be blocked. This is because after the $IR_{1P}$ 82 having received an infrared signal 802 of 3 KHz from $IR_{1S}$ 568, the comparator 80 sends the information to CPU 58 to order the LEDs 86, 92 and 98 NOT to emit the infrared beams 88, 94 and 100, respectively, downward. The voice alarm 110 is not actuated, the orange bulb 112 does not blink, and the camera 114 is not actuated. Truck 560 moves forward to block a last infrared beam 106, which is of switch on tailing-down type, being emitted from LED 104 of the entrance main booth 4. Therefore, only after truck 560 has moved out of the infrared beam 106 as shown in FIG. 41 that CPU 58 commands the LEDs 86, 92 and 98 to reemit the infrared beams 88, 94 and 100, respectively, once again downward. At the same time at the support booth 3, CPU 58 also commands the turning off of red light 60, LED 70 to stop emitting an infrared beam 72 and green light 62 to start blinking again as a signal that truck 560 has moved away from the main booth 4 of the Entrance A towards any exit and that a next vehicle is then allowed to enter the support booth 3 of the Entrance A.

Truck 560 moves out of main booth 4 of Entrance A simultaneously as $IR_{1S}$ 568 transmitting out the infrared beam 802 of frequency 3 KHz and $IR_{3S}$ 570 transmitting out the infrared beam 806 of frequency 10 KHz at all time. Truck 560 then moves, assumingly, towards Exit F.

At main booth 14 of Exit F.

Assuming at Exit F, before entering of any vehicle into main booth 4, the display screen 214 shows, at the moment starting from 10.00 a.m. Aug. 8, 1995, that the total number of vehicles exit at Exit F is 0. Toll collected is also 0 at Time 0 hr. 0 min 0 sec as in FIG. 14. The number of each category of vehicle enter from Entrance A, B or C is 0.

Figure 42:
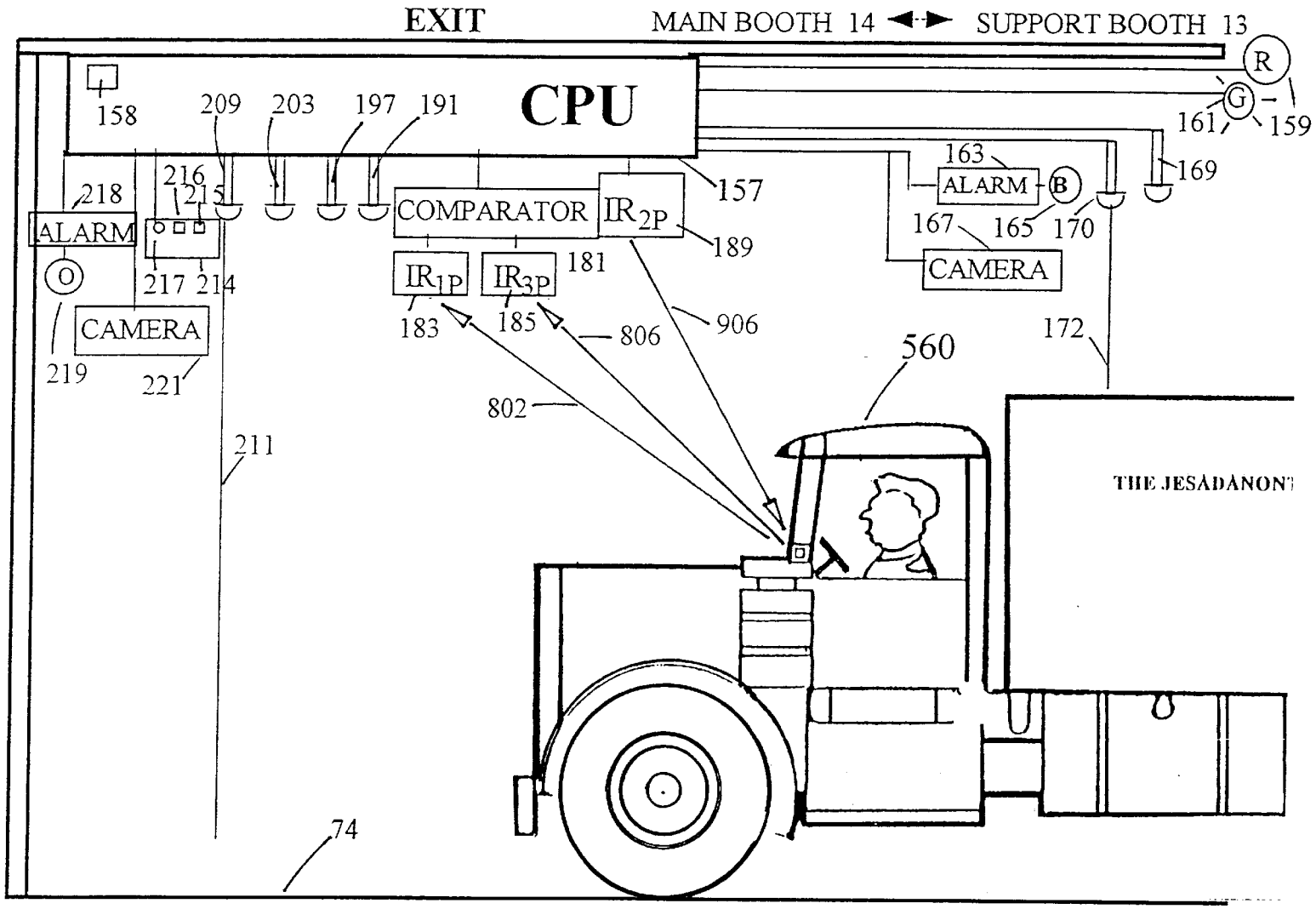
FIG. 42 shows a truck using a correct IVU while arriving at the main booth of an exit.
Figure 43:
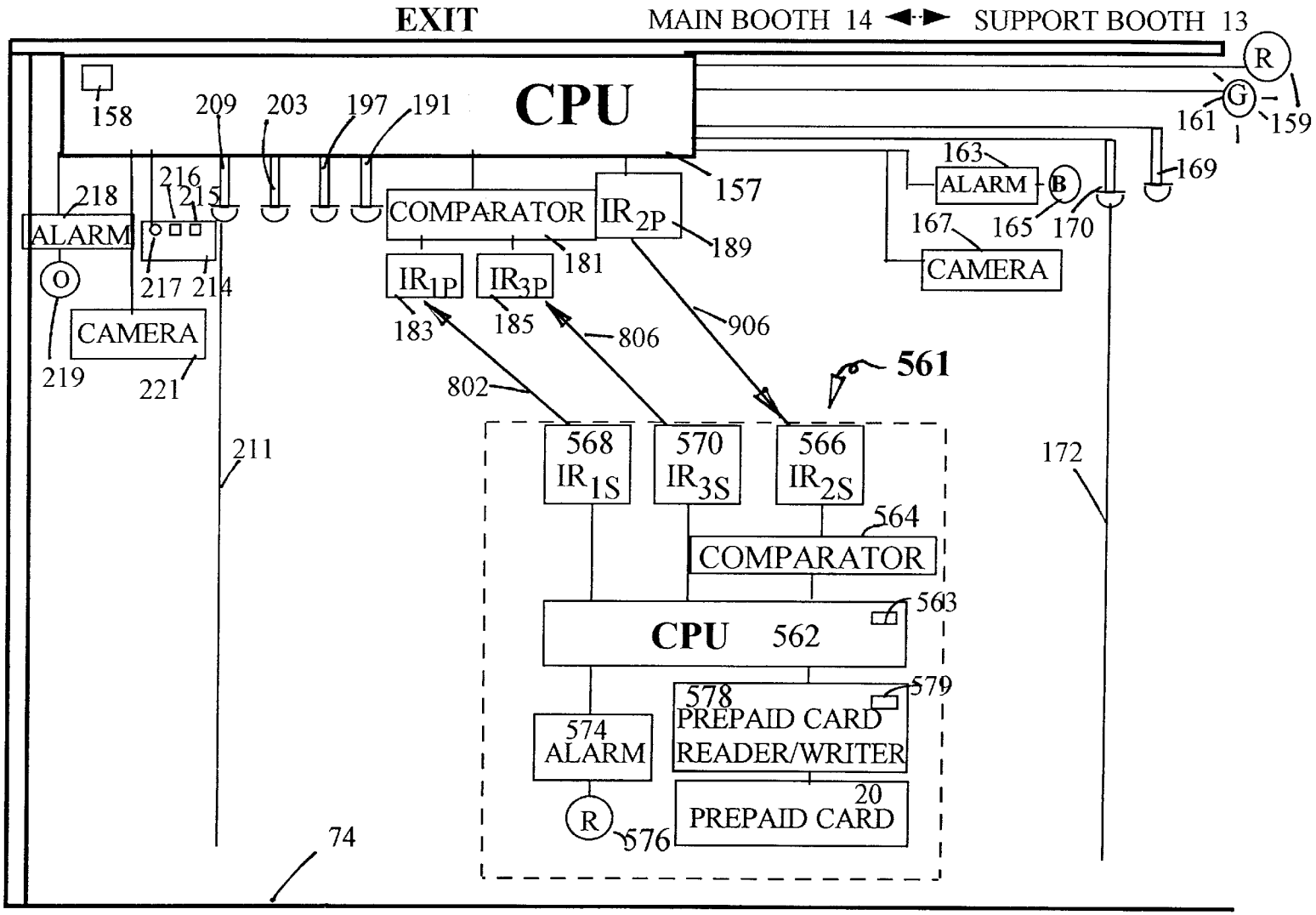
FIG. 43 is a block diagram of FIG. 38.

FIG. 42 and FIG. 43 which is a block diagram of FIG. 42 show that, at the main booth 14, an infrared beam 802 emitted from $IR_{1S}$ 568 by the order of CPU 562 in IVU 561 of truck 560 is received by $IR_{1P}$ 183 at the main booth 14 of Exit F. Comparator 181 identifies this infrared signal that it is of 3 KHz frequency (which is a frequency identifying a vehicle of any height equal to or greater than 2.80 meters) and informs CPU 157 of the main booth 14 of Exit F. This informs CPU 157 that the arriving vehicle is one truck. CPU 157 then orders LEDs 191, 197 and 203 to stop emitting the infrared beams 193, 199 and 205, respectively.

In the mean time, an infrared beam 806 of frequency 10 KHz (which is equal to the frequency identifying the Entrance A) emitted from $IR_{3S}$ 570 in the vehicle is received by a receiver $IR_{3P}$ 185 at the main booth 14. The signal is identified by a comparator 181 that it has a frequency of 10 KHz and comparator 181 informs CPU 157. CPU 157 processes the data of the two frequencies 10 KHz (which is also a modulation frequency identifying the Entrance A) and 60 KHz (which is a modulation frequency identifying the Exit F). The result from the processing supposed that a toll of ฿160 must be collected for a truck passing through this toll booth. CPU 157 orders this number 160 to be shown on a display screen 214 as FIG. 15, located as the amount of toll charged at the line of the category of the vehicle having a height equal to or greater than 2.80 meters coming from Entrance A.

Thus, after 1hr. 2 min. 5 sec. which is at 11.02.05 am. Aug. 8, 1995, suppose there are 10 trucks coming from Entrance A to exit at Exit F. The display screen 214 shows that there are 10 trucks enter from Entrance A. The total toll collected would be ฿1600 as in FIG.15.

At the same time, in IVU 561 of truck 560, receiver $IR_{2S}$ 566 receives infrared beam 906 emitted from transmitter $IR_{2P}$ 189 having a frequency of 60 KHz (which is a modulation frequency identifying the Exit F) at all time. The comparator 564 of IVU 561 identifies the signal and sends this information to CPU 562. CPU 562 then processes this infrared frequency of 60 KHz with the frequency of 10 KHz the frequency identifying Entrance A recorded in its memory 563 while passing the main booth 4 of the Entrance A. The execution results in a toll of, assumingly, ฿160 needs to be collected. CPU 562 then subtracts this number from the cash balance present in a prepaid card 20 inserted in IVU 561 and instructs card reader/writer 578 to rewrite a new number resulted from the substraction onto the card represents a new cash balance. For example, if the previous cash balance was ฿800, then after the subtraction of ฿160 it will be left with ฿640 to be rewritten onto card 20 by card reader/writer 578. The number ฿640 is to be then displayed on the screen 519 of card reader/writer 578.

After the new cash balance has been written onto prepaid card 20, the card reader/writer 578 ejects out prepaid card 20 and IVU 561 is automatically turned off.

Figure 44:
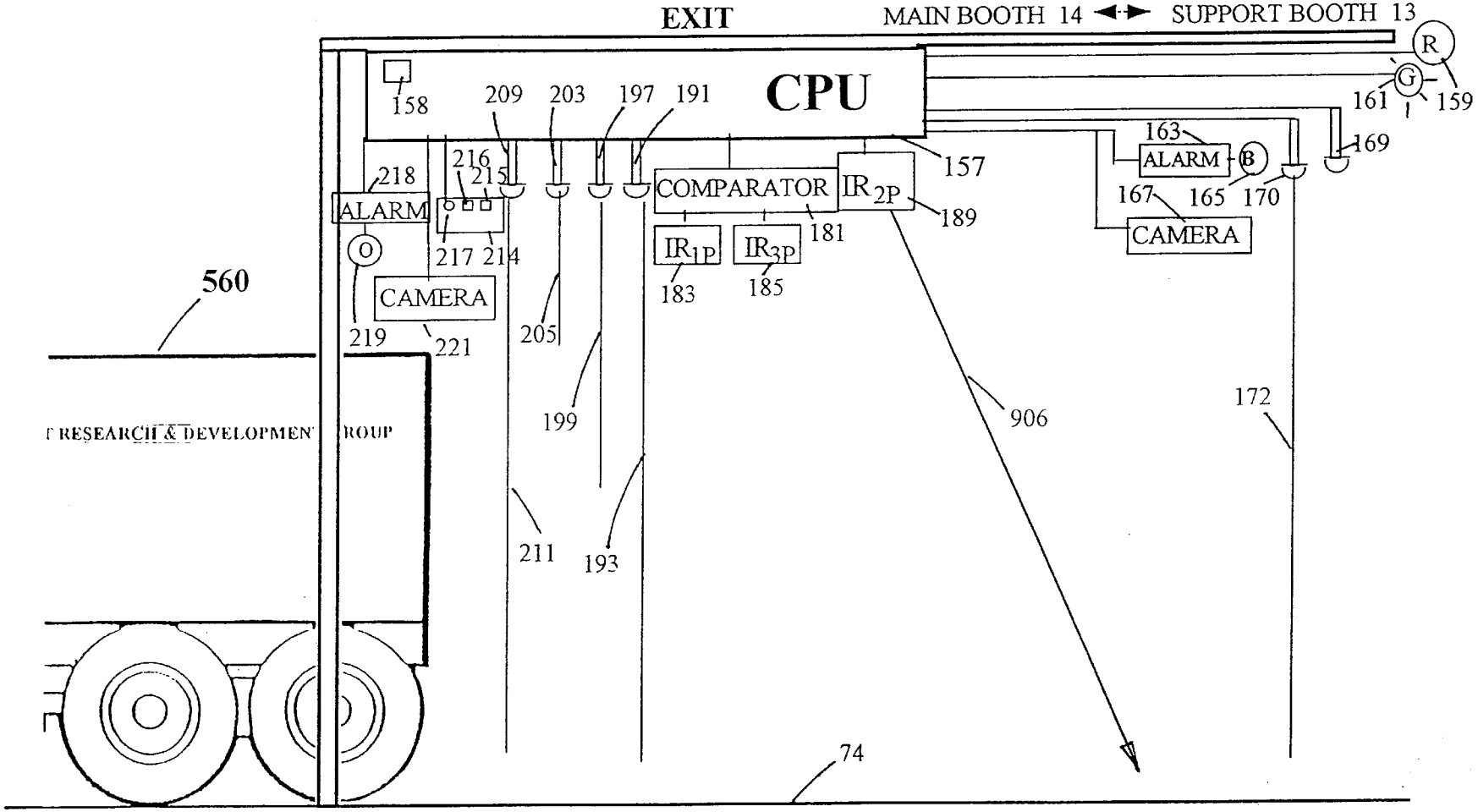
FIG. 44 shows a truck while moving out from the infrared beam of switch on tailing-down type at the main booth of an exit.

When truck 560 moves a little further, there are no infrared infrared beams 193, 199 and 205, to be blocked by truck 560 since the an infrared beam 802 of 3 KHz frequency emitted from $IR_{1S}$ 568 and received by $IR_{1P}$ 183 will actuate the CPU 157 to order LEDs 191, 197 and 203, to stop emitting out the infrared beams 193, 199 and 205, respectively. CPU also cancels the actuation of alarm 218, orange light bulb 219 and camera 221. Thus, the truck moves forward until it blocks an infrared beam 211 of switch on tailing-down type. Only after truck 560 has moved out from the beam 211 as in FIG. 44 that CPU commands LEDs 191, 197 and 203 to reemit out the infrared beams 193, 199 and 205, respectively, once again. At the same time at support booth 13, CPU 157 commands the red light bulb 159 to turn off, LED 169 to stop emitting an infrared beam 171 and green light 161 to start blinking once again. This is a signal means that truck 560 has already moved out from the main booth 14 at Exit F and get off the expressway 1, thus allowing that a next vehicle waiting at a waiting zone outside the support booth 13 may now pass into support booth 13 and move forward to main booth 14.

In a similar manner, from Entrance B (identification frequency of 12 KHz), 15 saloon cars paying ฿110 each, 20 vans paying ฿130 each, and 30 trucks paying ฿150 each;

from Entrance C (identification frequency of 14 KHz), 10 saloon cars paying ฿100 each, 20 vans paying ฿120 each, and 40 trucks paying ฿130 each;

Assumingly, these are all the vehicles exited at Exit F as the time has passed for 1 hr. 2 min. and 5 sec. which is at 11.02.05 am, Aug. 8, 1995; the screen 214 at Exit F would display as shown in FIG. 15 as follows:

| | | | |
|---|---|---|---|
| 1 hr. 2 min. 5 sec. | | 11.02.05 am, August 8, 1995 | |
| AT EXIT F | | | |
| From Entrance A | | | |
| Saloon cars | 10 | Tolls collected (฿) | 1200 |
| Vans | 10 | Tolls collected (฿) | 1400 |
| Trucks | 10 | Tolls collected (฿) | 1600 |
| From Entrance B | | | |
| Saloon cars | 15 | Tolls collected (฿) | 1650 |
| Vans | 20 | Tolls collected (฿) | 2600 |
| Trucks | 30 | Tolls collected (฿) | 4500 |
| From Entrance C | | | |
| Saloon cars | 10 | Tolls collected (฿) | 1000 |
| Vans | 20 | Tolls collected (฿) | 2400 |
| Trucks | 40 | Tolls collected (฿) | 5200 |
| A total of tolls colected (฿) | | | 21550 |

In a similar manner, at Exit E with identification frequency of 58 KHz, if the time is reset to zero at 12.00 am Aug. 8, 1995; then there appears on the display screen 214 at the Entrance E as in FIG. 12, where tolls collected from each category of vehicles are all 0.

At 1.15.10 pm Aug. 8, 1995; suppose there were from Entrance A (identification frequency of 10 KHz), 30 saloon cars paying ฿100 each, 20 vans paying ฿110 each, and 10 trucks paying ฿120 each;

from Entrance B (identification frequency of 12 KHz), 10 saloon cars paying ฿90 each, 20 vans paying ฿100 each, and 10 trucks paying ฿110 each;

from Entrance C (identification frequency of 14 KHz), 10 saloon cars paying ฿80 each, 15 vans paying ฿90 each, and 20 trucks paying ฿100 each;

then there would appear on the display screen 214 at the Exit E as in FIG. 13 as follows:

| | | | |
|---|---|---|---|
| 1 hr. 15 min. 10 sec. | | 1.15.10 pm; August 8, 1995 | |
| AT EXIT F | | | |
| From Entrance A | | | |
| Saloon cars | 30 | Tolls collected (฿) | 3000 |
| Vans | 20 | Tolls collected (฿) | 2200 |
| Trucks | 10 | Tolls collected (฿) | 1200 |
| From Entrance B | | | |
| Saloon cars | 10 | Tolls collected (฿) | 900 |
| Vans | 20 | Tolls collected (฿) | 2000 |
| Trucks | 10 | Tolls collected (฿) | 1100 |
| From Entrance C | | | |
| Saloon cars | 10 | Tolls collected (฿) | 800 |
| Vans | 15 | Tolls collected (฿) | 1350 |
| Trucks | 20 | Tolls collected (฿) | 2000 |
| A total of tolls collected (฿) | | | 14550 |

In a similar manner, at Exit D with identification frequency of 56 KHz, if the time is reset zero at 14.00 am Aug. 8, 1995; at 3.20.30 pm Aug. 8, 1995; suppose there were from Entrance A (identification frequency of 10 KHz), 20 saloon cars paying ฿80 each, 15 vans paying ฿90 each, and 10 trucks paying ฿100 each;

from Entrance B (identification frequency of 12 KHz), 10 saloon cars paying ฿70 each, 30 vans paying ฿80 each, and 20 trucks paying ฿90 each;

from Entrance C (identification frequency of 14 KHz), 20 saloon cars paying ฿60 each, 10 vans paying ฿70 each, and 20 trucks paying ฿80 each;

then there would appear on the display screen 214 at the Exit D as in FIG. 11 as follows:

| | | | |
|---|---|---|---|
| 1 hr. 20 min. 30 sec. | | 3.20.30 pm; August 8, 1995 | |
| AT EXIT F | | | |
| From Entrance A | | | |
| Saloon cars | 20 | Tolls collected (฿) | 1600 |
| Vans | 15 | Tolls collected (฿) | 1350 |
| Trucks | 10 | Tolls collected (฿) | 1000 |
| From Entrance B | | | |
| Saloon cars | 10 | Tolls collected (฿) | 700 |
| Vans | 30 | Tolls collected (฿) | 2400 |
| Trucks | 20 | Tolls coliected (฿) | 1800 |
| From Entrance C | | | |
| Saloon cars | 20 | Tolls collected (฿) | 1200 |
| Vans | 10 | Tolls collected (฿) | 700 |
| Trucks | 20 | Tolls collected (฿) | 1600 |
| A total of tolls collected (฿) | | | 12350 |

Thus, at each exit, a total tolls collected at each time point from a reset time zero can be shown on the display screen which also indicates the number of each category of vehicles coming from any of the entrances to an expressway 1. This, in turn, can help verifying the revenue of each particular expressway in details which can be done at any time point.

The Reason Why There Must be Support Booth at The Entrance and The Exit

Figure 45:
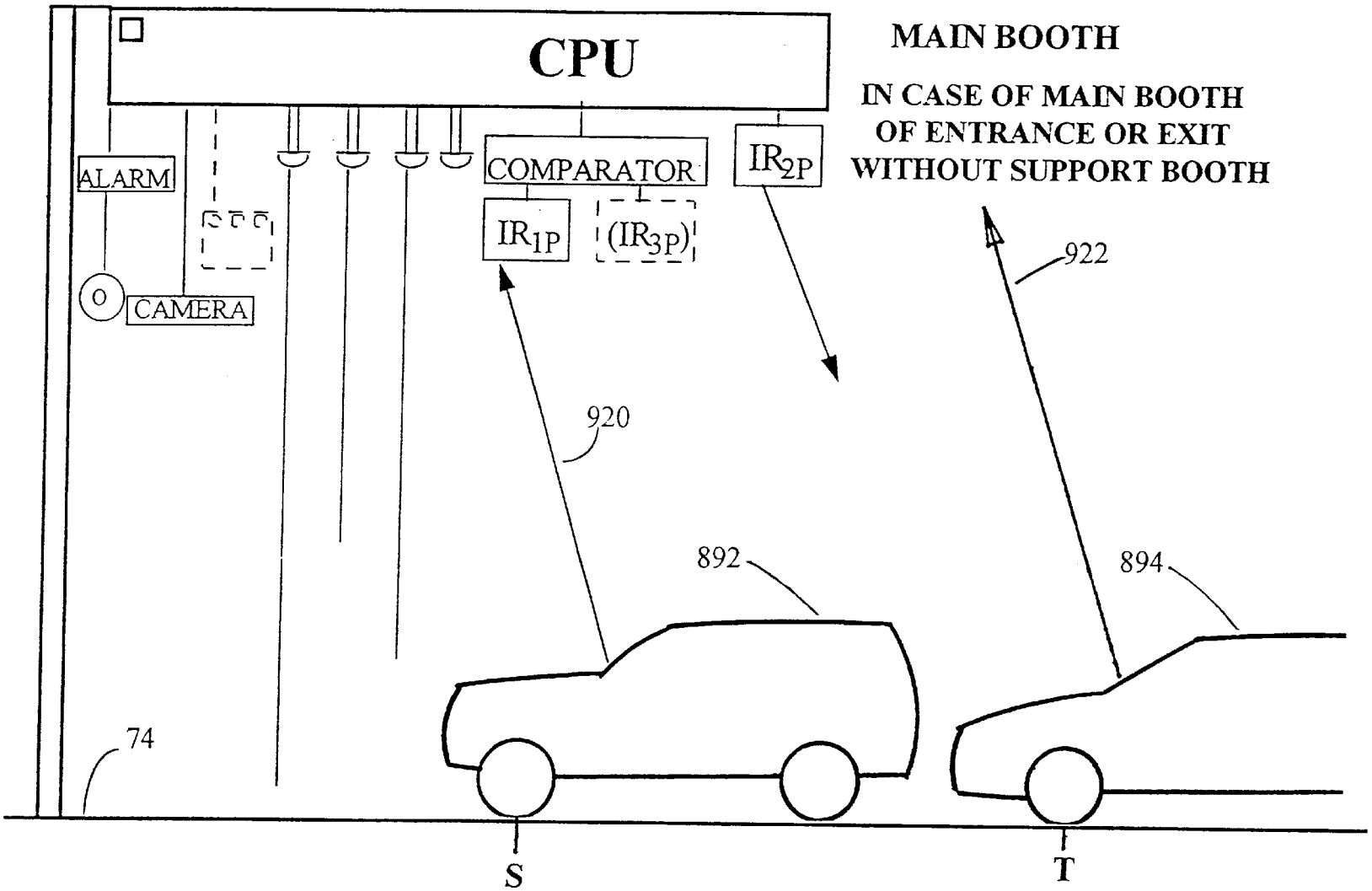
FIG. 45 shows the situation when a vehicle arrives at the toll booth of an entrance or an exit without a support booth.

As in FIG. 45, it shows the condition where there is only a main booth at the entrance or the exit without support booth. When there is traffic jam at the entrance or the exit of such toll booth without support booth, there can always be problem as follows:

Supposing there are 2 vehicles, vehicles 892 and 894 at the main booth; where vehicle 892 is at position S and the transmitter $IR_{1S}$ of the IVU of this vehicle transmits an infrared beam 920 to be received by the receiver $IR_{1P}$ at the main booth (both of the entrance and the exit). The CPU at the main booth then commands the LED(s) to stop emitting the infrared beam(s) of switch on tailing-up type correspond to the category of the vehicle (which may be a saloon car, a van or a truck).

Figure 46:
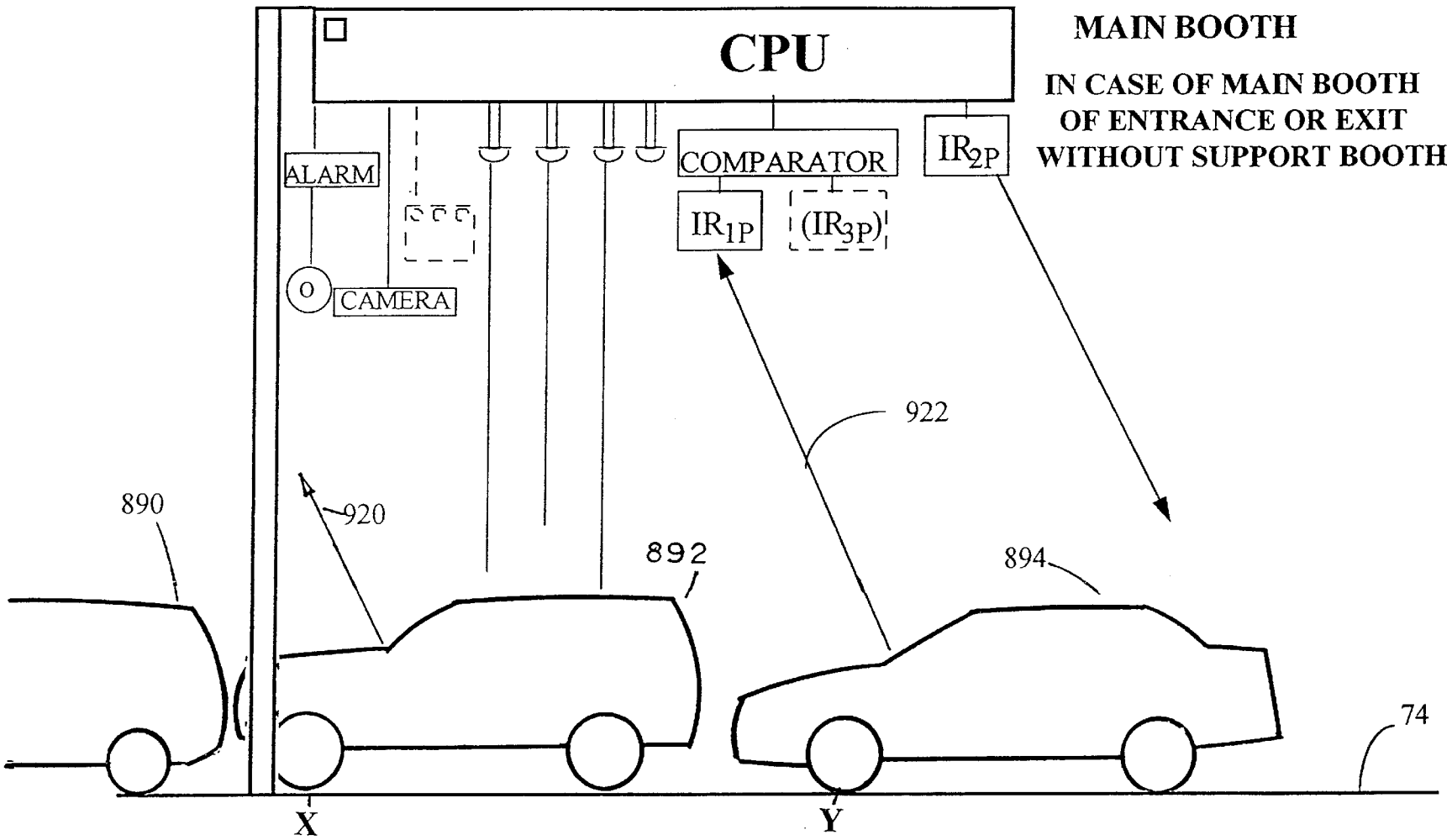
FIG. 46 shows the traffic jam at the toll booth of an entrance or an exit without a support booth.

FIG. 46 shows that when vehicle 892 moves further and stop at position X, no matter what the case is, for example, the engine is out of order or the traffic is jam; where there is another vehicle 890 stops in front of vehicle 892 and obstructs such that vehicle 892 can not move further and away from the toll booth. The vehicle 892 is held still and thus blocks the infrared beam of the switch on tailing-down type of the main booth. At this moment, CPU of the main booth will not yet command LED(s) to reemit the infrared beam(s) of switch on tailing-up type as in FIG. 45.

As vehicle 892 is at this position X, the vehicle 894 moves from a position T in FIG. 45 to a new position Y as in FIG. 46. Where at this position Y, $IR_{1S}$ of the IVU in vehicle 894 transmits the infrared beam 922 to the receiver $IR_{1P}$ of the toll booth. But in the present invention, if any vehicle is still blocking the infrared beam of switch on tailing-down type at the main booth and has not yet moved away, CPU will not commands LED(s) to reemit down all the infrared beam(s) of switch on tailing-up type.

Figure 47:
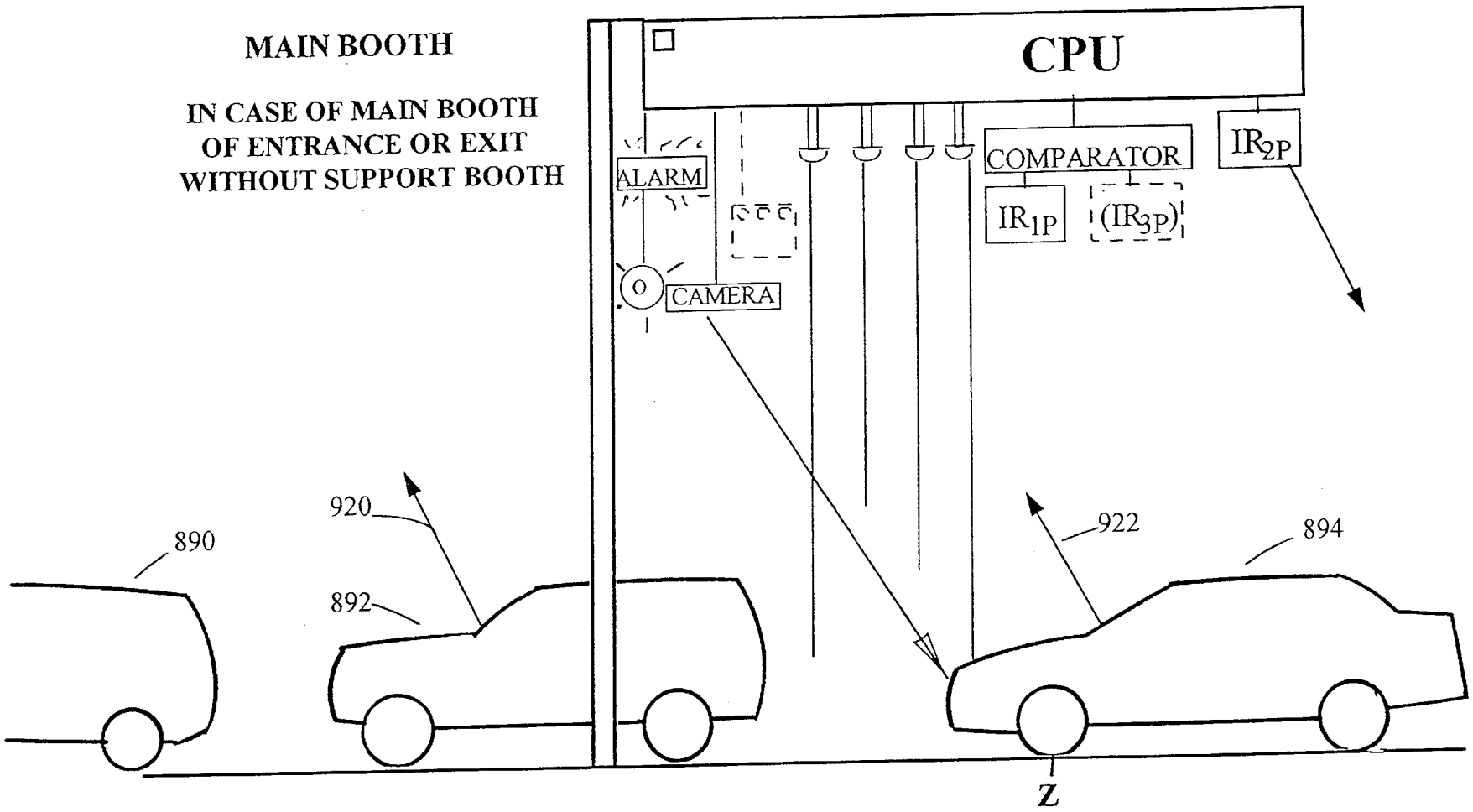
FIG. 47 shows the situation when a vehicle starts moving at the toll booth of an entrance or an exit without a support booth.

As in FIG. 47, at the moment the vehicle 892 has moved out from the infrared beam of switch on tailing-down type, CPU of the toll booth commands LED(s) to reemit the infrared beam(s) of switch on tailing-up type downwards. Therefore, when the vehicle 894 moves from position Y in FIG. 46 to position Z in FIG. 47, it then blocks the first infrared beam of switch on tailing-up type which is the longest one with its end 0.50 meter above the expressway surface. CPU of the toll booth then actuates the alarm, commands the orange light bulb to blink and the camera to take the picture of the license plate of the vehicle 894. The driver of vehicle 894 is then arrested although he does not intend to invade the toll booth.

Accordingly, there must be a support booth both at the entrance and the exit where the vehicle 894 must wait in front of the blinking red light at the support booth. Only after the preceding vehicle 892 has moved out of the infrared beam of switch on tailing-down type at the main booth, and the red light bulb turns off at the same time as the green light starts blinking at the support booth that the vehicle 894 can move through the support booth and enter the main booth zone.

Figure 48:
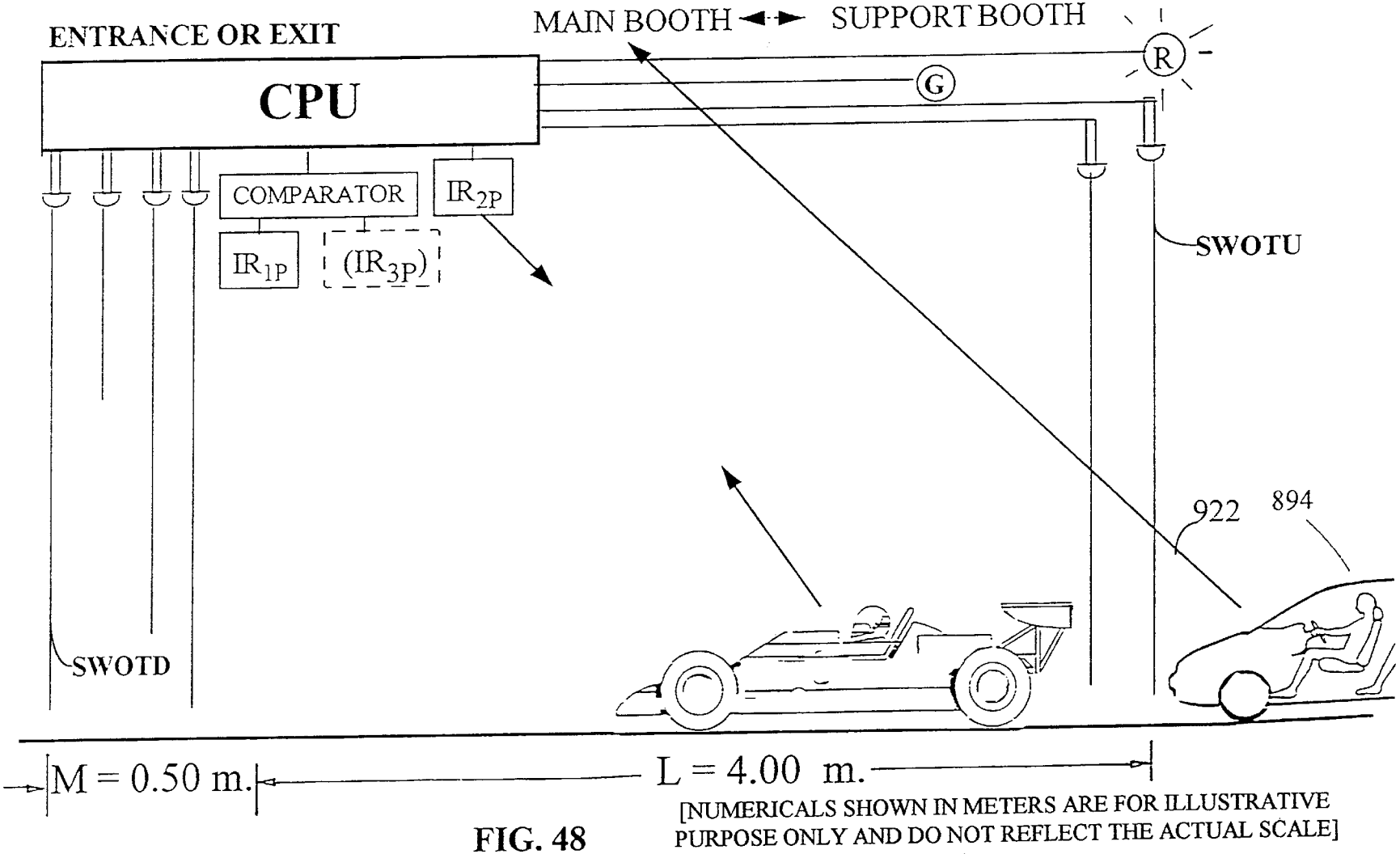
FIG. 48 shows the distance between the support booth and the main booth of an entrance and an exit of an expressway.

As in FIG. 48, a distance between the main booth and the support booth both at the entrance and the exit is the horizontal distance, L, between the infrared beam of switch on tailing-up type at the support booth and the receiver $IR_{1P}$ at the main booth. In the present invention, this distance L is assigned to be 4 meters (or less).

The distance L, is obtained by the hypothesis that when the second vehicle 894 is waiting in front of the blinking red light and the infrared beam of switch on tailing-up type at the support booth, the beam 922 transmitted out from the transmitter $IR_{1S}$ of the IVU in the vehicle 894 must not reach the receiver $IR_{1P}$ at the main booth, as shown in FIG. 48.

The distance M is a distance between the receiver $IR_{1P}$ and the infrared beam of switch on tailing-down type at the main booth of the entrance or the exit, and here is assigned to be 0.50 meter. That is, the distance between the infrared beam of switch on tailing-up type at the support booth and the infrared beam of switch on tailing-down type of the main booth=L+M=4.50 meters.

Therefore, the beam 922 of any type of vehicles can be received by $IR_{1P}$ only after such vehicle has passed the infrared beam of switch on tailing-up type at the support booth and has entered the main booth. Only after the receiver $IR_{1P}$ has received the beam 922 that CPU commands the LED at main booth to stop emitting the infrared beam(s) of switch on tailing-up type corresponded to the category of the vehicle.

Figure 49:
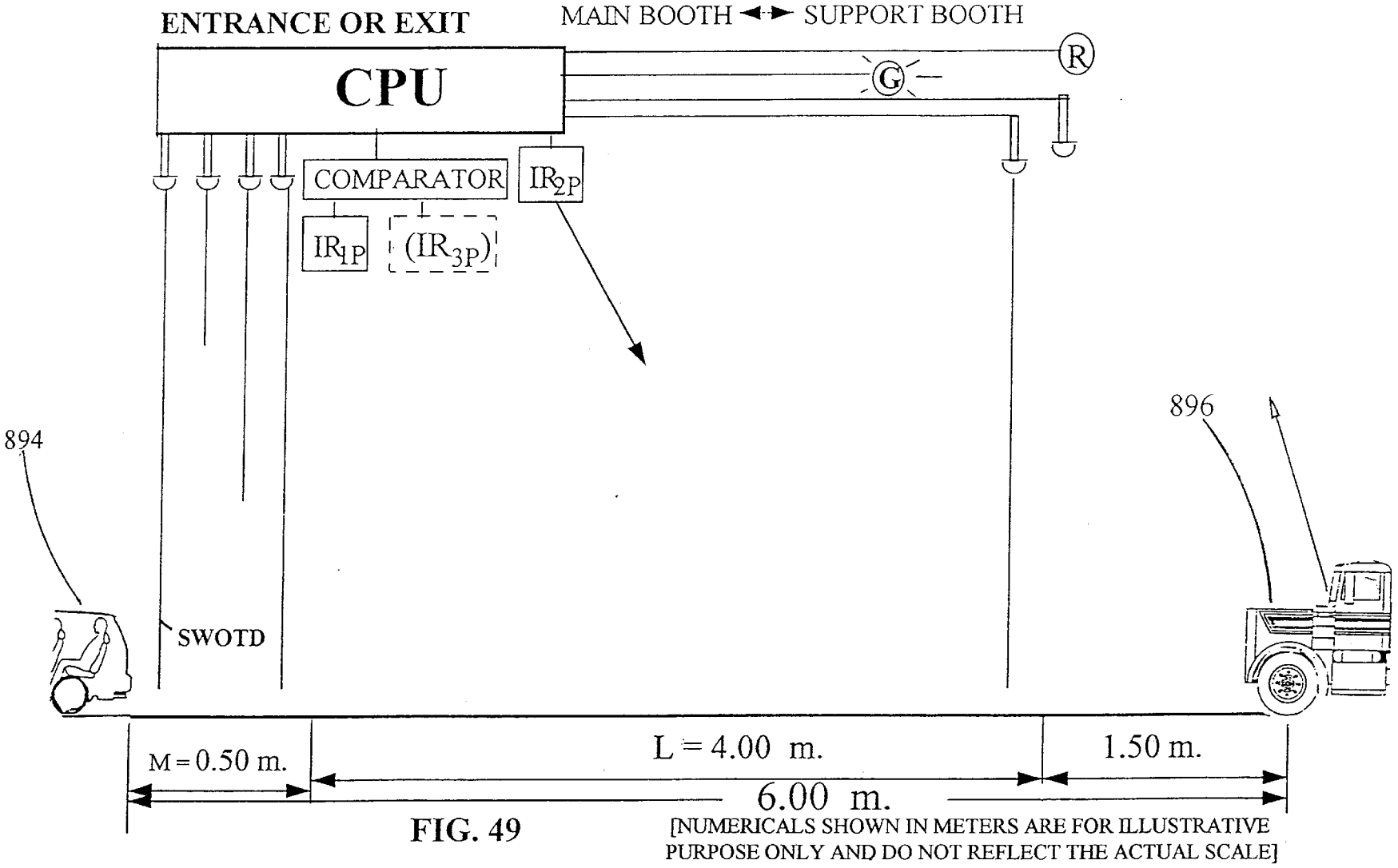
FIG. 49 shows the distance between the first and the second vehicles passing at the toll booth of an entrance or an exit of an expressway.

According to FIG. 49, in a normal situation, if at the entrance or the exit there is no traffic jam, all the vehicles can then pass the toll booth at a normal driving speed which generally move at a distance of about at least 6 meters apart. Thus, when the preceeding vehicle 894 has already moved out and away from the infrared beam of switch on tailing-up type at the main booth, the red light at the support booth is then turned off and the green light starts blinking. The following vehicle 896 receiving such green light signal can therefore enter the support booth with no need to wait, since at the moment the vehicle 894 has moved out of the infrared beam of switch on tailing-down type at the main booth the vehicle 896 is still outside and does not yet reach the infrared beam of switch on tailing-up type at the support booth and is about 6−(4+0.50)=1.5 meters away. Thus, generally, any following vehicle can enter the support booth with no need at all to stop and wait for the green light.

It is evident from what has been described above that the present invention successfully fulfills all the objectives mentioned. It is also apparent to those skilled in the art that all matter contained in the above description or shown in the accompanying drawings be interpreted as illustrative rather than in a limiting sense. Various modifications can be made without departing from the spirit or scope of the toll paying system of the present invention. All variations are included herein, provided they come within the scope of the appended claims and their equivalents. The following claims are intended to cover all of the specific and generic features of the invention as described herein, and all statements of the scope of the invention which, as a matter of language, might be said to fall therebetween.

I claim:

1. An automatic non-computer network system for toll collection from a vehicle moving along an expressway, according to a category said vehicle belongs to and a distance said vehicle travels, using infrared signals as communicating means between devices at toll booths one at an entrance and another at an exit of said expressway and a device in said moving vehicle and as means to calculate toll and differentiate vehicle comprises:

a toll booth at each entrance;

a toll booth at each exit; and an in-vehicle unit to be installed in said vehicle;

wherein first toll booth which is at each entrance of said expressway has a toll-collecting device comprises first support booth and first main booth located at fixed positions apart relatively on said expressway, and first central processing unit (CPU) installed at a relatively fixed position at said first main booth which connected to all other components of said toll booth for controlling functions of all components both at said support booth and at said main booth where said first support booth of said entrance has a booth canopy and all its components positioned at fixed positions relatively at said booth canopy, comprising:

first red light bulb;

first green light bulb;

first voice alarm which can be actuated to give an audible signal, together with a blue light bulb connected thereto;

first camera;

first light-emitting diode (LED) which emits an infrared beam of switch on tailing-up type, where said infrared beam can detect the passage of all vehicles of any different heights equal to or greater than 0.50 meter passing through said first support booth;

second LED, which emits an infrared beam of switch on tailing-down type, positioned relatively rearward to said first LED emitting said infrared beam of switch on tailing-up type from the point said vehicle entering said first support booth, where said infrared beam can detect the passage of all vehicles of any different heights equal to or greater than 0.50 meter passing through said first support booth;

said first main booth of said entrance has a booth canopy and all its components positioned at fixed positions relatively at said booth canopy, comprising:

first comparator;

first infrared signal receiver connected thereto said first comparator to receive an infrared signal of a modulation frequency identifying said vehicle transmitted from a transmitter of said in-vehicle unit installed in said vehicle;

first transmitter, transmitting an infrared beam of a predetermined modulation frequency identifying each particular entrance out at an inclination angle towards said first support booth at all time by command from said first CPU;

third LED emitting an infrared beam of switch on tailing-up type, where said infrared beam can detect the passage of all vehicles of any different heights equal to or greater than 0.50 meter passing through said first main booth;

fourth LED emitting an infrared beam of switch on tailing-up type, where said infrared beam can detect the passage of all vehicles of any heights equal to or greater than 2.0 meters passing through said first main booth but not those of heights less than 2.0 meters;

fifth LED emitting an infrared beam of switch on tailing-up type, where said infrared beam can detect the passage of all vehicles of any heights equal to or greater than 2.80 meters but not those of heights less than 2.80 meters passing through said first main booth;

sixth LED, emitting an infrared beam of switch on tailing-down type, positioned relatively rearward to said three LEDs emitting said infrared beam of switch on tailing-up type from the point said vehicle entering said first main booth, where said infrared beam can detect the passage of all vehicles of any different heights equal to or greater than 0.50 meter passing through said first main booth;

second voice alarm, which can be actuated to give a siren audible signal, with an orange light bulb connected thereto; and second camera.

2. An automatic non-computer network system for toll collection from a vehicle moving along an expressway of claim 1, wherein second toll booth which is at each exit of said expressway has a toll-collecting device comprises second support booth and second main booth located at fixed positions apart relatively on said expressway, having second central processing unit (CPU) installed at a relatively fixed position at said second main booth which connected to all other components of said second toll booth for controlling functions of all components both at said second support booth and at said second main booth where said second support booth has all the components identical to said first support booth; and said second main booth has all the components the same as those of said first main and, in addition, a display screen having a digital clock indicating time, date, month and year at any particular time point, and a timer with its reset button connected thereto and third receiver connected thereto second comparator to receive an infrared signal of a modulation frequency identical to said predetermined modulation frequency identifying said entrance from which said vehicle had entered transmitted from third transmitter of said in-vehicle unit installed in said vehicle where all these additional components also connected thereto said second CPU at said exit.

3. An automatic non-computer network system for toll collection from a vehicle moving along an expressway of claim 2, wherein said in-vehicle unit (IVU) installed relatively in said moving vehicle comprises:

third central processing unit (CPU) with its memory unit (RAM and ROM), capable of processing data received from other components in said IVU, executing calculation of tolls and commanding all other components in said IVU to function where each category of vehicle has said third CPU belongs to its own category;

third comparator;

fourth infrared receiver, connected thereto said third comparator to receive two infrared signals each of a modulation frequency identifying said entrance or said exit transmitted from said transmitters of said entrance and said exit said vehicle had passed through;

third infrared transmitter belongs to each category of said vehicle to transmit an infrared signal of a predetermined modulation frequency for identifying said vehicle to inform first or second CPUs of either said entrance or said exit to command said LED(s) of either main booths not to send out said infrared beam(s) of switch on tailing-up type corresponding to a category of said moving vehicle;

fourth infrared transmitter to transmit an infrared signal whose modulation frequency is identical to predetermined modulation frequency identifying said entrance from which said vehicle had entered;

third voice alarm, with a red light bulb connected thereto;

an information storing means which can be a prepaid card or any medium of mechanisms capable of making payment of toll;

a card reader/writer, having a display screen to show a number representing an amount of money left in an information storing means and capable of reading and writing information onto said information storing means.

4. An automatic non-computer network system for toll collection from a vehicle moving along an expressway of claim 3, wherein said information storing means has information represents amount of money capable of paying said expressway toll contained in a number of count track and information necessary for processing of payment of toll contained in a password track where vehicle driver can purchase said information storing means from toll authority of said expressway.

* * * * *